US007572564B2

(12) United States Patent
Sato et al.

(10) Patent No.: US 7,572,564 B2
(45) Date of Patent: Aug. 11, 2009

(54) TONER FOR ELECTROSTATIC IMAGE DEVELOPMENT, ELECTROSTATIC IMAGE DEVELOPER AND IMAGE FORMING METHOD USING THE SAME

(75) Inventors: Shuji Sato, Minamiashigara (JP); Shigeru Hayashi, Minamiashigara (JP); Katsumi Daimon, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 448 days.

(21) Appl. No.: 11/401,968

(22) Filed: Apr. 12, 2006

(65) Prior Publication Data

US 2007/0092821 A1 Apr. 26, 2007

(30) Foreign Application Priority Data

Oct. 25, 2005 (JP) ..... 2005-309788

(51) Int. Cl.
*G03G 5/06* (2006.01)

(52) U.S. Cl. ..... 430/108.4; 430/109.4; 430/110.1; 430/119.88; 430/119.71; 430/123.42

(58) Field of Classification Search ..... 430/108.4, 430/109.4, 123.42, 110.1, 119.88, 119.71
See application file for complete search history.

(56) References Cited

U.S. PATENT DOCUMENTS

| | | | | |
|---|---|---|---|---|
| 2,297,691 | A * | 10/1942 | Carlson | 430/55 |
| 4,931,375 | A * | 6/1990 | Akimoto et al. | 430/109.4 |
| 5,604,072 | A * | 2/1997 | Unno et al. | 430/108.4 |
| 5,741,617 | A * | 4/1998 | Inaba et al. | 430/108.4 |
| 5,998,080 | A * | 12/1999 | Ohno et al. | 430/110.3 |
| 6,495,300 | B1 * | 12/2002 | Qi et al. | 430/123.42 |
| 6,602,644 | B2 * | 8/2003 | Matsushima et al. | 430/108.4 |
| 6,830,860 | B2 * | 12/2004 | Sacripante et al. | 430/109.4 |
| 7,300,737 | B2 * | 11/2007 | Ayaki et al. | 430/137.15 |

FOREIGN PATENT DOCUMENTS

| | | | |
|---|---|---|---|
| EP | 952495 A1 * | | 10/1999 |
| JP | A 62-129867 | | 6/1987 |
| JP | A 62-170971 | | 7/1987 |
| JP | A 62-170972 | | 7/1987 |
| JP | A 62-205365 | | 9/1987 |
| JP | A 62-276565 | | 12/1987 |
| JP | A 62-276566 | | 12/1987 |
| JP | A 63-038949 | | 2/1988 |
| JP | A 63-038950 | | 2/1988 |
| JP | A 63-038951 | | 2/1988 |
| JP | A 63-038952 | | 2/1988 |
| JP | A 63-038953 | | 2/1988 |
| JP | A 63-038954 | | 2/1988 |
| JP | A 63-038955 | | 2/1988 |
| JP | A 63-038956 | | 2/1988 |
| JP | A 05-001217 | | 1/1993 |
| JP | A 05-005056 | | 1/1993 |
| JP | A 05-112715 | | 5/1993 |
| JP | A 06-148936 | | 5/1994 |
| JP | A 06-194874 | | 7/1994 |
| JP | 2000147832 A | * | 5/2000 |
| JP | A 2002-049180 | | 2/2002 |
| JP | A 2004-264331 | | 9/2004 |
| JP | A 2005-062510 | | 3/2005 |

OTHER PUBLICATIONS

Diamond, Arthur S & David Weiss (eds.) Handbook of Imaging Materials, 2nd ed.. New York: Marcel-Dekker, Inc. (Nov. 2001) pp. 145-164.*

Diamond, Arthur S & David Weiss (eds.) Handbook of Imaging Materials, 2nd ed.. New York: Marcel-Dekker, Inc. (Nov. 2001) pp. 182, 183, 187-189.*

* cited by examiner

*Primary Examiner*—Christopher RoDee
(74) *Attorney, Agent, or Firm*—Oliff & Berridge, PLC

(57) ABSTRACT

The present invention relates to a toner for electrostatic image development, comprising a crystalline ester compound synthesized by polymerizing a carboxylic acid component with an alcohol component, a non-crystalline resin, a colorant and a releasing agent, wherein the weight-average molecular weight of the crystalline ester compound is 5000 or less, and the number of carbon atoms in at least one component selected from the carboxylic acid component and the alcohol component is 10 or more.

19 Claims, No Drawings

TONER FOR ELECTROSTATIC IMAGE DEVELOPMENT, ELECTROSTATIC IMAGE DEVELOPER AND IMAGE FORMING METHOD USING THE SAME

CROSS-REFERENCE TO RELATED APPLICATION

This application claims priority under 35 USC 119 from Japanese Patent Application No. 2005-309788, the disclosure of which is incorporated by reference herein.

BACKGROUND OF THE INVENTION

1. Field of the Invention

The present invention relates to a toner for electrostatic image development used in forming an image by electrophotography, an electrostatic image developer and an image forming method using the same.

2. Description of the Related Art

In electrophotography, an electrostatic image is formed on a photoreceptor through a process of charging and light exposure, the electrostatic latent image is developed by a toner-containing developer to form a toner image, and this toner image is transferred onto a recording medium and fixed to form an image. As the developer used herein, there are two-component developers of a toner and a carrier, and one-component developers using either a magnetic toner or a nonmagnetic toner. Production of the toner generally uses a kneading milling process including melting and kneading a thermoplastic resin with a pigment, a charge controlling agent, and a releasing agent such as wax, then cooling the mixture, pulverizing it and further size classifying the particles.

With respect to the toner produced by the conventional kneading milling process, the shape of the toner particle is indefinite, and the surface structure of the toner particle is changed subtly depending on the pulverizability of the materials used and conditions in the milling process, thus making it difficult to systematically regulate the shape and surface structure of the toner particles.

On the other hand, recently a method of producing a toner by wet processes is proposed as a means capable of systematically regulating the shape and surface structure of the toner. Among wet processes, there are wet globularization methods capable of shape regulation, suspension particle formation methods capable of regulating the surface composition, suspension polymerization methods capable of regulating an internal composition, and emulsion polymerization aggregation methods.

As demand for energy saving is increased, there is need for energy saving in the fixation process that uses a certain amount of electric power in a copier, and for reducing the fixation temperature of toner in order to enlarge the fixation region. Reduction in the fixation temperature of a toner enables reduction in waiting time until the fixation temperature of the surface of a fixation roll is reached after inputting electric power to a copier etc., that is, reduction in warm-up time, as well as long life of a fixation roll, in addition to the energy saving and enlargement of fixation region.

Reduction in the fixation temperature of a toner brings about reduction in the glass transition point of the toner causing a problem of deterioration in the storage stability of the toner, and thus it is difficult to get a reduction in the fixation temperature together with storage stability of the toner. To satisfy both low-temperature fixability and toner storage stability, the toner should have "sharp" melting properties, by which the glass transition point of the toner remains at a high temperature while the viscosity of the toner rapidly reduces at the high-temperature region.

However, the glass transition point and molecular weight of resin used in toners usually have a certain range of variation, and to attain sharp melting properties, the composition and molecular weight of resin need to be closely regulated. For obtaining such a resin, since the molecular weight of the resin needs to be regulated by using a special process or by subjecting the resin to chromatography, is significantly increases the production cost of the resin, and in such processes unrequired resin is formed as a byproduct. That is not preferable from an environmental viewpoint.

As a method of reducing the fixation temperature of the toner, use of crystalline resin as binder resin is proposed (see, for example, Japanese Patent Application Laid-Open (JP-A) No. 62-129867, JP-A No. 62-170971, JP-A No. 62-170972, JP-A No. 62-205365, JP-A No. 62-276565, JP-A No. 62-276566, JP-A No. 63-038949, JP-A No. 63-038950, JP-A No. 63-038951, JP-A No. 63-038952, JP-A No. 63-038953, JP-A No. 63-038954, JP-A No. 63-038955, JP-A No. 63-038956, JP-A No. 05-001217, JP-A No. 06-148936, JP-A No. 06-194874, JP-A No. 05-005056 and JP-A No. 05-112715).

These methods can reduce the fixation temperature, but the viscosity of resin changes significantly with changes in temperature, so during production of a toner, for example during kneading, sufficient viscosity cannot be obtained, and the dispersibility of a colorant, a releasing agent etc. in the resin is not stable, thus easily generating a toner that gives rise to uneven coloration and fixation. When a toner is produced by using the kneading milling method, the kneaded material becomes difficult to mill, so there arises a problem of difficulty in obtaining a toner of small diameter. To solve this problem, there is a method of adding auxiliary agents such as a thickening agent or milling auxiliary agents, but these auxiliary agents are not preferable because they are dispersed in the resin and break-up the crystallinity of the binder resin.

From this viewpoint, techniques of producing toner particles by wet processes not requiring excessive temperature or kneading energy are being extensively studied.

However, achievement of sharp melting properties by means of the molecular weight, distribution of molecular weights and melt viscosity of binder resin, and the amount of crystalline resin included results in a deterioration of resin strength. This may lead to a drop in toner strength and a drop in image strength, and it is not easy to satisfy plural characteristics simultaneously.

In particular, the addition of crystalline resin reduces the ability to enclose a releasing agent etc. in the binder resin, and can also deteriorate the stability of production of particles with respect to regulation of particle size and particle shape, thus exerting an influence on various aspects in addition to qualities of the toner.

On the other hand, recently, in order to give waste free toner, an image forming method using a cleaner-less, toner recycle system has been proposed. Especially with toner used in an image forming method using a toner recycle system uniform particle strength, particle size and shape is required. However, these characteristics are often obstacles to achievement of sharp melting properties.

Furthermore, in recent years, long-life xerography equipment is desired when considering the environmental impact. In particular, for achieving a longer life of a photoreceptor, a photoreceptor using a very hard material such as amorphous silicon and a photoreceptor having a protective layer having a 3-dimensional crosslinked structure on the outermost surface thereof are gradually becoming used.

Generally, the surface of such photoreceptors is difficult to clean so that when a mechanical cleaning means such as a cleaning blade is used as a means of cleaning, high pressure needs to be applied to the contact region between the cleaning means and the photoreceptor. In this case, the pressure applied to toner particles passing through the contact region tends to be increased, and thus high-strength toner particles are required, particularly in a toner recycle system.

However, when crystalline resin is used as binder resin, because the toner particles become soft, they have insufficient strength against high pressure, and are difficult to utilize in a toner recycle system, and external additives can be embedded in the surface of the toner when used for a long time, causing a deterioration in the fluidity of the toner.

In toners using a combination of non-crystalline resins and crystalline resins as binder resin, in order to compensate for such a deterioration in durability (strength), because the dispersibility of a releasing agent in the toner particles and the compatibility between the non-crystalline resin and the releasing agent are inferior, and the releasing agent is exposed at the surface of the toner which deteriorates the storage stability and charging stability.

For the purpose of achieving both low-temperature fixability and toner durability, a toner containing crystalline polyester resin and a releasing agent, wherein the dispersion structure/surface-exposed state of the releasing agent are regulated, is proposed as an attempt at regulating the dispersibility of the releasing agent and the crystalline resin in the toner.

Specific examples include a toner containing a releasing agent in a layer other than the outermost layer thereof, which is produced by multistage polymerization (see JP-A No. 2002-49180), a toner comprising crystalline polyester and non-crystalline polyester as binder resin, wherein the crystalline polyester makes use of block polyester obtained by copolymerizing a non-crystalline block constituting the non-crystalline polyester with a crystalline block (see JP-A No. 2005-62510), and a toner prepared by utilizing a masterbatch (see JP-A No. 2004-264331).

However, these toners are not so practical because both their production method is limited to a specific process and it is complicated. Further, when the amount of crystalline resin and releasing agent contained in the toner is increased to improve low-temperature fixability or releasability, there arises a problem of difficulty in regulation of the dispersibility of the releasing agent.

As described above, low-temperature fixability and the dispersibility and compatibility in binder resin and durability (strength) of a releasing agent contained in a toner are difficult to conventionally satisfy at the same time.

SUMMARY OF THE INVENTION

The present invention has been made in view of the above circumstances and provides a toner for electrostatic image development, which is capable of fixation at low temperature and is excellent in the dispersibility and compatibility in binder resin and strength of a releasing agent contained in a toner, as well as an electrostatic image developer and an image forming method using the same.

A first aspect of the invention is a toner for electrostatic image development, comprising a crystalline ester compound synthesized by polymerizing a carboxylic acid component with an alcohol component, a non-crystalline resin, a colorant and a releasing agent, wherein the weight-average molecular weight of the crystalline ester compound is about 5000 or less, and the number of carbon atoms in at least one component selected from the carboxylic acid component and the alcohol component is 10 or more.

A second aspect of the invention is an electrostatic image developer comprising a toner containing a crystalline ester compound synthesized by polymerizing a carboxylic acid component with an alcohol component, a non-crystalline resin, a colorant and a releasing agent, wherein the weight-average molecular weight of the crystalline ester compound is about 5000 or less, and the number of carbon atoms in at least one component selected from the carboxylic acid component and the alcohol component is 10 or more.

A third aspect of the invention is an image forming method comprising: forming an electrostatic latent image on the surface of a latent image carrier, developing the electrostatic latent image with a toner-containing developer to form a toner image, transferring the toner image onto a recording medium, and fixing the toner image on the recording medium, wherein the toner comprises a crystalline ester compound synthesized by polymerizing a carboxylic acid component with an alcohol component, a non-crystalline resin, a colorant and a releasing agent, the weight-average molecular weight of the crystalline ester compound is about 5000 or less, and the number of carbon atoms in at least one component selected from the carboxylic acid component and the alcohol component is 10 or more.

DETAILED DESCRIPTION OF THE INVENTION

The toner for electrostatic image development according to the present invention (hereinafter, referred to sometimes as simply "toner") comprises a crystalline ester compound synthesized by polymerizing a carboxylic acid component with an alcohol component, a non-crystalline resin, a colorant and a releasing agent, wherein the weight-average molecular weight of the crystalline ester compound is about 5000 or less, and the number of carbon atoms in at least one component selected from the carboxylic acid component and the alcohol component is 10 or more, provided that the number of carbon atoms in the carboxylic acid component refers to the number of carbon atoms excluding carbon atoms constituting a carboxyl group.

Accordingly, the toner of the invention can be fixed at low temperature and is excellent in the dispersibility and compatibility in binder resin and high strength of the releasing agent contained in the toner.

The toner of the invention comprises, in addition to a non-crystalline resin as binder resin, a crystalline ester compound (hereinafter, referred to sometimes as simply "crystalline ester compound") which is synthesized by polymerizing a carboxylic acid component with an alcohol component and is a low-molecular crystalline resin or low-molecular oligomer having a weight-average molecular weight of about 5000 or less, wherein the number of carbon atoms in at least one component selected from the carboxylic acid component and the alcohol component is 10 or more.

This crystalline ester compound, similar to crystalline polyester resin used as binder resin for conventional toner, has a role in lowering the fixation temperature of the toner, and thus, the toner of the invention can be fixed at low temperature.

Although the weight-average molecular weight of the crystalline polyester resin conventionally used as binder resin is usually 20000 or more, the weight-average molecular weight of the crystalline ester compound used in the invention is about 5000 or less. Because the crystalline ester compound has low molecular size, it is excellent in permeation and compatibility with other components in the toner. That is, the dispersibility/compatibility, in binder resin, of a hydrophobic releasing agent which is poor in compatibility with non-crystalline resin that is a binder resin component essential for securing the strength of toner particles can be improved to suppress the exposure of the releasing agent to the surface of the toner. Accordingly, the deterioration in charging properties and storage ability attributable to exposure of the releasing agent to the surface of the toner can be prevented. Even if crystalline resin that is inferior to non-crystalline resin in compatibility as binder resin is simultaneously used, the dispersibility/compatibility of the crystalline resin with the non-crystalline resin can be improved, and thus the charging properties and storage ability attributable to the exposure of the crystalline resin to the surface of the toner can be prevented.

When the weight-average molecular weight of the crystalline ester compound is higher than 5000, the crystalline ester compound tends to be unevenly present without uniform dispersion in the non-crystalline resin, and the dispersibility/compatibility of components such as a releasing agent inherently lack in compatibility with the non-crystalline resin cannot be secured. Accordingly, the weight-average molecular weight of the crystalline ester compound is preferably 4000 or less, more preferably 3000 or less.

When the weight-average molecular weight of the crystalline ester compound is too low, hydrophilic functional groups are increased at the ends of the resin molecules and the acid value is increased, so in a process of particle forming particularly in an aqueous system, the ability to enclose the releasing agent in the toner easily becomes difficult to cause problems such as reduction in charging properties, etc. Accordingly, the weight-average molecular weight of the crystalline ester compound is preferably 1000 or more.

The number of carbon atoms in at least one component selected from the carboxylic acid component and the alcohol component, which constitute the crystalline ester compound is required to be 10 or more. This is necessary for increasing the electric resistance of the crystalline ester compound and for satisfying, suitable compatibility with the non-crystalline resin while maintaining the melting point in a suitable range. When the number of carbon atoms in each of the carboxylic acid component and alcohol component is less than 10, the electric resistance is decreased and the melting point is also decreased, and thus charging properties and storage ability are deteriorated.

The structure of a main-chain moiety of the carboxylic acid component and/or alcohol component used in synthesis of the crystalline ester compound is not particularly limited, and may be a linear structure, a branched structure or a structure containing an aromatic group.

In the branched structure, however, the flexibility of a molecular chain of the crystalline ester compound may be deteriorated, and components such as the releasing agent become poor in dispersibility/compatibility with the non-crystalline resin.

In the structure containing an aromatic group, the crystalline ester compound may function as a plasticizer made of an aromatic ester.

On the other hand, when the plasticizer described above is added to the toner, there is the case where 1) reduction in toner strength due to reduction in the elastic modulus of the toner and 2) reduction in the glass transition point of the non-crystalline resin used as binder resin give rise to reduction in the viscosity of the non-crystalline resin at a temperature region for storing the toner, and the releasing agent dispersed in the toner is fluidized during storage to form a large domain and is easily exposed to the surface of the toner to cause deterioration in charging properties.

Accordingly, a main-chain moiety of at least one of the carboxylic acid component and alcohol component used in synthesis of the crystalline ester compound is preferably a linear chain structure, and the main-chain moiety of both the components more preferably contains a linear chain structure.

When the main-chain moiety of either component contains a linear chain structure, the number of carbon atoms in the linear chain structure is required to be 10 or more, and when the main chain moiety of both the components contains a linear chain structure, the number of carbon atoms in the main-chain moiety (linear chain structure) of at least one component is required to be 10 or more.

A long linear chain structure is thereby contained in the main-chain moiety of the crystalline ester compound to further increase the flexibility of the molecular chain thereby further improving the dispersibility and compatibility of components such as the releasing agent with the non-crystalline resin.

When the number of carbon atoms is less than 10, the crystalline ester compound molecule becomes poor in flexibility, thus failing to sufficiently improve the dispersibility and compatibility of components such as the releasing agent with the non-crystalline resin and causing deterioration in charging properties and storage ability. From this viewpoint, the number of carbon atoms is more preferably 12 or more, further more preferably 14 or more. From practical viewpoints such as the availability of starting monomer material used in synthesis, the number of carbon atoms is preferably 16 or less.

The linear chain structure may be either a saturated aliphatic group (that is, an alkylene group) or an unsaturated aliphatic group, but in respect of improvement in the crystallinity of the crystalline ester compound, the linear chain structure is most preferably an alkylene group. For attaining high crystallinity, the number of carbon atoms in the alkylene group is preferably 10 or more.

When the main-chain moiety of the carboxylic acid component and/or alcohol component used in synthesis of the crystalline ester compound is a group of very low polarity such as an alkylene group, the toner of the invention, even if repeatedly subjected to heating and cooling, is difficult to change the phase state before and after heating and cooling. Accordingly, even if the toner is formed into an image through a heating and cooling process at the time of fixation, the same phase state as in the toner before fixation is maintained. Accordingly, reduction in gloss of an image attributable to phase separation of components in the toner after fixation, and reduction in transparency of OHP sheet used, can be easily depressed.

Preferably, the melting point of the toner of the invention is in the range of 50 to 90° C., and simultaneously satisfies the following equation (1):

$$0.9 \leqq Y/X \leqq 1.0 \quad (1)$$

wherein X represents the heat quantity (J/g) of the maximum endothermic peak of the toner after production (toner in an initial stage not subjected to any heat treatment after production), measured under heating from room temperature to 150° C. at an increasing temperature rate of 10° C./min. by a differential scanning calorimeter, and Y represents the heat quantity (J/g) of the maximum endothermic peak of the toner after making the measurement of the heat quantity X, measured under heating from 0° C. to 150° C. at an increasing temperature rate of 10° C./min. by a differential scanning calorimeter.

The melting point and maximum endothermic peak are measured according to ASTMD3418-8 by using a differential scanning calorimeter (DSC60A manufactured by Shimadzu Corporation). The melting points of indium and zinc are used in temperature correction in a detection part of the apparatus, and the heat of fusion of indium is used in correction of heat quantity. With an empty pan set for comparison, a sample is placed on an aluminum pan and measured at an increasing temperature rate of 10° C./min. as described above. The heat quantities X and Y in the maximum endothermic peak can be determined by converting, into heat quantity, the area of the maximum endothermic peak (area surrounded by the base line and a curve of the endothermic peak) in a chart obtained by measurement.

In the invention, the melting point and the heat quantities X and Y of the maximum endothermic peak are attributable to the crystalline ester compound contained in the toner, and when the melting point is out of the range of 50 to 90° C., the toner may be deteriorated in storage ability or may be hardly fixed at low temperature. When the formula (1) is not satisfied even if the toner has a melting point in the range of 50 to 90° C. so as to satisfy storage ability and fixation at low temperature, the toner of the invention, when subjected repeatedly to heating and cooling, changes the phase state significantly before and after heating and cooling, so reduction in the gloss of an image attributable to phase separation of components in the toner after fixation, or reduction in transparency of OHP sheet used, may occur. The Y/X value in the formula (1) is more preferably in the range of 0.95 to 1.0.

The average dispersion diameter of the releasing agent dispersed and contained in the toner of the invention is preferably in the range of 0.3 to 0.8 μm, more preferably in the range of 0.4 to 0.8 μm.

When the average dispersion diameter of the releasing agent is less than 0.3 μm, the releasability may be inferior, and this tendency occurs more easily particularly when the process speed is high. When the average dispersion diameter is greater than 0.8 μm, reduction in the transparency of OHP sheet used, and exposure of the releasing agent component to the surface of the toner, may significantly occur.

The standard derivation of the dispersion diameter of the releasing agent is preferably 0.05 or less, more preferably 0.04 or less. When the standard derivation of the dispersion diameter of the releasing agent is greater than 0.05, the releasability, the transparency of OHP sheet used and the exposure of the releasing agent component to the surface of the toner may be adversely influenced.

The average dispersion diameter of the releasing agent dispersed and contained in the toner is determined by analyzing a TEM (transmission electron microscope) photograph with an image analyzer (Luzex image analyzer, manufactured by Nireko Co., Ltd.) and calculating the mean dispersion diameter (=(major axis+minor axis)/2) of the releasing agent in 100 toner particles, and on the basis of the individual dispersion diameters thus obtained, the standard derivation is determined.

The degree of exposure of the releasing agent to the surface of the toner is preferably in the range of 5 to 12 atom %, more preferably 6 to 11 atom %. When the degree of exposure is less than 5 atm %, the fixability is deteriorated at the high temperature side particularly in a system used at high speed, while when the degree of exposure is higher than 12 atm %, the developability and transferability may be lowered in use for a long time because of maldistribution and embedding of the external agent.

The degree of exposure is determined by XPS (X ray photoelectron spectroscopy) measurement. As the XPS measuring instrument, JPS-900MX manufactured by JEOL with MgKα ray as an X-ray source at an accelerating voltage of 10 kV and an emission current of 30 mA. By a method of peak separation of $C_{1S}$ spectrum, the amount of the releasing agent on the surface of the toner is quantified. In the peak separation method, the measured $C_{1S}$ spectrum is separated into the components by curve fitting with the method of least squares. As spectra of the components on which the separation is based, $C_{1S}$ spectra obtained by measuring each component, that is, the releasing agent, binder resin and crystalline ester compound used in preparing the toner are used. That is, the degree of exposure is defined as the proportion of the percentage of carbon atoms of releasing agent derived form 1s orbits, compared to the total number of carbon atoms derived from 1s orbits.

Then, the method of producing the toner of the invention, constituent materials etc. are described in more detail.

The toner of the invention can be produced through a conventional toner production method, but is preferably produced by so-called wet process, that is, through a process of forming colored resin particles containing a crystalline ester compound, non-crystalline resin, a colorant and a releasing agent in water, an organic solvent or a mixed solvent thereof, and a process of washing and drying the colored resin particles.

Such wet process includes, but is not limited to, a suspension polymerization method that involves suspending a crystalline ester compound, a colorant, a releasing agent and a component used if necessary, together with a polymerizable unit forming binder resin such as non-crystalline resin, to polymerize the polymerizable unit, a solution suspension method that involves dissolving toner constituent materials such as a crystalline ester compound, non-crystalline resin, a colorant and a releasing agent in an organic solvent, dispersing the mixture in a suspended state in an aqueous solvent, and then removing the organic solvent, and an emulsion polymerization aggregation method that involves preparing binder resin components such as a crystalline ester compound and non-crystalline resin to hetero-aggregate them with a dispersion of a pigment, a releasing agent etc. and then fusing them. Among these methods, the emulsion polymerization aggregation method is most suitable because of excellent toner particle diameter regulation, narrow particle size distribution, shape regulation, narrow shape distribution, internal dispersion regulation, etc.

When the emulsion polymerization aggregation method is used, the toner of the invention is produced at least through a process of forming aggregated particles in a starting dispersion comprising a mixture of a crystalline ester compound dispersion having the crystalline ester compound dispersed therein, a non-crystalline resin particle dispersion having the non-crystalline resin dispersed therein, a colorant dispersion having the colorant dispersed therein and a releasing agent dispersion having the releasing agent dispersed therein, and a process of fusing the aggregated particles by heating the starting dispersion having the aggregated particles formed therein, to a temperature not lower than the glass transition temperature of the non-crystalline resin. Other dispersions such as an inorganic particle dispersion and a crystalline resin particle dispersion having crystalline resin dispersed therein may be added if necessary to the starting dispersion.

The materials constituting the toner of the invention include a crystalline ester compound, non-crystalline resin, a colorant and a releasing agent, and if necessary crystalline resin can also be used in a small amount.

The "crystalline resin" in the invention means crystalline resin which though its repeating unit may be the same as or different from that of the "crystalline ester compound", has a weight-average molecular weight of greater than 5000, and usually means crystalline resin having a weight-average molecular weight of 10000 or more.

-crystalline Resin-

The crystalline resin can give further excellent low-temperature fixability because it has a melting point thus significantly reducing viscosity at the specific temperature, and upon heating of the toner at the time of fixation, can reduce the difference between the temperature upon initiation of thermal activity of crystalline resin molecules and the temperature at which fixation is feasible. The content of the crystalline resin in the toner is preferably in the range of 1 to 10%, more preferably 2 to 8%.

Preferably the crystalline resin used in the invention has a melting point in the range of 45 to 110° C. to secure low-temperature fixability and the storage stability of the toner. When the melting point is lower than 45° C., storage of the toner is difficult, while when the melting point is higher than 110° C., the effect of low-temperature fixability cannot be enjoyed. The melting point of the crystalline resin is preferably in the range of 50 to 100° C., more preferably in the range of 55 to 90° C. The melting point of the resin is determined by a method shown in JIS K-7121:87, the disclosure of which is incorporated herein by reference.

The type of the crystalline resin used as binder resin in the invention is not particularly limited insofar as it has a melting point in the range of 45 to 110° C. The melting point of the crystalline resin is preferably in the range of 50 to 100° C., more preferably in the range of 55 to 90° C. Preferably the toner containing the binder resin in the invention makes use of crystalline resin having a region in which the storage elastic modulus G' and loss elastic modulus G" are changed by 2 orders of magnitude or more for at least one difference in temperature range of 10° C. in the temperature range of 45 to 110° C. The toner containing the binder resin in the invention makes use of crystalline resin having a region in which the storage elastic modulus G' and loss elastic modulus G" are changed by 2 orders of magnitude or more for at least one difference in temperature range of 10° C. preferably in the temperature range of 60 to 90° C.

The number-average molecular weight (Mn) of the crystalline resin is preferably 2000 or more, and is more preferably 4000 or more. When the number-average molecular weight (Mn) is less than 1500, the toner may penetrate into the surface of a recording medium such as paper, thus causing uneven fixation at the time of fixation or reducing the resistance of a fixed image to bending.

The crystalline resin used in the invention is not particularly limited insofar as it is a resin having crystallinity and a weight-average molecular weight of 5000 or more, and specific examples thereof include crystalline polyester resin, crystalline vinyl resin etc., among them, the crystalline polyester resin is preferable from the viewpoints of charging properties and adhesion to paper at the time of fixation and regulation of the melting point in the preferable range. The crystalline resin is more preferably aliphatic crystalline polyester resin having a suitable melting point.

Specific examples of the crystalline vinyl resin include vinyl resins using long-chain alkyl or alkenyl(meth)acrylates such as amyl(meth)acrylate, hexyl(meth)acrylate, heptyl (meth)acrylate, octyl(meth)acrylate, nonyl(meth)acrylate, decyl(meth)acrylate, undecyl(meth)acrylate, tridecyl(meth) acrylate, myristyl(meth)acrylate, cetyl(meth)acrylate, stearyl (meth)acrylate, oleyl(meth)acrylate and behenyl(meth)acrylate. In the specification, the term "(meth)acryl" refers to both "acryl" and "methacryl".

The crystalline polyester resin is synthesized from a carboxylic acid (dicarboxylic acid) component and an alcohol (diol) component. Hereinafter, the carboxylic acid component and the alcohol component are described in more detail. The crystalline polyester resin in the invention also includes a copolymer produced by copolymerizing a crystalline polyester resin with another component in an amount of 50 wt % or less based on the main chain of the crystalline polyester resin.

-Carboxylic Acid Component-

The carboxylic acid component is preferably an aliphatic dicarboxylic acid, particularly preferably a linear carboxylic acid, and examples thereof include, but are not limited to, oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid, 1,11-undecanedicarboxylic acid, 1,12-dodecanedicarboxylic acid, 1,13-tridecanedicarboxylic acid, 1,14-tetradecanedicarboxylic acid, 1,16-hexadecanedicarboxylic acid and 1,18-octadecanedicarboxylic acid, and lower alkyl esters and acid anhydrides thereof.

The carboxylic acid component preferably includes components such as a dicarboxylic acid component having a double bond and a dicarboxylic acid component having a sulfonic acid group, besides the above-mentioned aliphatic dicarboxylic acid component. The dicarboxylic acid component having a double bond includes not only components derived from dicarboxylic acids having double bonds but also components derived from lower alkyl esters or acid anhydrides of dicarboxylic acids having double bonds. The dicarboxylic acid component having a sulfonic acid group includes not only components derived from dicarboxylic acids having sulfonic acid groups but also components derived from lower alkyl esters or acid anhydrides of dicarboxylic acids having sulfonic acid groups.

The dicarboxylic acid having a double bond can be used preferably in crosslinking the entire resin by utilizing double bonds therein for preventing hot offset upon fixation. Examples of the dicarboxylic acid include, but are not limited to, fumaric acid, maleic acid, 3-hexenedioic acid and 3-octenedioic acid, and lower alkyl esters and acid anhydrides thereof. Among them, fumaric acid, maleic acid etc. are preferable from the viewpoint of costs.

The dicarboxylic acid having a sulfonic acid group is effective in improving dispersion of a colorant such as a pigment or the like. When the entire resin is emulsified or suspended in water to form particles, presence of the sulfonic group enables the emulsification or suspension of the resins without a surfactant as will be described hereinafter. Examples of the dicarboxylic acid having a sulfonic acid group include, but are not limited to, sodium 2-sulfoterephthalate, sodium 5-sulfoisophthalate and sodium sulfosuccinate, and lower alkyl esters and acid anhydrides thereof. Among them, sodium 5-sulfoisophthalate or the like is preferable from the viewpoint of costs.

The content of the carboxylic acid component other than the aliphatic dicarboxylic acid component in the carboxylic acid component (the dicarboxylic acid component having a double bond and/or the dicarboxylic acid component having a sulfonic acid group) is preferably 1 to 20% by constitutional mole, more preferably 2 to 10% by constitutional mole.

When the content is less than 1% by constitutional mole, the dispersibility of a pigment in the toner may be insufficient. When the toner is prepared by the emulsion polymerization aggregation method, the diameter of the emulsified particle in the dispersion increases, and regulation of the toner diameter by aggregation may become difficult.

On the other hand, when the content is greater than 20% by constitutional mole, the crystallinity of the crystalline polyester resin may be lowered, the melting point decreases, and the storability of an image may be deteriorated.

When the toner is prepared by the emulsion polymerization aggregation method, the diameter of the emulsified particle in the dispersion is too small to form latex by dissolving the particle in water. In the invention, the "% by constitutional mole" refers to percentage where the amount of each component (carboxylic acid component, alcohol component) in the polyester resin is 1 unit (mol).

-Alcohol Component-

The alcohol component is preferably an aliphatic diol, and examples thereof include, but are not limited to, ethylene glycol, 1,3-propane diol, 1,4-butane diol, 1,5-pentane diol, 1,6-hexane diol, 1,7-heptane diol, 1,8-octane diol, 1,9-nonane diol, 1,10-decane diol, 1,11-undecane diol, 1,12-dodecane diol, 1,13-tridecane diol, 1,14-tetradecane diol, 1,18-octadecane diol and 1,20-eicosane diol, and the like.

The alcohol component contains preferably 80% by constitutional mole or more of aliphatic diol component and other components if necessary. The alcohol component contains more preferably 90% by constitutional mole or more of the aliphatic diol component.

When the content is less than 80% by constitutional mole, the crystallinity of the polyester resin decreases, the melting point is lowered, and thus toner blocking properties, image storability, and low-temperature fixability may be deteriorated. The other components contained if necessary include components such as a diol component having a double bond and a diol component having a sulfonic acid group.

The diol component having a double bond includes 2-butene-1,4-diol, 3-butene-1,6-diol, 4-butene-1,8-diol, etc. On the other hand, the diol component having a sulfonic acid group includes sodium benzene 1,4-dihydroxy-2-sulfonate, sodium benzene 1,3-dihydroxymethyl-5-sulfonate, 2-sulfo-1,4-butanediol sodium salt, etc.

When these alcohol components (the diol component having a double bond and/or the diol component having a sulfonic acid group) other than the linear aliphatic diol component are added, the content thereof in the alcohol component is preferably 1 to 20 mol %, more preferably 2 to 10 mol %. When the content is less than 1 mol %, there is the case where the dispersion of a pigment is insufficient, the diameter of the emulsified particle is increased, and regulation of the toner diameter by aggregation becomes difficult. On the other hand, when the content is greater than 20 mol %, there is the case where the crystallinity of the polyester resin is decreased, the melting point is lowered, the storability of an image is deteriorated, and the diameter of the emulsified particle is so small that the toner may be dissolved in water, thus failing to form latex.

The method of producing the crystalline polyester resin is not particularly limited, and the resin can be produced by a general method of polymerizing a polyester by reacting a carboxylic acid component with an alcohol component, such as a direct polycondensation method or an ester exchange method, and a suitable method is selected depending on the type of monomer. The molar ratio of the acid component to the alcohol component (acid component/alcohol component) to be reacted with each other varies depending on reaction conditions etc., and cannot be generalized, but is usually about 1/1.

Production of the crystalline polyester resin can be carried out at a polymerization temperature of 180 to 230° C., and the reaction is carried out in the reaction system if necessary under reduced pressure while water and alcohol generated upon condensation are removed. When the monomers are not dissolved or compatible with each other at the reaction temperature, a high-boiling solvent may be added as a solubilizer to dissolve the monomers. Polycondensation is carried out while the solubilizer solvent is distilled away. When there is a monomer which is poor in compatibility in copolymerization, the monomer which is poor in compatibility may be previously condensed with an intended carboxylic acid component or alcohol component and then copolymerized with a major component.

A catalyst usable in production of the crystalline polyester resin includes alkali metals such as sodium, lithium etc.; alkaline earth metals such as magnesium, calcium etc.; metals such as zinc, manganese, antimony, titanium, tin, zirconium, germanium etc.; and phosphorous acids, phosphoric acids and amine compounds, and the like.

Specific examples of the catalyst include sodium acetate, sodium carbonate, lithium acetate, calcium acetate, zinc stearate, zinc naphthenate, zinc chloride, manganese acetate, manganese naphthenate, titanium tetraethoxide, titanium tetrapropoxide, titanium tetraisopropoxide, titanium tetrabutoxide, antimony trioxide, triphenyl antimony, tributyl antimony, tin formate, tin oxalate, tetraphenyl tin, dibutyltin dichloride, dibutyltin oxide, diphenyltin oxide, zirconium tetrabutoxide, zirconium naphthenate, zirconyl carbonate, zirconyl acetate, zirconyl stearate, zirconyl octylate, germanium oxide, triphenyl phosphite, tris(2,4-di-t-butylphenyl)phosphite, ethyltriphenyl phosphonium bromide, triethylamine, triphenylamine etc.

For regulating the melting point, molecular weight etc. of the crystalline resin, in addition to the polymerizable monomers described above, compounds having a shorter-chain alkyl or alkenyl group, an aromatic ring, etc. can be used.

Specific examples of such compounds include, for the dicarboxylic acid, alkyl dicarboxylic acids such as succinic acid, malonic acid and oxalic acid, aromatic dicarboxylic acids such as phthalic acid, isophthalic acid, terephthalic acid, homophthalic acid, 4,4'-bibenzoic acid, 2,6-naphthalene dicarboxylic acid and 1,4-naphthalene dicarboxylic acid, and nitrogen-containing aromatic dicarboxylic acids such as dipicolinic acid, dinicotinic acid, quinolinic acid and 2,3-pyrazine dicarboxylic acid; for the diols, short-alkyl diols such as succinic acid, malonic acid, acetone dicarboxylic acid and diglycolic acid; and for the vinyl polymerizable monomers containing the short-chain alkyl group, short-chain alkyl or alkenyl(meth)acrylates such as methyl(meth)acrylate, ethyl (meth)acrylate, propyl(meth)acrylate and butyl(meth)acrylate, vinyl nitriles such as acrylonitrile and methacrylonitrile, vinyl ethers such as vinyl methyl ether and vinyl isobutyl ether, isopropenyl ketones such as vinyl methyl ketone, vinyl ethyl ketone and vinyl isopropenyl ketone, and olefins such as ethylene, propylene, butadiene and isoprene. These polymerizable monomers may be used alone or two or more thereof may be used in combination.

-crystalline Ester Compound-

The crystalline ester compound can be prepared from a carboxylic acid component and an alcohol component in the same manner as for crystalline polyester resin described above. However, at least one of the two components (monomers) has preferably 10 or more carbon atoms. Further, a main chain of at least one of the two components (monomers) more preferably contains a linear-chain structure (preferably linear-chain structure having a C10 or more), and the linear-chain structure is more preferably an alkylene group.

As the monomer particularly preferably used in synthesis of the crystalline ester compound, therefore, the carboxylic acid component includes 1,10-decanedicarboxylic acid, 1,11-undecanedicarboxylic acid, 1,12-dodecanedicarboxylic acid, 1,14-tetradecanedicarboxylic acid and 1,16-hexadecanedicarboxylic acid, and the alcohol component includes 1,10-decane diol, 1,11-undecane diol, 1,12-dodecane diol and 1,14-tetradecane diol, 1,16-hexadecane diol, etc.

Synthesis of the crystalline ester compound can also be conducted in the same manner as for the crystalline polyester resin, and for decreasing the weight-average molecular weight to 5000 or less, the reaction is allowed to proceed mildly by reducing the reaction temperature of the condensation polymerization, shortening the reaction time of the condensation polymerization, decreasing the amount of a condensation polymerization reaction catalyst, shortening the time of depressurization upon the condensation polymerization reaction, increasing the pressure upon the condensation polymerization reaction, etc., whereby a relatively low-molecular ester compound can be synthesized.

-Non-crystalline Resin-

As the non-crystalline resin used in the invention, known non-crystalline binder resin for toner can be used, and for example, styrene-acryl resin or the like can be used, but non-crystalline polyester resin is preferably used.

The glass transition point of the non-crystalline polyester resin used is preferably in the range of 50 to 80° C., more preferably in the range of 55 to 65° C. The weight-average molecular weight is preferably in the range of 8000 to 30000, and from the viewpoint of low-temperature fixability and mechanical strength, the weight-average molecular weight is more preferably in the range of 8000 to 16000. From the viewpoint of low-temperature fixability and mixability, the non-crystalline polyester resin may be copolymerized with a third component.

Preferably, the non-crystalline polyester resin has the same alcohol component or carboxylic acid component as in the crystalline ester compound used in combination therewith in order to improve compatibility.

The method of producing the non-crystalline polyester resin, similar to the method of producing the crystalline polyester resin, is not particularly limited, and the non-crystalline polyester resin can be produced by the general polyester polymerization method described above.

As the carboxylic acid component used in synthesis of the non-crystalline polyester resin, various dicarboxylic acids mentioned for the crystalline polyester resin can also be similarly used.

As the alcohol component, various diols used in synthesis of the non-crystalline polyester resin can also be used, and it is possible to use bisphenol A, bisphenol A/ethylene oxide adduct, bisphenol A/propylene oxide adduct, hydrogenated bisphenol A, bisphenol S, bisphenol S/ethylene oxide adduct, bisphenol S/propylene oxide adduct, etc, in addition to the aliphatic diols mentioned for the crystalline polyester resin.

From the viewpoints of toner productivity, heat resistance and transparency, bisphenol S and bisphenol S derivatives such as bisphenol S/ethylene oxide adduct and bisphenol S/propylene oxide adduct are preferably used. The carboxylic acid component or alcohol component may contain plural components, and particularly, bisphenol S has an effect of improving heat resistance.

-Crosslinking Treatment of Binder Resin, Etc.-

Crosslinking treatment of the non-crystalline resin used as binder resin, crosslinking treatment of the crystalline resin used if necessary, and copolymerizable components usable in synthesis of the binder resin, are described in detail.

For synthesis of the binder resin, other components can be copolymerized, and compounds having hydrophilic polar groups can be used.

When the binder resin is polyester resin, specific examples of other components include dicarboxylic acid compounds having an aromatic ring substituted directly with a sulfonyl group, such as sodium sulfonyl-terephthalate and sodium 3-sulfonyl isophthalate.

When the binder resin is vinyl resin, specific examples of other components include unsaturated fatty carboxylic acids such as (meth)acrylic acid and itaconic acid, esters of (meth) acrylic acids and alcohols, such as glycerin mono(meth)acrylate, fatty acid-modified glycidyl(meth)acrylate, zinc mono (meth)acrylate, zinc di(meth)acrylate, 2-hydroxyethyl(meth) acrylate, polyethylene glycol(meth)acrylate and polypropylene glycol(meth)acrylate, styrene derivatives having a sulfonyl group in the ortho-, meta- or para-position, and a sulfonyl group-substituted aromatic vinyl such as sulfonyl group-containing vinyl naphthalene and the like.

A crosslinking agent can be added if necessary to the binder resin for the purpose of preventing uneven gloss, uneven coloration and hot offset, upon fixation at a high-temperature region.

Specific examples of the crosslinking agent include aromatic polyvinyl compounds such as divinyl benzene and divinyl naphthalene, polyvinyl esters of aromatic polyvalent carboxylic acids such as divinyl phthalate, divinyl isophthalate, divinyl terephthalate, divinyl homophthalate, divinyl/trivinyl trimesate, divinyl naphthalene dicarboxylate and divinyl biphenyl carboxylate, divinyl esters of nitrogen-containing aromatic compounds, such as divinyl pyridine dicarboxylate, unsaturated heterocyclic compounds such as pyrrole and thiophene, vinyl esters of unsaturated heterocyclic carboxylic acids, such as vinyl pyromucate, vinyl furan carboxylate, vinyl pyrrole-2-carboxylate and vinyl thiophene carboxylate, (meth)acrylates of linear polyvalent alcohols, such as butane diol methacrylate, hexane diol acrylate, octane diol methacrylate, decane diol acrylate and dodecane diol methacrylate, branched, substituted polyvalent alcohol (meth)acrylates such as neopentyl glycol dimethacrylate, 2-hydroxy-1, 3-diacryloxy propane, and polyvalent polyvinyl carboxylates such as polyethylene glycol di(meth)acrylate, polypropylene polyethylene glycol di(meth)acrylates, divinyl succinate, divinyl fumarate, vinyl/divinyl maleate, divinyl diglycolate, vinyl/divinyl itaconate, divinyl acetone dicarboxylate, divinyl glutarate, divinyl 3,3'-thiodipropionate, divinyl/trivinyl trans-aconate, divinyl adipate, divinyl pimelate, divinyl suberate, divinyl azelate, divinyl sebacate, dodecane diacid divinyl, divinyl brassylate etc.

Particularly in the crystalline polyester resin, unsaturated polycarboxylic acids such as fumaric acid, maleic acid, itaconic acid and trans-aconic acid are copolymerized with polyester, and then multiple bonds in the resin may be crosslinked with one another or other vinyl compounds may be crosslinked therewith. In the invention, the crosslinking agents may be used alone or two or more thereof may be used in combination.

The method of crosslinking by the crosslinking agent may be a method of crosslinking by polymerizing the polymerizable monomer together with the crosslinking agent to crosslink the monomer or a method wherein after the binder resin is polymerized while unsaturated portions are allowed to remain in the binder resin, or after the toner is prepared, the unsaturated portions are crosslinked by crosslinking reaction.

When the binder resin is polyester resin, the polymerizable monomer can be polymerized by condensation polymerization. As the catalyst for condensation polymerization, a known catalyst can be used, and specific examples thereof include titanium tetrabutoxide, dibutyltin oxide, germanium dioxide, antimony trioxide, tin acetate, zinc acetate and tin disulfide. When the binder resin is vinyl resin, the polymerizable monomer can be polymerized by radical polymerization.

The radical polymerization initiator is not particularly limited insofar as it is capable of emulsion polymerization. Specific examples of the radical polymerization initiator include peroxides such as hydrogen peroxide, acetyl peroxide, cumyl peroxide, tert-butyl peroxide, propionyl peroxide, benzoyl peroxide, chlorobenzoyl peroxide, dichlorobenzoyl peroxide, bromomethyl benzoyl peroxide, lauroyl peroxide, ammonium persulfate, sodium persulfate, potassium persulfate, peroxy carbonate, diisopropyl tetralin hydroperoxide, 1-phenyl-2-methylpropyl-1-hydroperoxide, pertriphenyl acetate-tert-butyl hydroperoxide, tert-butyl performate, tert-butyl peracetate, tert-butyl perbenzoate, tert-butyl perphenylacetate, tert-butyl permethoxyacetate, and tert-butyl perN-(3-toluyl)carbamate, azo compounds such as 2,2'-azobispropane, 2,2'-dichloro-2,2'-azobispropane, 1,1'-azo(methylethyl)diacetate, 2,2'-azobis(2-amidinopropane) hydrochloride, 2,2'-azobis(2-amidinopropane)nitrate, 2,2'-azobisisobutane, 2,2'-azobisisobutylamide, 2,2'-azobisisobutyronitrile, methyl 2,2'-azobis-2-methylpropionate, 2,2'-dichloro-2,2'-azobisbutane, 2,2'-azobis-2-methylbutyronitrile, dimethyl 2,2'-azobisisobutyrate, 1,1'-azobis(sodium 1-methylbutyronitrile-3-sulfonate), 2-(4-methylphenylazo)-2-methylmalonodinitrile, 4,4'-azobis-4-cyanovaleric acid, 3,5-dihydroxymethylphenylazo-2-methylmalonodinitrile, 2-(4-bromophenylazo)-2-allylmalonodinitrile, 2,2'-azobis-2-methylvaleronitrile, dimethyl 4,4'-azobis-4-cyanovalerate, 2,2'-azobis-2,4-dimethylvaleronitrile, 1,1'-azobiscyclohexanenitrile, 2,2'-azobis-2-propylbutyronitrile, 1,1'-azobis-1-chlorophenylethane, 1,1'-azobis-1-cyclohexanecarbonitrile, 1,1'-azobis-1-cycloheptanenitrile, 1,1'-azobis-1-phenylethane, 1,1'-azobiscumene, ethyl 4-nitrophenylazobenzylcyanoacetate, phenyl azodiphenyl methane, phenyl azotriphenyl methane, 4-nitrophenyl azotriphenyl methane, 1,1'-azobis-1,2-diphenyl ethane and poly(bisphenol A-4,4'-azobis-4-cyanopentanoate), poly(tetraethyleneglycol-2,2'-azobisisobutyrate), and 1,4-bis(pentaethylene)-2-tetrazene, 1,4-dimethoxycarbonyl-1,4-diphenyl-2-tetrazene. These polymerization initiators can also be used as initiators for the crosslinking reaction.

The binder resin has been described by referring mainly to the crystalline polyester resin and non-crystalline polyester resin, and if necessary it is also possible to use styrene and styrene derivatives such as parachlorostyrene and α-methyl styrene; acrylate monomers such as methyl acrylate, ethyl acrylate, n-propyl acrylate, butyl acrylate, lauryl acrylate and 2-ethylhexyl acrylate; methacrylate monomers such as methyl methacrylate, ethyl methacrylate, n-propyl methacrylate, lauryl methacrylate and 2-ethylhexyl methacrylate; ethylenically unsaturated monomers such as acrylic acid, methacrylic acid and sodium styrenesulfonate; vinyl nitriles such as acrylonitrile and methacrylonitrile; vinyl ethers such as vinyl methyl ether and vinyl isobutyl ether; vinyl ketones such as vinyl methyl ketone, vinyl ethyl ketone and vinyl isopropenyl ketone; homopolymers of olefinic monomers such as ethylene, propylene and butadiene, copolymers comprising a combination of two or more of these monomers, or mixtures thereof; non-vinyl condensed resins such as epoxy resin, polyester resin, polyurethane resin, polyamide resin, cellulose resin and polyether resin, or mixtures thereof with the vinyl resin, and graft polymers obtained by polymerizing the vinyl monomers in the presence of these resins.

-Resin Particle Dispersion-

Now, the method of preparing a resin particle dispersion, used in preparing the toner of the invention by the emulsion polymerization aggregation method, is described in detail.

The resin particle dispersion can be obtained easily by emulsion polymerization or by polymerization in a heterogeneous dispersion system similar to emulsion polymerization. Alternatively, the resin particle dispersion can be obtained optionally by a method such as a method which comprises adding, together with a stabilizer, a polymer uniformly polymerized in advance by solution polymerization or bulk polymerization to a solvent in which the polymer is not dissolved, and then mechanically mixing and dispersing it.

For example, when a vinyl monomer is used, a resin particle dispersion can be prepared by emulsion polymerization or seed polymerization using an ionic surfactant or the like, preferably a combination of an ionic surfactant and a nonionic surfactant.

Examples of the surfactant used include, but is not limited to, anionic surfactants based on sulfates, sulfonates, phosphates and soap; cationic surfactants based on amines and quaternary ammonium salts; nonionic surfactants based polyethylene glycol, alkyl phenol/ethylene oxide adducts, alkyl alcohol/ethylene oxide adducts and polyhydric alcohols, as well as various graft polymers.

When the resin particle dispersion is produced by emulsion polymerization, a small amount of unsaturated acid, for example, acrylic acid, methacrylic acid, maleic acid or styrenesulfonic acid is preferably used as a part of the monomer component so that a protective colloidal layer can be formed on the surfaces of particles to realize soap-free polymerization.

The average particle diameter of the resin particles is preferably 1 μm or less, more preferably 0.01 to 1 μm. When the average particle diameter of the resin particles is greater than 1 μm, the particle size distribution of the finally obtained toner for electrostatic image development is broadened, and free particles are generated to cause deterioration in performance and reliability. On the other hand, when the average particle diameter of the resin particles is within the range described above, there does not arise the disadvantage described above, and there is an advantage that the uneven distribution of the resin particles among toner particles is decreased, and the dispersion thereof in the toner is improved, thus reducing fluctuation in performance and reliability. The average particle diameter of the resin particles can be measured by using a microtrack or the like.

A dispersion having the crystalline ester compound dispersed therein can also be prepared in the same manner as for the resin particle dispersion described above.

-Releasing Agent-

The releasing agent used in the invention includes low-molecular polyolefins such as polyethylene, polypropylene and polybutene; fatty acid amides such as silicones, oleic acid amide, erucic acid amide, ricinoleic acid amide and stearic acid amide; vegetable wax such as carnauba wax, rice wax, candelila wax, haze wax and jojoba oil; animal wax such as beeswax; mineral or petroleum wax such as montan wax, ozokerite, ceresin, paraffin wax, microcrystalline wax and Fischer Tropsch wax, and modified products thereof.

When the toner is produced by the emulsion polymerization aggregation method, the releasing agent is heated to the melting point or more and simultaneously dispersed in water together with an ionic surfactant, a polymeric acid, and a polymeric electrolyte such as polymeric base, finely divided by a homogenizer capable of giving strong shearing force or a pressure discharging dispersing machine, and used as a releasing agent dispersion containing releasing agent particles having an average particle diameter of 1 μm or less.

To prepare the toner, these releasing agent particles together with the other resin particle components may be added to a mixed solvent all at once or several times in divided portions.

The amount of the releasing agent to be added is preferably in the range of 0.5 to 50 wt % relative to the toner. The amount is more preferably in the range of 1 to 30 wt %, still more preferably in the range of 5 to 15 wt %. An amount outside the above range is not preferable, because when the amount is lower than 0.5 wt %, the effect of the releasing agent added is not brought about, while when the amount is higher than 50 wt %, the surface of an image is insufficiently dyed at fixation, and the releasing agent easily remains in the image and the transparency deteriorates.

-Colorant-

A colorant used in the invention includes various pigments such as carbon black, chrome yellow, hanza yellow, benzidine yellow, threne yellow, quinoline yellow, permanent orange GTR, pyrazolone orange, vulcan orange, Watchung red, permanent red, brilliant carmine 3B, brilliant carmine 6B, DuPont oil red, pyrazolone red, lithol red, rhodamine B lake, lake red C, rose Bengal, aniline blue, ultramarine blue, chalco oil blue, methylene blue chloride, phthalocyanine blue, phthalocyanine green and malachite green oxalate, various dyes based on acridine, xanthene, azo, benzoquinone, azine, anthraquinone, thioindigo, dioxazine, thiazine, azomethine, indigo, phthalocyanine, aniline black, polymethine, triphenyl methane, diphenyl methane and thiazole, and a mixture of two or more thereof.

When the toner is prepared by the emulsion polymerization aggregation method, these colorants are dispersed in a solvent and used as a colorant dispersion. The average particle diameter of the colorant particles in the dispersion is preferably 0.8 μm or less, more preferably 0.05 to 0.5 μm. When the average particle diameter of the colorant particles is greater than 0.8 μm, the particle size distribution of the finally obtained toner for electrostatic image development is broadened, and free particles are generated, resulting in deterioration in performance and reliability. When the average particle diameter of the colorant particles is smaller than 0.05 μm, coloring properties in the toner are reduced, and shape regulation that is one feature of the emulsion aggregation method is lost, so a truly spherical toner cannot be obtained.

The ratio of the number of coarse particles having an average particle diameter of 0.8 μm or more to the number of the total particles in the colorant dispersion is preferably less than 10% and preferably substantially 0%. The presence of such coarse particles causes deterioration in the stability of the aggregation process, generation of free coarse colored particles, and broader particle-size distribution.

The ratio of the number of particles having an average particle diameter of 0.05 μm or less to the number of the total particles in the colorant dispersion is preferably 5% or less. The presence of such particles causes deterioration in regulation of the shape in the fusion process, so smooth colorant particles having an average circularity of 0.940 or less may not be obtained.

On the other hand, when the average particle diameter of the colorant particles, coarse particles and particles are in the ranges described above, there does not arise the disadvantage described above, and there is an advantage that the uneven distribution of the colorant particles among toner particles is decreased, and the dispersion thereof in the toner is improved, thus reducing fluctuation in performance and reliability.

The average particle diameter of the colorant particles can be measured by using a microtrack or the like. The amount of the colorant added is preferably in the range of 1 to 20 wt % relative to the toner.

A method of dispersing the colorant in a solvent is not particularly limited, and a method, for example, a method using a rotating shearing homogenizer or a ball mill, sand mill or DYNO-mill having media can be used optionally.

The colorant used may be surface-modified with rosin, polymer etc. The surface-modified colorant is advantageous in that it is sufficiently stabilized in the colorant dispersion, and when the colorant is dispersed to a desired average particle diameter in the colorant dispersion and mixed with the resin particle dispersion or subjected to the aggregation process etc., the colorant particles are not aggregated with one another and can be maintained in an excellent dispersed state. However, a colorant subjected to excessive surface modification may become free without aggregation with the resin particles in the aggregation process. Accordingly, the surface modification is conducted under suitably selected optimum conditions.

The polymer used in surface treatment of the colorant includes an acrylonitrile polymer, methyl methacrylate polymer etc.

As the conditions for surface modification, it is generally possible to use a polymerization method of polymerizing a monomer in the presence of the colorant (pigment) or a phase separation method which comprises dispersing the colorant (pigment) in a polymer solution and lowering the solubility of the polymer to precipitate it on the surface of the colorant (pigment).

-Other Additives-

When the toner of the invention is used as a magnetic toner, magnetic powder is contained therein, and examples of the magnetic powder used include metals such as ferrite, magnetite, reduced iron, cobalt, nickel and manganese, alloys thereof and compounds containing the metals. If necessary, a wide variety of ordinarily used charge controlling agents such as quaternary ammonium salts, Nigrosine compounds and triphenyl methane pigments may also be added.

In the toner of the invention, inorganic particles can also be contained if necessary. From the viewpoint of durability, it is preferable that inorganic particles having a median particle diameter of 5 to 30 nm and inorganic particles having a median particle diameter of 30 to 100 nm are contained in the range of 0.5 to 10 wt % relative to the toner.

Specific examples of the inorganic particles include silica, hydrophobated silica, titanium oxide, alumina, calcium carbonate, magnesium carbonate, tricalcium phosphate, colloidal silica, cation surface-treated colloidal silica and anion surface-treated colloidal silica. These inorganic particles have been previously treated in the presence of an ionic surfactant by a sonicator, and colloidal silica which does not require this dispersion treatment is more preferably used.

When the amount of the inorganic particles added is less than 0.5 wt %, sufficient toughness cannot be achieved at the time of toner melting even if the inorganic particles are added, and releasability in oil-less fixation cannot be improved and coarse dispersion of fine toner particles in the toner upon melting increases viscosity only, resulting in deterioration of stringiness to deteriorate releasability in oil-less fixation. When the content of the inorganic particles is higher than 10 wt %, sufficient toughness can be attained, but fluidity upon toner melting is significantly reduced to deteriorate image gloss.

A known external additive can be externally added to the toner of the invention. As the external additive, inorganic particles such as silica, alumina, titania, calcium carbonate, magnesium carbonate and tricalcium phosphate can be used. For example, inorganic particles such as silica, alumina, titania and calcium carbonate and resin particles such as vinyl resin, polyester and silicone can be used as a flowability auxiliary agent, a cleaning auxiliary agent or the like. The method of adding the external additive is not particularly limited, and the external additive in a dried state can be added onto the surfaces of the toner particles with shearing force.

-Other Physical Properties of the Toner-

The volume-average particle diameter $D_{50v}$ of the toner of the invention is preferably 3 to 8 μm. When the volume-average particle diameter is smaller than 3 μm, charging properties are insufficient and the toner may be scattered around to cause image fogging, while when the particle diameter is greater than 8 μm, the resolution of an image lowers and achievement of high qualities may be difficult. The average-volume particle size distribution index GSDv of the toner is preferably 1.25 or less. When the GSDv is greater than 1.25, the vividness and resolution of the resulting image may be deteriorated.

The small particle diameter-side particle size distribution index GSDp-under is preferably 1.27 or less. When the GSDp-under is greater than 1.27, the ratio of small particle toner is high, so there is significant influence not only on initial performance but also on reliability. That is, the adhesion of small-diameter toner is high as conventionally known, so the electrostatic regulation is easily made difficult, and when a two-component developer is used, the toner easily remains on a carrier. In this case, when repeated mechanical force is applied, the carrier is contaminated, resulting in acceleration of deterioration of the carrier.

In the invention, the volume-average particle diameter $D_{50v}$ and various particle distribution indexes can be determined by using measuring instruments such as Coulter Counter TAII (manufactured by Beckman Coulter, Inc) and Multisizer II (manufactured by Beckman Coulter, Inc.) wherein ISOTON-II (manufacture by Beckman Coulter, Inc.) is used as an electrolyte.

In the measurement, 0.5 to 50 mg of a sample for measurement is added to a surfactant as dispersant, preferably 2 ml of 5% aqueous sodium alkyl benzene sulfonate. The resultant is added to 100 to 150 ml of electrolyte.

The electrolyte having the sample suspended therein is dispersed for about 1 minute with a sonicator, and the particle size distribution of the particles having a particle diameter in the range of 2 to 50 μm is measured with an aperture having a diameter of 100 μm by the above-mentioned Coulter Counter TA-II. The number of particles sampled is 50000.

A cumulative distribution is drawn with respect to volume and number from the side of small particle against the particle size range (channel) divided on the basis of the particle size distribution thus determined, and the particle diameter at 16% accumulation is defined as cumulative volume-average particle diameter $D_{16v}$ and cumulative number-average particle diameter $D_{16P}$, the particle diameter at 50% accumulation is defined as cumulative volume-average particle diameter $D_{50v}$ and cumulative number-average particle diameter $D_{50P}$, and the particle diameter at 84% accumulation is defined as cumulative volume-average particle diameter $D_{84v}$ and cumulative number-average particle diameter $D_{84P}$.

Using them, the volume-average particle size distribution index (GSDv) is determined from the formula $(D_{84v}/D_{16v})^{1/2}$, the number average particle size distribution index (GSDp) from the formula $(D_{84P}/D_{16P})^{1/2}$, and the small particle diameter-side particle size distribution index GSDp-under from the formula $(D_{50p}/D_{16p})$.

The small particle diameter toner has large adhesion, so the efficiency of development is lowered resulting in defects in qualities. Particularly in the transfer process, transfer of components of small diameter in the toner developed on the photoreceptor is easily made difficult, resulting in poor efficiency of transfer, and discharged toners are increased and defects in image qualities generates. These problems cause to increase of toners not electrostatically regulated or toners having reverse polarity, resulting in pollution therearound. In particular, these unregulated toners are accumulated on a charging roll via the photoreceptor etc., to cause insufficient charging unfavorably.

The average circularity of the toner of the invention is preferably 0.94 to 0.99.

When the average circularity is lower than the above range, the shape becomes amorphous and the transferability, durability and flowability are lowered, while when the average circularity is higher than the above range, the proportion of spherical particles increases and cleaning is made difficult in some cases.

The average circularity of the toner can be measured by a flow-type particle image analyzer FPIA-2000 (manufactured by Toaiyo Denshi Co., Ltd.). In a specific measurement method, 0.1 to 0.5 ml of a surfactant, preferably alkyl benzene sulfonate, as a dispersant is added to 100 to 150 ml water from which impurities were removed, and about 0.1 to 0.5 g of a sample for measurement is further added thereto. The resulting suspension having the measurement sample dispersed therein is dispersed for about 1 to 3 minutes with a sonicator, and the average circularity of the toner is measured at a dispersion density of 3000 to 10,000 toner particles/μl by the above analyzer.

The glass transition temperature Tg of the toner of the invention is not particularly limited, but is preferably selected in the range of 40 to 70° C. When the glass transition temperature is lower than this range, there may arise problems in toner storage, storage of fixed image and durability in a machine. When the glass transition temperature is higher than this range, there may arise problems such as an increase in fixation temperature and an increase in temperature required for granulation.

According to ASTMD3418-8 (the disclosure of which is incorporated herein by reference), Tg is measured using a DSC measuring instrument (differential calorimeter DSC-7, manufactured by Perkin Elmer, Inc.). The melting points of indium and zinc are used in temperature correction in a detection part of the apparatus, and the heat of fusion of indium is used in correction of heat quantity. With an empty pan set for comparison, a sample is placed on an aluminum pan and measured at an increasing temperature rate of 10° C./min.

The absolute value of charging of the toner for electrostatic image development according to the invention is preferably in the range of 10 to 40 μC/g, more preferably 15 to 35 μC/g.

When the absolute value is lower than 10 μC/g, background staining occurs easily, while when the absolute value is higher than 40 μC/g, image density is easily lowered.

The ratio of the charging, in summer (28° C., 85% RH), of the toner for electrostatic image development to the charging thereof in winter (10° C., 30% RH) is preferably 0.5 to 1.5, more preferably 0.7 to 1.3. A ratio outside of the above range is practically not preferable because the dependence of the toner on the environment is increased and the charging properties are not stable.

-Preparation of the Toner by the Emulsion Polymerization Aggregation Method-

Now, the method of producing the toner of the invention is described in more detail by reference to the emulsion polymerization aggregation method.

When the toner of the invention is prepared by the emulsion polymerization aggregation method, the toner is produced at least through a aggregation process and a fusion process as described above, and the process may further comprise an adhesion process of forming an aggregated particle having a core/shell structure with resin particles adhering to the surface of an aggregated particle (core particle) formed through the aggregation process.

-Aggregation Process-

In the aggregation process, aggregated particles are formed in a starting dispersion mixture of a crystalline ester compound dispersion having the crystalline ester compound dispersed therein, a non-crystalline resin particle dispersion having the non-crystalline resin dispersed therein, a colorant dispersion having the colorant dispersed therein and a releasing agent dispersion having the releasing agent dispersed therein.

Specifically, a starting dispersion obtained by mixing the respective dispersions is heated to aggregate particles in the starting dispersion, thereby forming aggregated particles. The heating is carried out at a temperature slightly lower than the melting point of the crystalline ester compound or the glass transition temperature of the non-crystalline resin. The heating temperature is preferably lower by 5 to 25° C. than the melting point or the glass transition temperature.

Formation of aggregated particles is carried out by adding an aggregating agent at room temperature under stirring in a rotating shearing homogenizer and then acidifying the starting dispersion.

As the aggregating agent used in the aggregation process, a surfactant having reverse polarity to that of the surfactant used as a dispersant to be added to the starting dispersion, that is, a divalent or more metal complex in addition to an inorganic metal salt, can be preferably used. Particularly a metal complex is preferably used because the amount of the surfactant used can be reduced and charging properties are improved.

Examples of the inorganic metal salt include metal salts such as calcium chloride, calcium nitrate, barium chloride, magnesium chloride, zinc chloride, aluminum chloride and aluminum sulfate, and inorganic metal salt polymers such as poly(aluminum chloride), poly(aluminum hydroxide) and poly(calcium sulfide). Among these compounds, the aluminum salts and polymers thereof are particularly preferable. For attaining a sharper particle-size distribution, the valence of the inorganic metal salt is more preferably divalent than monovalent, trivalent than divalent, or tetravalent than trivalent, and given the same valence, an inorganic metal salt polymer of polymerization type is more preferable.

-Adhesion Process-

If necessary, an adhesion process may be carried out after aggregation. In the adhesion process, resin particles are allowed to adhere to the surfaces of aggregated particles formed through the aggregation process, whereby a coating layer is formed. A toner having a core/shell structure which consists of the core layer and a shell layer coated thereon can be obtained.

The coating layer can be formed usually by additionally adding a dispersion containing non-crystalline resin particles to a dispersion having aggregated particles (core particles) formed in the aggregation process. The non-crystalline resin used in the adhesion process may be identical with, or different from, the one used in the aggregation process.

The general adhesion process is used in preparing a toner having a core/shell structure wherein together with the releasing agent, the crystalline resin as binder resin is contained as a main component, and the major object is to prevent depression of the exposure, to the toner surface, of the releasing agent and crystalline resin contained in the core layer and to compensate for the strength of toner particles which is insufficient when the toner particles are made of the core alone.

In the toner of the invention, however, the releasing agent is excellent in dispersibility and compatibility, and non-crystalline resin is used as binder resin, so that even if the shell layer is not formed in the adhesion process, components such as the releasing agent adversely influencing charging properties and storage stability can be prevented from being exposed to the surface of the toner, and sufficient strength can also be achieved. Accordingly, when the emulsion polymerization aggregation method is used, there is no problem even if the adhesion process is omitted, and thus production of the toner can be further simplified.

-Fusion Process-

In the fusion process carried out after aggregation or after both aggregation and adhesion, the suspension containing aggregated particles formed through these processes is adjusted in the range of pH 6.5 to 8.5 thereby terminating progress of aggregation and then heated, whereby fusing the aggregated particles. In fusion, the aggregated particles are fused by heating at a temperature higher than the glass transition temperature of the non-crystalline resin.

When heating is carried out for fusion or after fusion is completed, crosslinking may be carried out. Crosslinking may be also carried out simultaneously with fusion. When crosslinking is carried out, the crosslinking agent and polymerization initiator described above are used in preparation of the toner.

The polymerization initiator may be mixed with the dispersion before the stage of preparing the starting dispersion or may be incorporated into the aggregated particles in the aggregation process. Alternatively, the polymerization initiator maybe introduced in the fusion process or after the fusion process. When the polymerization initiator is introduced in the aggregation process, adhesion process or fusion process or after the fusion process, a solution or emulsion of the polymerization initiator is added to the dispersion. For the purpose of regulating the degree of polymerization, a known crosslinking agent, chain transfer agent, polymerization inhibitor etc. may be added to the polymerization initiator.

-Washing Process, Drying Process Etc.-

After the process of fusing aggregated particles is completed, desired toner particles are obtained through an optional washing process, solid/liquid separation process and drying process, and in consideration of charging properties, the washing process preferably comprises sufficient washing by replacement with water. The solid/liquid separation process is not particularly limited, but from the viewpoint of productivity, filtration under suction, filtration under pressure etc. are preferable. The drying process is not particularly limited either, but from the viewpoint of productivity, freeze drying, flash jet drying, fluidizing drying, vibration fluidizing drying etc. are preferably used. If necessary, various external additives described above can be added to the toner particles after drying.

(Electrostatic Image Developer)

The electrostatic image developer of the invention (hereinafter, referred to sometimes as merely "developer") comprises the toner of the invention, and may be compounded with other components if necessary.

Specifically, when the toner of the invention is used alone, the developer of the invention is prepared as one-component electrostatic image developer, and when the toner is used in combination with a carrier, the developer is prepared as two-component electrostatic image developer.

The carrier is not particularly limited, and carriers known per se can be mentioned, and for example known carriers such as carriers having a core material coated with a resin layer (resin-coated carrier) which are described in JP-A No. 62-39879 and JP-A No. 56-11461 can be used.

The core material of the resin-coated carrier includes shaped products such as iron powder, ferrite and magnetite, and the average particle diameter thereof is about 30 to 200 μm.

The coating resin forming the coating layer includes, for example, styrene and styrene derivatives such as parachlorostyrene and α-methyl styrene, α-methylene fatty monocarboxylic acids such as methyl acrylate, ethyl acrylate, n-propyl acrylate, lauryl acrylate, 2-ethylhexyl acrylate, methyl methacrylate, n-propyl methacrylate, lauryl methacrylate and 2-ethylhexyl methacrylate, nitrogen-containing acryls such as dimethylaminoethyl methacrylate, vinyl nitriles such as acrylonitrile and methacrylonitrile, vinyl pyridines such as 2-vinyl pyridine and 4-vinyl pyridine, vinyl ethers such as vinyl methyl ether and vinyl isobutyl ether, vinyl ketones such as vinyl methyl ketone, vinyl ethyl ketone and vinyl isopropenyl ketone, olefins such as ethylene and propylene, homopolymers of vinyl fluorine-containing monomers such as vinylidene fluoride, tetrafluoroethylene and hexafluoroethylene, or copolymers consisting of two or more monomers, silicones such as methyl silicone and methyl phenyl silicone, polyesters containing bisphenol, glycol etc., epoxy resin, polyurethane resin, polyamide resin, cellulose resin, polyether resin and polycarbonate resin. These resins may be used alone or as a mixture of two or more thereof.

The amount of the coating resin is in the range of 0.1 to 10 parts by weight, preferably 0.5 to 3.0 parts by weight, relative to 100 parts by weight of the core material. For production of the carrier, a heating kneader, a heating Henschel mixer, an UM mixer etc. can be used, and a heating fluidized rolling bed, a heating kiln etc. can be used depending on the amount of the coating resin. The toner/carrier mixing ratio in the electrostatic image developer is not particularly limited, and can be suitably selected depending on the purpose.

(Image Forming Method)

Now, the image forming method of the invention is described in detail. The image forming method of the invention is not particularly limited insofar as the toner (developer) of the invention is used, and the image forming method preferably comprises forming an electrostatic latent image on the surface of a latent image carrier, developing the electrostatic latent image with a developer containing the toner of the invention to form a toner image, transferring the toner image onto a recording medium, and fixing the toner image on the recording medium.

The image forming method of the invention can be combined with known processes usable in the image forming method by electrophotography, in addition to the process described above, and the method may comprise, for example, cleaning and recovering residual toner remaining on the surface of the latent image carrier after transferring to recover the toner, and toner recycling where the residual toner recovered in the cleaning is re-utilized as the developer The electrostatic latent image-forming process is a process of forming an electrostatic latent image by charging the surface of a latent image carrier evenly with a charging means and then exposing the latent image carrier to light with a laser optical system or an LED array. The charging means may be any type of charger and includes non-contact-type chargers such as corotron and scorotron and contact-type chargers that the surface of a latent image carrier is charged by applying voltage to an electroconductive member contacting with the surface of the latent image carrier. However, from the viewpoints of exhibiting the effects of less generation of ozone, environmental compatibility and excellent printing durability, a charger of contact charging type is preferable. In the charger of contact charging type, the shape of the electroconductive member is not limited, and may be in the form of a brush, blade, pin electrode or roller. The image forming method of the invention is not particularly limited in the latent image forming process.

The development process described above is a process wherein a developer carrier having a developer layer containing at least a toner formed on the surface thereof is contacted with, or made close to, the surface of a latent image carrier thereby allowing toner particles to adhere to an electrostatic latent image on the surface of the latent image carrier, to form a toner image on the surface of the latent image carrier. The development system can make use of a known system, and the developer system where the developer is a two-component developer includes a cascade system, a magnetic brush system etc. The image forming method of the invention is not particularly limited with respect to the development system.

The transfer process is a process of transferring a toner image formed on the surface of the latent image carrier onto a recording medium. The transfer process is not particularly limited and may be a system of directly transferring a toner image onto a recording medium such as paper or a system of transferring a toner image onto a drum- or belt-shaped intermediate transfer material and then transferring it onto a recording medium such as paper.

A corotron can be used as the transfer apparatus for transferring a toner image from the latent image carrier onto paper etc. The corotron is effective as a means of uniformly charging paper, and for applying predetermined charge to paper as a recording medium, high voltage of several kV should be applied, and a high-voltage power source is necessary. Because ozone is generated due to corona discharge, rubber parts and the latent image carrier are deteriorated, so a contact-transfer system is preferable in which an electroconductive transfer roll made of an elastic material is abutted on the latent image carrier to transfer a toner image onto paper. The image forming method of the invention is not particularly limited with respect to the transfer apparatus.

The cleaning process is a process of removing a toner, paper powder, dust etc. adhering to the surface of the latent image carrier by directly contacting a blade, brush, roll or the like with the surface of the latent image carrier.

The most generally used system is a blade cleaning system wherein a blade made of rubber such as polyurethane is abutted on the latent image carrier. Use can also be made of a magnetic brush system having a magnet fixed therein and provided with a rotatable cylindrical non-magnetic sleeve arranged in the outer periphery of the magnet, wherein a magnetic carrier is carried on the surface of the sleeve to recover a toner, or a system wherein a semi-electroconductive resin fiber or animal hair is rendered rotatable in a rolled state, and bias of polarity opposite to the toner is applied to the roll to remove the toner. In the former magnetic brush system, a corotron for cleaning pretreatment may be arranged. In the image forming method of the invention, the cleaning system is not particularly limited.

The fixation process is a process wherein the toner image transferred on the surface of the recording medium is fixed with a fixation apparatus. As the fixation apparatus, a heating fixation apparatus using a heat roll is preferably used. The heating fixation apparatus includes a fixation roller having a heater lamp for heating arranged in a cylindrical metallic core and provided with a heat-resistant resin coating layer or a heat-resistant rubber coating layer as a release layer on the outer periphery thereof, and a press roller or a press belt abutted on this fixation roller and having a heat-resistant elastic layer formed on the outer periphery of a cylindrical core or on the surface of a belt-shaped substrate. In the process of fixing a toner image, a recording medium having the toner image formed thereon is passed between the fixation roller and the press roller or the press belt, and the binder resin, additives etc. in the toner are fixed by heat melting. In the image forming method of the invention, the fixation system is not particularly limited.

For forming a full-color image in the image forming method of the invention, it is preferable to use the image forming method wherein plural latent image carriers have developer carriers in different colors, and by a series of processes consisting of a latent image forming process, a development process, a transfer process and a cleaning process with the respective latent image carriers and developer carriers, toner images in different colors are successively layered on the surface of the same recording medium, and the resulting layered full-color toner image is thermally fixed in the fixation process. The developer of the invention is used in the image forming method, whereby stable development, transfer and fixation performance can be obtained even in a tandem system suitable for small size and high-speed coloring.

The system for toner recycling is not particularly limited and includes, for example, a method wherein a toner recovered in a cleaning part is sent on a delivery conveyer or with a transfer screw to a replenishing toner hopper or a developing device, or after being mixed with a replenishing toner in an intermediate chamber, is fed to a developing device. Preferably, the toner recycle system is a system wherein the recycle toner is returned directly to a developing device or the recycle toner is mixed with a replenishing toner in an intermediate chamber and then fed to a developing device.

When the toner is used by recycling, it is necessary that the strength of the toner particles is high and the releasing agent is excellent in dispersibility in the toner and is not exposed to the surface of the toner, and the toner of the invention has sufficient strength, thus causing no deterioration in image qualities even if the toner is used for a long time.

The image forming apparatus using the image forming method of the invention is constituted as a process cartridge consisting of elements such as a photoreceptor (latent image carrier), a developing device and a cleaning device connected to one another as one body, and this unit may be constituted to be freely attachable to and detachable from the main body of the apparatus. At least one of a charger, a light exposing device, a developing device, a transfer device or a separator, and a cleaning device may be integrated with the photoreceptor to form a process cartridge as a single unit freely attachable to and detachable from the main body of the apparatus, and may be constituted to be freely attached and detached with a guiding means such as a rail of the main body of the apparatus.

The recording medium onto which a toner image is transferred includes, for example, paper and OHP sheet used in a copier or printer in an electrophotographic system. For further improving the smoothness of the surface of an image after fixation, the surface of the transfer material is also preferably as smooth as possible, and for example paper coated with resin or the like, coated paper for printing, etc. can be preferably used.

-Electrophotographic Photoreceptor-

Now, the photoreceptor used in the image forming method of the invention is described in detail.

As the photoreceptor used in the invention, a known photoreceptor having at least a photosensitive layer formed on an electroconductive support can be used, and an organic photoreceptor is preferably used. In this case, it is preferable that a layer constituting the outermost surface of the photoreceptor contains a resin having a crosslinked structure. The resin having a crosslinked structure includes phenol resin, urethane resin and siloxane resin, and among them, the siloxane resin is most preferable.

The photoreceptor wherein the resin having a crosslinked structure is contained in a layer constituting the outermost surface thereof has high strength and can thus have high resistance to abrasion and scratch to attain ultra-longevity of the photoreceptor. However, when a cleaning blade is used as a means of cleaning the photoreceptor to secure cleaning properties, the cleaning blade is preferably contacted at a relatively high abutting pressure with the photoreceptor. In this case, the toner remaining on the surface of the photoreceptor is easily broken in the abutted region between the cleaning blade and the photoreceptor, so the constituent materials of the toner easily adhere to the surface of the photoreceptor and subsequent change in charging easily occurs. However, the toner of the invention has excellent strength and can thus prevent such problem, and even if used in combination with the system of reutilizing the toner by recycling, does not cause deterioration in image qualities for a long time.

The layer structure of the photoreceptor used in the invention is not particularly limited insofar as it comprises an electroconductive support and a photosensitive layer arranged on the electroconductive support, and the photoreceptor preferably has photosensitive layer consisting of a charge generating layer and a charge transporting layer different in functions each other, and preferably the layer structure specifically comprises an undercoat layer, a charge generating layer, a charge transporting layer and a protective layer in this order on the surface of an electroconductive substrate. Hereinafter, the respective layers are described in detail.

The electroconductive support includes, for example, a metal plate, a metal drum and a metal belt using a metal such as aluminum, copper, zinc, stainless steel, chromium, nickel, molybdenum, vanadium, indium, gold and platinum or an alloy thereof, or a paper, a plastic film and a belt coated, deposited or laminated with an electroconductive polymer, an electroconductive compound such as indium oxide, a metal such as aluminum, palladium and gold or an alloy thereof.

When the photoreceptor is used in a laser printer, the oscillation wavelength of the laser is preferably 350 to 850 nm, and shorter wavelength is more preferable for higher resolution of image.

For preventing interference fringes generated upon irradiation with laser beam, the surface of the support is preferably roughened to a central line average roughness (Ra) of 0.04 μm to 0.5 μm. The roughening method is preferably wet honing of the support with an aqueous suspension of an abrasive, center-less abrasion of continuously abrading the support against a rotating grindstone, anodizing, or formation of a layer containing organic or inorganic semi-electroconductive particles. Roughness outside of the above range is not suitable because when Ra is less than 0.04 μm, the surface of the support assumes a mirror surface, thus failing to attain an interference preventing effect, while when Ra is greater than 0.5 μm, image qualities are roughened even if a coating is formed. When a non-interference light is used as the light source, surface roughening for preventing interference fringes is not particularly necessary, generation of defects due to the uneven surface of the substrate can be prevented, and thus longer longevity can be attained.

In anodizing treatment, aluminum is anodized as an anode in an electrolyte solution to form an oxide film on the surface of aluminum. The electrolyte solution includes a sulfuric acid solution, oxalic acid solution etc. However, the porous anodized film itself is chemically active, is easily polluted and significantly changes resistance depending on the environment. Accordingly, the anodized film is subjected to pore sealing wherein fine pores of the anodized film are closed by volume expansion with hydration reaction in pressurized water vapor or boiling water (to which a metallic salt of nickel or the like may be added) thereby converting it into a more stable hydrated oxide. The thickness of the anodized film is preferably 0.3 to 15 μm. When the thickness is less than 0.3 μm, the film is poor in barrier properties against injection and unsatisfactory in effect. When the thickness is greater than 15 μm, residual potential is increased due to repeated use.

The treatment with an acidic treating solution consisting of phosphoric acid, chromic acid and fluoric acid is carried out in the following manner. The compounding ratio of phosphoric acid, chromic acid and fluoric acid in the acidic treating solution is established preferably such that that phosphoric acid is in the range of 10 to 11 wt %, chromic acid in the range of 3 to 5 wt %, and fluoric acid in the range of 0.5 to 2 wt %, and the total concentration of these acids is in the range of 13.5 to 18 wt %. The treatment temperature is 42 to 48° C., and by keeping the treatment temperature high, a thick film can be formed more rapidly. The thickness of the film is preferably 0.3 to 15 μm. When the thickness of the film is less than 0.3 μm, the film is poor in barrier properties against injection, and a satisfactory effect can not be attained. When the thickness of the film is greater than 15 μm, residual electric potential is caused by repeated use.

Boehmite treatment can be carried out by dipping in purified water at 90 to 100° C. for 5 to 60 minutes or by contacting with heated water vapor at 90 to 120° C. for 5 to 60 minutes. The thickness of the film is preferably 0.1 to 5 μm. The film can further be subjected to anodizing with an electrolyte solution such as adipic acid, boric acid, borate, phosphate, phthalate, maleate, benzoate, tartrate and citrate, in which the film is hardly dissolved. The organic or inorganic semi-electroconductive particles include pigments described in JP-A No. 47-30330, for example organic pigments such as perylene pigment, bisbenzimidazole perylene pigment, polycyclic quinone pigment, indigo pigment and quinacridone pigment, organic pigments such as bisazo pigment and phthalocyanine pigment having an electron attractive substituent group such as cyano group, nitro group, nitroso group and halogen atom, and inorganic pigments such as zinc oxide, titanium oxide and aluminum oxide. Among these pigments, zinc oxide and titanium oxide is preferable because they have a high ability to transfer charge and are effective in film thickening.

For the purpose of improving dispersibility or regulating the energy level, the surfaces of these pigments are preferably treated with organic titanium compounds such as titanate coupling agent, aluminum chelate compound and aluminum coupling agent and particularly preferably treated with silane coupling agents such as vinyl trichlorosilane, vinyl trimethoxy silane, vinyl triethoxy silane, vinyl tris-2-methoxy ethoxy silane, vinyl triacetoxy silane, γ-glycidoxy propyl trimethoxy silane, γ-methacryloxy propyl trimethoxy silane, γ-aminopropyl triethoxy silane, γ-chloropropyl trimethoxy silane, γ-2-aminoethyl aminopropyl trimethoxy silane, γ-mercaptopropyl trimethoxy silane, γ-ureidopropyl triethoxy silane and β-3,4-epoxy cyclohexyl trimethoxy silane.

When the amount of the organic or inorganic semi-electroconductive particles is too high, the strength of the undercoat layer is reduced to cause defects in a coating, and thus the semi-electroconductive particles are used in an amount of preferably 95 wt % or less, more preferably 90 wt % or less. A method using a ball mill, a roll mill, a sand mill, an attriter or supersonic waves is used as the method of mixing and dispersing the organic or inorganic semi-electroconductive particles. Mixing/dispersion is carried out in an organic solvent which may be any organic solvent dissolving an organometallic compound or resin and not causing gelation or aggregation upon mixing/dispersion of the organic or inorganic semi-electroconductive particles. For example, an usual organic solvent such as methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene and toluene may be used alone or a mixed solvent of two or more thereof may be used.

If necessary, an undercoat layer may also be formed between the electroconductive support and the photosensitive layer.

The material used in forming the undercoat layer includes organozirconium compounds such as zirconium chelate compound, zirconium alkoxide compound and zirconium coupling agent, organotitanium compounds such as titanium chelate compound, titanium alkoxide compound and titanate coupling agent, organoaluminum compounds such as aluminum chelate compound and aluminum coupling agent, and organometallic compounds such as antimony alkoxide compound, germanium alkoxide compound, indium alkoxide compound, indium chelate compound, manganese alkoxide compound, manganese chelate compound, tin alkoxide compound, tin chelate compound, aluminum silicon alkoxide compound, aluminum titanium alkoxide compound and aluminum zirconium alkoxide compound, and among them, organozirconium compounds, organotitanium compounds and organoaluminum compounds are preferably used because they exhibit excellent electrophotographic properties with low residual potential.

Further, silane coupling agents such vinyl trichlorosilane, vinyl trimethoxy silane, vinyl triethoxy silane, vinyl tris-2-methoxy ethoxy silane, vinyl triacetoxy silane, γ-glycidoxy propyl trimethoxy silane, γ-methacryloxy propyl trimethoxy silane, γ-aminopropyl triethoxy silane, γ-chloropropyl trimethoxy silane, γ-2-aminoethyl aminopropyl trimethoxy silane, γ-mercaptopropyl trimethoxy silane, γ-ureidopropyl triethoxy silane and β-3,4-epoxy cyclohexyl trimethoxy silane can be used in the undercoat layer.

It is also possible to use known binder resins used conventionally in the undercoat layer, for example polyvinyl alcohol, polyvinyl methyl ether, poly-N-vinylimidazole, polyethylene oxide, ethyl cellulose, methyl cellulose, ethylene-acrylic acid copolymer, polyamide, polyimide, casein, gelatin, polyethylene, polyester, phenol resin, vinyl chloride-vinyl acetate copolymer, epoxy resin, polyvinyl pyrrolidone, polyvinyl pyridine, polyurethane, polyglutamic acid and polyacrylic acid. The mixing ratio of these materials can be suitably selected depending on necessity.

An electron transporting pigment can be mixed/dispersed in the undercoat layer. The electron transporting pigments include pigments described in JP-A No. 47-30330, for example organic pigments such as perylene pigment, bisbenzimidazole perylene pigment, polycyclic quinone pigment, indigo pigment and quinacridone pigment, organic pigments such as bisazo pigment and phthalocyanine pigment having an electron attractive substituent group such as cyano group, nitro group, nitroso group and halogen atom, and inorganic pigments such as zinc oxide and titanium oxide.

Among these pigments, perylene pigment, bisbenzimidazole perylene pigment, polycyclic quinone pigment, zinc oxide and titanium oxide are preferably used because of their high electron mobility. These pigments may be surface-treated with the above-mentioned coupling agent, binder etc. for the purpose of regulating dispersibility and charge transportability. When the amount of the electron transport pigment is too high, the strength of the undercoat layer is reduced, and coating defects are generated, and thus the electron transporting pigment is used in an amount of 95 wt % or less, preferably 90 wt % or less.

As the mixing/dispersing method, a usual method of using a ball mill, a roll mill, a sand mill, an attriter or supersonic waves is used. Mixing/dispersion is carried out in an organic solvent which may be any organic solvent dissolving an organic metallic compound and resin and not causing gelation or aggregation upon mixing/dispersion of the electron transporting pigment. For example, an usual organic solvent such as methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene and toluene may be used alone, or a mixed solvent of two or more thereof may be used.

The thickness of the undercoat layer is generally 0.1 to 30 μm, preferably 0.2 to 25 μm. The coating method usable in forming the undercoat layer includes an usual method such as blade coating, Meyer bar coating, spray coating, dipping coating, bead coating, air knife coating and curtain coating. The coating solution is dried to give the undercoat layer, and usually, drying is carried out at a temperature where a coating can be formed by evaporating the solvent. Particularly, a substrate treated with an acidic solution or boehmite becomes poor in ability to hide defects on the substrate, and thus an intermediate layer is preferably formed.

Now, the charge generating layer is described in detail.

As a charge generation material used in forming the charge generating layer, use can be made of all known charge generation materials, for example azo pigments such as bisazo and trisazo, condensed aromatic pigments such as dibromoanthanthrone, organic pigments such as perylene pigment, pyrrolopyrrole pigment and phthalocyanine pigment, and inorganic pigments such as triclinic selenium and zinc oxide, and particularly when an exposure light wavelength of 380 nm to 500 nm is used, an inorganic pigment is preferable, and when an exposure light wavelength of 700 nm to 800 nm is used, metallic and nonmetallic phthalocyanine pigments are preferable. Particularly, hydroxy gallium phthalocyanine disclosed in JP-A No. 5-263007 and JP-A No. 5-279591, chlorogallium phthalocyanine in JP-A No. 5-98181, dichlorotin phthalocyanine in JP-A No. 5-140472 and JP-A No. 5-140473, and titanyl phthalocyanine in JP-A No. 4-189873 and JP-A No. 5-43813 are preferable.

The binder resin used in forming the charge generating layer can be selected from a wide variety of insulating resins or can be selected from organic photoelectroconductive polymers such as poly-N-vinyl carbazole, polyvinyl anthracene, polyvinyl pyrene and polysilane. The binder resin is preferably insulating resin which includes, but is not limited to, polyvinyl butyral resin, polyarylate resin (bisphenol A/phthalic acid polycondensate, etc.), polycarbonate resin, polyester resin, phenoxy resin, vinyl chloride-vinyl acetate copolymer, polyamide resin, acryl resin, polyacrylamide resin, polyvinyl pyridine resin, cellulose resin, urethane resin, epoxy resin, casein, polyvinyl alcohol resin and polyvinyl pyrrolidone resin. These binder resins may be used alone or as a mixture of two or more thereof.

The compounding ratio (weight ratio) of the charge generation material to the binder resin is preferably in the range of 10:1 to 1:10. As the method of dispersing them, use can be made of an usual method such as a ball mill dispersion method, an attriter dispersion method or a sand mill dispersion method, wherein conditions under which the crystalline form is not changed by dispersion are required. It is confirmed that the crystalline form is not changed after dispersion by the dispersion method carried out in the invention. In dispersion, it is effective for the size of the particle to be reduced to a size of 0.5 μm or less, preferably 0.3 μm or less, more preferably 0.15 μm or less.

As the solvent used in dispersion, an usual organic solvent such as methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene and toluene may be used alone, or a mixed solvent of two or more thereof may be used.

The thickness of the charge generating layer is generally 0.1 to 5 μm, preferably 0.2 to 2.0 μm. The coating method usable in forming the charge generating layer includes an usual method such as blade coating, Meyer bar coating, spray coating, dipping coating, bead coating, air knife coating and curtain coating.

Now, the charge transporting layer is described in detail.

As the charge transporting layer, a layer formed by known techniques can be used. The charge transporting layer may be formed by using a charge transport material and binder resin or by using a polymeric charge transport material.

The charge transport material includes electron transporting compounds, for example quinone compounds such as p-benzoquinone, chloranil, bromanil and anthraquinone, tetracyanoquinodimethane compound, fluorenone compound such as 2,4,7-trinitrofluorenone, xanthone compound, benzophenone compound, cyanovinyl compound and ethylene compound, and hole transporting compounds such as triaryl amine compound, benzidine compound, aryl alkane compound, aryl-substituted ethylene compound, stilbene compound, anthracene compound and hydrazone compound. These charge transport materials can be used alone or as a mixture of two or more thereof, and the charge transport material is not limited thereto. These charge transport materials can be used alone or as a mixture of two or more thereof, but from the viewpoint of mobility, the charge transport materials are preferably those having structures represented by the following formulae (A) to (C):

Formula (A)

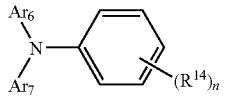

In the formula (A), $R^{14}$ represents a hydrogen atom or a methyl group; n is 1 or 2; $Ar_6$ and $Ar_7$ each represent a substituted or unsubstituted aryl group, and a substituent group, if any, is a halogen atom, a C1 to C5 alkyl group, a C1 to C5 alkoxy group, or an amino group substituted with a C1 to C3 alkyl group.

Formula (B)

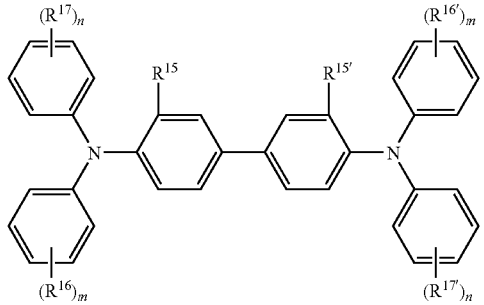

In the formula (B), $R^{15}$ and $R^{15'}$ may be the same or different and each represent a hydrogen atom, a halogen atom, a C1 to C5 alkyl group, or a C1 to C5 alkoxy group; $R^{16}$, $R^{16'}$, $R^{17}$ and $R^{17'}$ may be the same or different and each represent a hydrogen atom, a halogen atom, a C1 to C5 alkyl group, a C1 to C5 alkoxy group, an amino group substituted with a C1 to C2 alkyl group, a substituted or unsubstituted aryl group, $—C(R^{18})=C(R^{19})(R^{20})$, or $—CH=CH—CH=C(Ar)_2$; $R^{18}$, $R^{19}$ and $R^{20}$ each represent a hydrogen atom, a substituted or unsubstituted alkyl group, a substituted or unsubstituted aryl group; Ar represents a substituted or unsubstituted aryl group; and each of m and n is an integer of 0 to 2.

Formula (C)

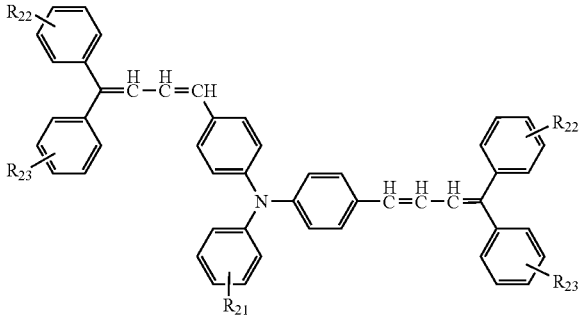

In the formula (C), $R_{21}$ represents a hydrogen atom, a C1 to C5 alkyl group, a C1 to C5 alkoxy group, a substituted or unsubstituted aryl group, or $—CH=CH—CH=C(Ar)_2$; Ar represents a substituted or unsubstituted aryl group; $R_{22}$ and $R_{23}$ may be the same or different and each represent a hydrogen atom, a halogen atom, a C1 to C5 alkyl group, a C1 to C5 alkoxy group, an amino group substituted with a C1 to C2 alkyl group, or a substituted or unsubstituted aryl group.

As the binder resin used in the charge transporting layer, it is possible to use polymer charge transport materials such as polycarbonate resin, polyester resin, methacryl resin, acryl resin, polyvinyl chloride resin, polyvinylidene chloride resin, polystyrene resin, polyvinyl acetate resin, styrene-butadiene copolymer, vinylidene chloride-acrylonitrile copolymer, vinyl chloride-vinyl acetate copolymer, vinyl chloride-vinyl acetate-maleic anhydride copolymer, silicone resin, silicone-alkyd resin, phenol-formaldehyde resin, styrene-alkyd resin, poly-N-vinyl carbazole, polysilane, as well as polyester-based polymeric charge transport materials and polymeric charge transport materials described in JP-A No. 8-176293 and JP-A No. 8-208820. These binder resins can be used alone or as a mixture of two or more thereof. The compounding ratio (weight ratio) of the charge transport material to the binder resin is preferably from 10:1 to 1:5.

For formation of the charge transporting layer, the polymer charge transport materials can be used alone. As the polymer charge transport materials, known materials having charge transportability, such as poly-N-vinyl carbazole and polysilane, can be used. Particularly polyester-based polymeric charge transport materials described in JP-A No. 8-176293 and JP-A No. 8-208820 have high charge transportability and are particularly preferable. The polymeric charge transport material only can be used as the charge transporting layer, but may be mixed with the binder resin to form a coating.

The thickness of the charge transporting layer is generally 5 to 50 μm, preferably 10 to 30 μm. As the coating method, it is possible to use an usual method such as blade coating, Meyer bar coating, spray coating, dipping coating, bead coating, air knife coating and curtain coating. The solvent used in forming the charge transporting layer includes usual organic solvents such as aromatic hydrocarbons such as benzene, toluene, xylene and chlorobenzene, ketones such as acetone and 2-butanone, halogenated aliphatic hydrocarbons such as methylene chloride, chloroform and ethylene chloride, and cyclic or linear ethers such as tetrahydrofuran and ethyl ether, or a mixed solvent thereof.

For the purpose of preventing the deterioration of the photoreceptor due to ozone and an oxidized gas generated in a copier or due to light or heat, additives such as an antioxidant, a light stabilizer and a heat stabilizer can be added to the photosensitive layer. For example, the antioxidant includes hindered phenol, hindered amine, paraphenylene diamine, aryl alkane, hydroquinone, spirochroman, spiroindanone and derivatives thereof, organic sulfur compounds, organic phosphorous compounds, etc. Examples of the light stabilizer include derivatives such as benzophenone, benzotriazole, dithiocarbamate and tetramethyl piperidine.

For the purpose of improvement in sensitivity, reduction in residual potential, reduction in fatigue upon repeated use, etc., at least one kind of electron receptor can be contained. The electron receptor usable in the photoreceptor of the invention includes, for example, succinic anhydride, maleic anhydride, dibromomaleic anhydride, phthalic anhydride, tetrabromophthalic anhydride, tetracyanoethylene, tetracyanoquinodimethane, o-dinitrobenzene, m-dinitrobenzene, chloranil, dinitroanthraquinone, trinitrofluorenone, picric acid, o-nitrobenzoic acid, p-nitrobenzoic acid, phthalic acid and compounds represented by the formula (I). Among these compounds, fluorenone- and quinone-based electron receptors and benzene derivatives having electron attractive substituent groups such as Cl, CN and $NO_2$ are particularly preferable.

Now, the protective layer is described in detail.

To confer resistance to abrasion, scratch etc. on the surface of the photoreceptor, a high-strength protective layer can also be formed. This protective layer is preferably a layer wherein electroconductive particles are dispersed in a binder resin, or lubricating particles such as fluorine resin, acryl resin etc. are dispersed in an usual charge transport material, or a hard coating agent such as silicone and acryl, and from the viewpoint of strength, electric characteristics and image quality maintenance, the protective layer contains preferably resin having a crosslinked structure, more preferably a charge transport material. As the resin having a crosslinked structure, various materials can be used, and in respect of characteristics, phenol resin, urethane resin, siloxane resin etc. are preferable, and particularly a protective layer consisting of siloxane-based resin is preferable. Especially, a protective layer having a structure derived from a compound represented by the formula (I) or (II) is excellent in strength and stability and is thus particularly preferable.

$$F\text{-}[D\text{-}Si(R^2)_{(3-a)}Q_a]_b \quad (I)$$

In the formula (I), F is an organic group derived from a compound having hole transportability, D is a flexible subunit, $R^2$ represents hydrogen, an alkyl group or a substituted or unsubstituted aryl group, Q represents a hydrolyzable group, a is an integer of 1 to 3, and b is an integer of 1 to 4.

The flexible subunit represented by D in the formula (I) contain essentially $—(CH_2)_n—$ group, which may be combined with —COO—, —O—, —CH═CH— or —CH═N— group to form a divalent linear group. In the $—(CH_2)_n—$ group, n is an integer of 1 to 5. The hydrolyzable group represented by Q represents —OR group wherein R represents an alkyl group.

$$F—((X)_nR_1\text{-}ZH)_m \quad (II)$$

In the formula (II), F is an organic group derived from a compound having hole transportability, $R_1$ is an alkylene group, Z is —O—, —S—, —NH— or —COO—, and m is an integer of 1 to 4. X represents —O— or —S—, and n is integer of 0 or 1.

The compound represented by the formula (I) or (II) is more preferably a compound wherein the organic group F is represented particularly by the following formula (III):

(III)

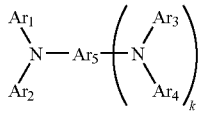

In the formula (III), $Ar_1$ to $Ar_4$ independently represent a substituted or unsubstituted aryl group, $Ar_5$ represents a substituted or unsubstituted aryl or arylene group and simultaneously two to four of $Ar_1$ to $Ar_5$ have a linking bond represented by $\text{-}D\text{-}Si(R^2)_{(3-a)}Q_a$ in the formula (I) and k is 0 or 1. D is a flexible subunit, $R^2$ represents hydrogen, an alkyl group or a substituted or unsubstituted aryl group, Q represents a hydrolyzable group, and a is an integer of 1 to 3.

In the formula (III), $Ar_1$ to $Ar_4$ independently represent a substituted or unsubstituted aryl group, and are specifically preferably groups represented by the following structure group 1:

Structure Group 1

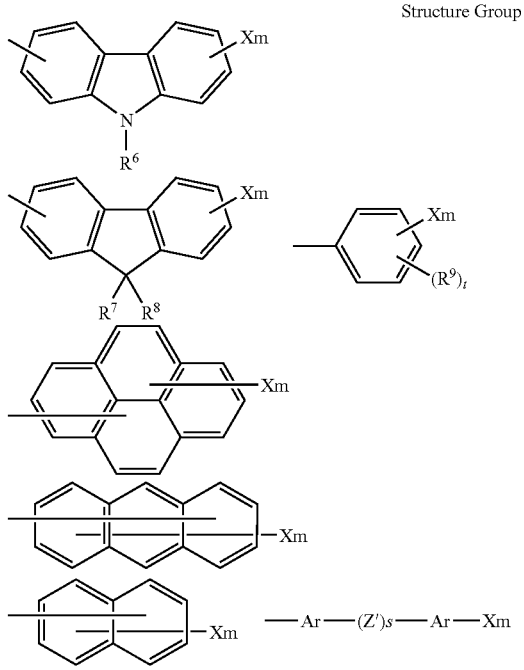

Ar shown in the structure group 1 is selected preferably from the following structure group 2, and Z' is selected preferably from the following structure group 3.

Structure Group 2

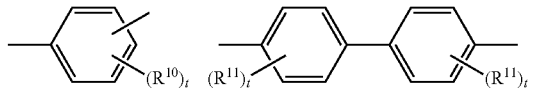

Structure Group 3

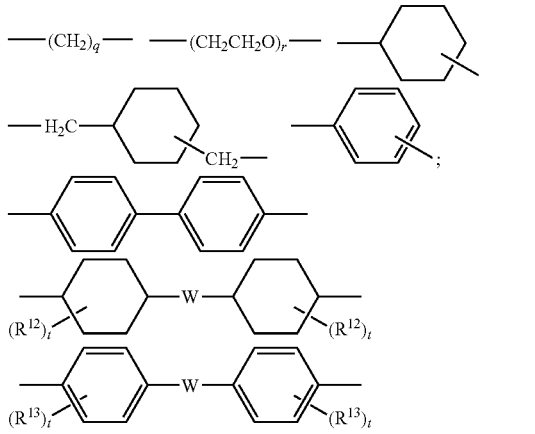

In the structure groups 1 to 3, $R^6$ is selected from hydrogen, a C1 to C4 alkyl group, a phenyl group substituted with a C1 to C4 alkyl group or a C1 to C4 alkoxy group, an unsubstituted phenyl group, or a C7 to C10 aralkyl group.

Each of $R^7$ to $R^{13}$ is selected from hydrogen, a C1 to C4 alkyl group, a C1 to C4 alkoxy group, a phenyl group substituted with a C1 to C4 alkoxy group, an unsubstituted phenyl group, a C7 to C10 aralkyl group, or halogen.

m and s each represent 0 or 1, q and r each represent an integer of 1 to 10, and t represents an integer of 1 to 3. X represents a group represented by $\text{-}D\text{-}Si(R^2)_{(3-a)}Q_a$ in the formula (I).

W shown in the structure group 3 is represented preferably by the following structure group 4. In the structure group 4, s' is an integer of 0 to 3.

Structure Group 4

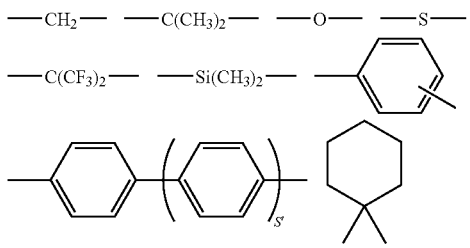

The specific structure of $Ar_5$ in the formula (III), when k=0, includes the structure of $Ar_1$ to $Ar_4$ wherein m=1 shown in the structure group 1, or when k=1, includes the structure of $Ar_1$ to $Ar_4$ wherein m=0 in the structure group 1.

Specific examples of the compounds represented by the formula (III) include compounds (III-1) to (III-61) shown in Tables 1 to 7 below, but the compounds represented by the formula (III) used in the invention are not limited thereto.

In the structural formulae shown in the items "$Ar_1$" to "$Ar_5$" in Tables 1 to 7, the benzene ring-bound "—S group" refers to a monovalent group (group corresponding to the structure represented by $-D-Si(R^2)_{(3-a)}Q_a$ in the formula (I)) shown in the item "S" in Tables 1 to 7.

| No. | $Ar^1$ | $Ar^2$ | $Ar^3$ | $Ar^4$ |
|---|---|---|---|---|
| III-1 | 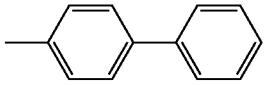 | 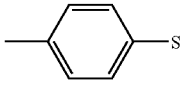 | — | — |
| III-2 | 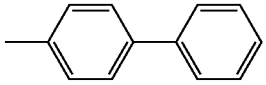 | 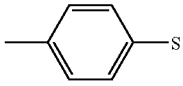 | — | — |
| III-3 | 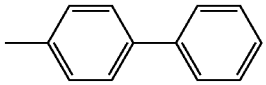 | 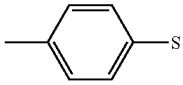 | — | — |
| III-4 | 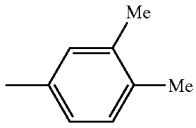 | 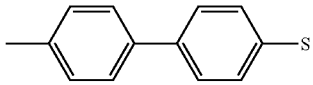 | — | — |
| III-5 | 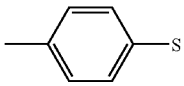 | 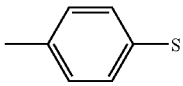 | — | — |
| III-6 | 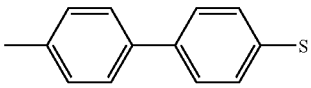 | 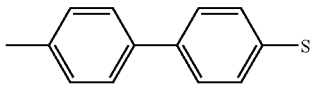 | — | — |
| III-7 | 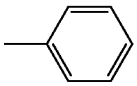 | 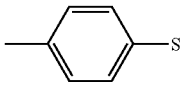 | 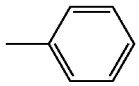 | 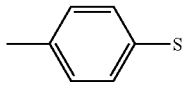 |
| III-8 | 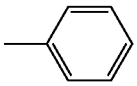 | 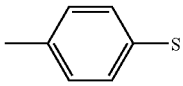 | 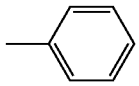 | 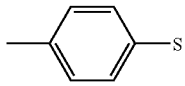 |
| III-9 | 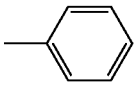 | 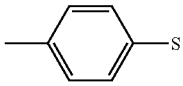 | 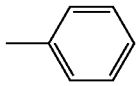 | 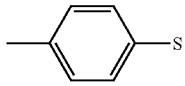 |
| III-10 | 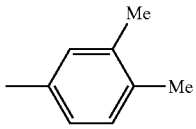 | 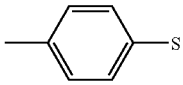 | 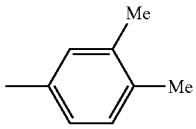 | 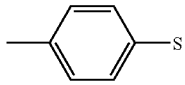 |

-continued
| No. | $Ar^5$ | k | S |
|---|---|---|---|
| III-1 | 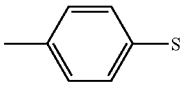 | 0 | —$(CH_2)_2$—COO—$(CH_2)_3$—Si(OiPr)$_3$ |
| III-2 | 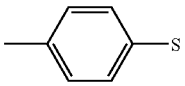 | 0 | —$(CH_2)_2$—COO—$(CH_2)_3$—Si(OiPr)$_2$Me |
| III-3 | 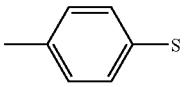 | 0 | —$(CH_2)_2$—COO—$(CH_2)_3$—Si(OiPr)Me$_2$ |
| III-4 | 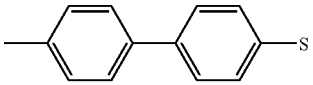 | 0 | —COO—$(CH_2)_3$—Si(OiPr)$_3$ |
| III-5 | 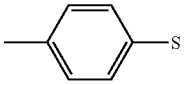 | 0 | —$(CH_2)_2$—COO—$(CH_2)_3$—Si(OiPr)$_3$ |
| III-6 | 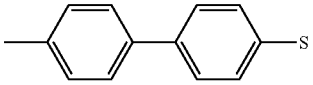 | 0 | —COO—$(CH_2)_3$—Si(OiPr)$_3$ |
| III-7 | 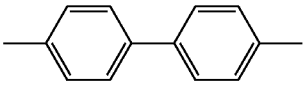 | 1 | —$(CH_2)_4$—Si(OEt)$_3$ |
| III-8 | 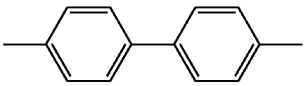 | 1 | —$(CH_2)_4$—Si(OiPr)$_3$ |
| III-9 | 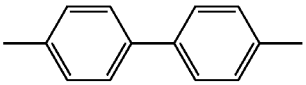 | 1 | —CH═CH—$(CH_2)_2$—Si(OiPr)$_3$ |
| III-10 | 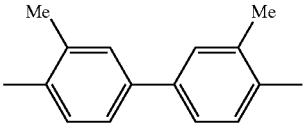 | 1 | —$(CH_2)_4$—Si(OMe)$_3$ |
| No. | $Ar^1$ | $Ar^2$ | $Ar^3$ | $Ar^4$ |
|---|---|---|---|---|
| III-11 | 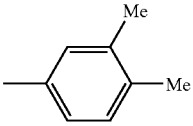 | 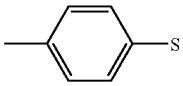 | 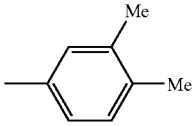 | 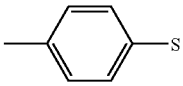 |
| III-12 | 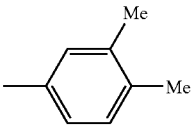 | 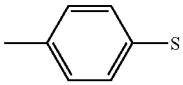 | 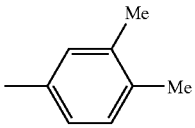 | 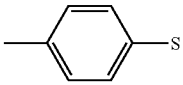 |

-continued
| | | | | |
|---|---|---|---|---|
| III-13 | 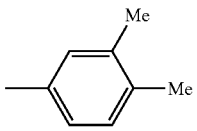 | 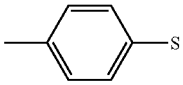 | 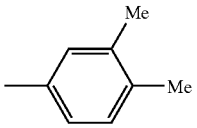 | 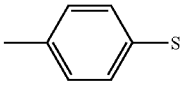 |
| III-14 | 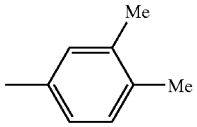 | 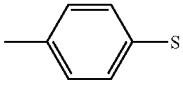 | 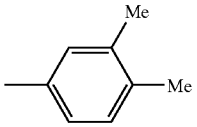 | 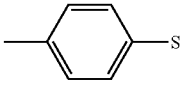 |
| III-15 | 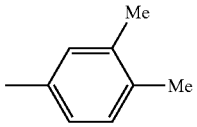 | 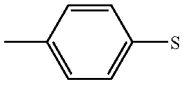 | 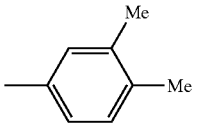 | 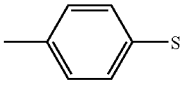 |
| III-16 | 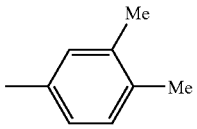 | 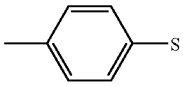 | 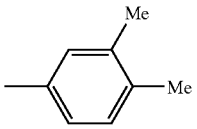 | 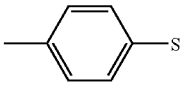 |
| III-17 | 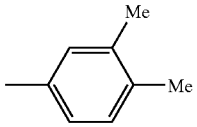 | 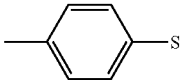 | 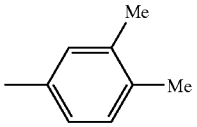 | 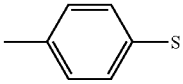 |
| III-18 | 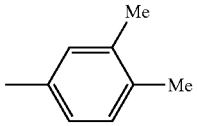 | 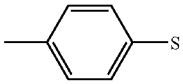 | 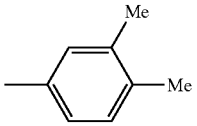 | 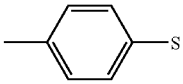 |
| III-19 | 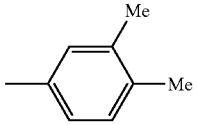 | 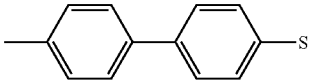 | 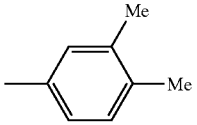 | 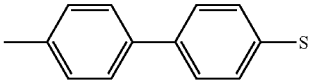 |
| III-20 | 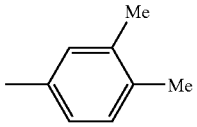 | 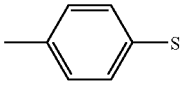 | 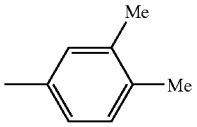 | 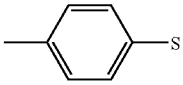 |
| No. | $Ar^5$ | k | S |
|---|---|---|---|
| III-11 | 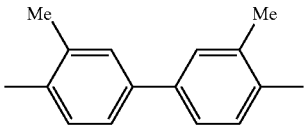 | 1 | —$(CH_2)_4$—Si(OiPr)$_3$ |
| III-12 | 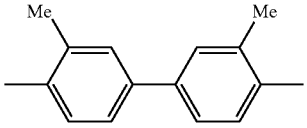 | 1 | —CH═CH—$(CH_2)_2$—Si(OiPr)$_3$ |
| III-13 | 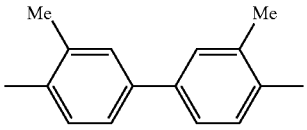 | 1 | —CH═N—$(CH_2)_3$—Si(OiPr)$_3$ |

-continued
| | | | |
|---|---|---|---|
| III-14 | 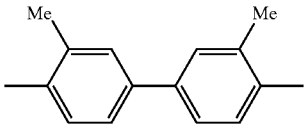 | 1 | —O—$(CH_2)_3$—Si(OiPr)$_3$ |
| III-15 | 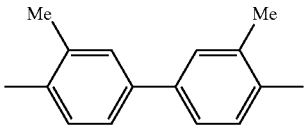 | 1 | —COO—$(CH_2)_3$—Si(OiPr)$_3$ |
| III-16 | 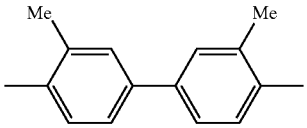 | 1 | —$(CH_2)_2$—COO—$(CH_2)_3$—Si(OiPr)$_3$ |
| III-17 | 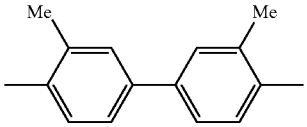 | 1 | —$(CH_2)_2$—COO—$(CH_2)_3$—Si(OiPr)$_2$Me |
| III-18 | 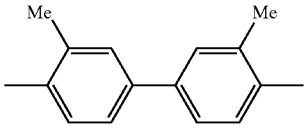 | 1 | —$(CH_2)_2$—COO—$(CH_2)_3$—Si(OiPr)Me$_2$ |
| III-19 | 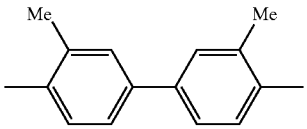 | 1 | —COO—$(CH_2)_3$—Si(OiPr)$_3$ |
| III-20 | 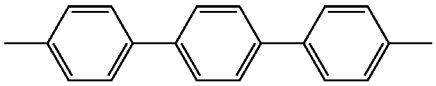 | 1 | —$(CH_2)_4$—Si(OiPr)$_3$ |
| No. | $Ar^1$ | $Ar^2$ | $Ar^3$ | $Ar^4$ |
|---|---|---|---|---|
| III-21 | 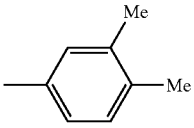 | 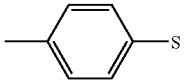 | 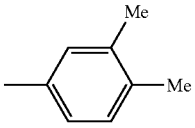 | 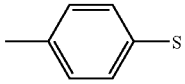 |
| III-22 | 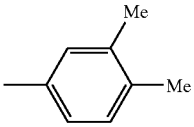 | 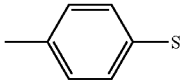 | 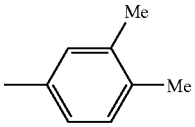 | 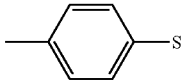 |
| III-23 | 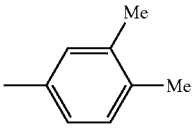 | 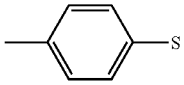 | 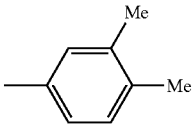 | 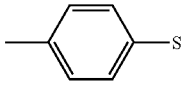 |
| III-24 | 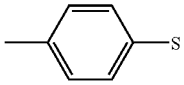 | 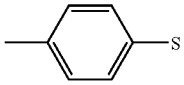 | 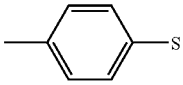 | 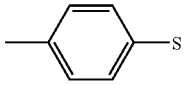 |

-continued
| | | | | |
|---|---|---|---|---|
| III-25 | 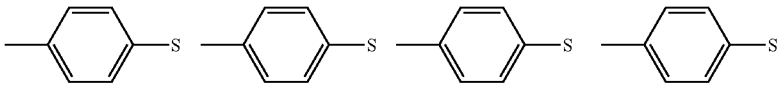 | | | |
| III-26 | 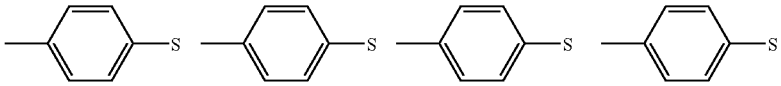 | | | |
| III-27 | 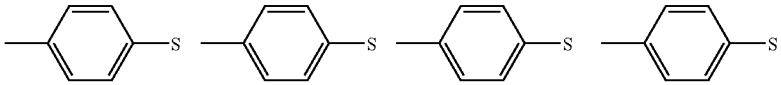 | | | |
| III-28 | 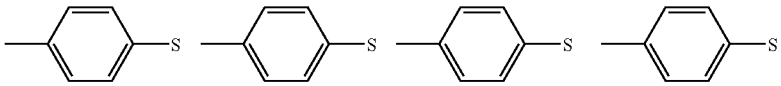 | | | |
| III-29 | 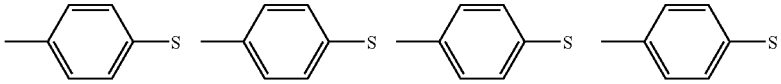 | | | |
| III-30 | 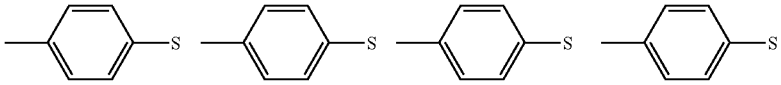 | | | |
| No. | $Ar^5$ | k | S | |
| III-21 | 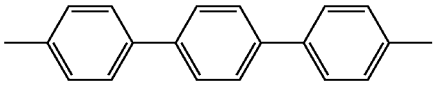 | 1 | —CH═CH—$(CH_2)_2$—Si(OiPr)$_3$ | |
| III-22 | 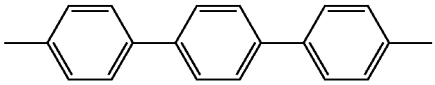 | 1 | —$(CH_2)_2$—COO—$(CH_2)_3$—Si(OiPr)$_3$ | |
| III-23 | 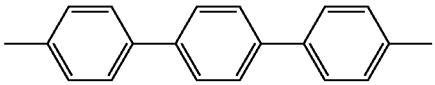 | 1 | —$(CH_2)_2$—COO—$(CH_2)_3$—Si(OiPr)$_2$Me | |
| III-24 | 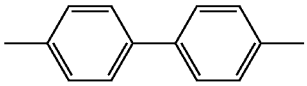 | 1 | —COO—$(CH_2)_3$—Si(OiPr)$_3$ | |
| III-25 | 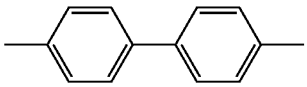 | 1 | —$(CH_2)_2$—COO—$(CH_2)_3$—Si(OiPr)$_3$ | |
| III-26 | 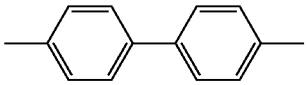 | 1 | —$(CH_2)_2$—COO—$(CH_2)_3$—Si(OiPr)$_2$Me | |
| III-27 | 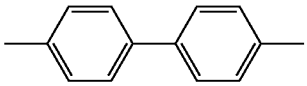 | 1 | —$(CH_2)_2$—COO—$(CH_2)_3$—Si(OiPr)Me$_2$ | |
| III-28 | 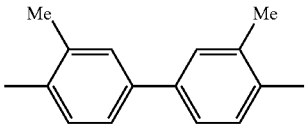  | 1 | —COO—$(CH_2)_3$—Si(OiPr)$_3$ | |
| III-29 | 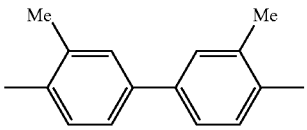  | 1 | —$(CH_2)_2$—COO—$(CH_2)_3$—Si(OiPr)$_3$ | |

-continued
| | | | |
|---|---|---|---|
| III-30 | 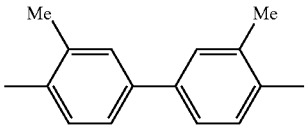 | 1 | —$(CH_2)_2$—COO—$(CH_2)_3$—Si(OiPr)$_2$Me |
| No. | $Ar^1$ | $Ar^2$ | $Ar^3$ | $Ar^4$ |
|---|---|---|---|---|
| III-31 | 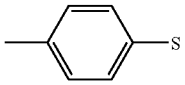 | 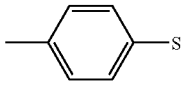 | 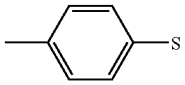 | 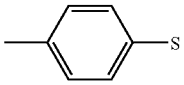 |
| III-32 | 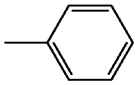 | 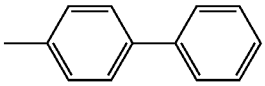 | — | — |
| III-33 | 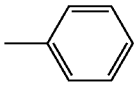 | 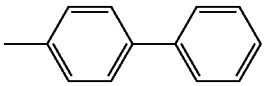 | — | — |
| III-34 | 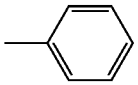 | 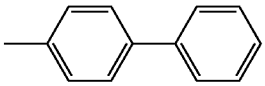 | — | — |
| III-35 | 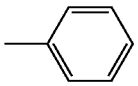 | 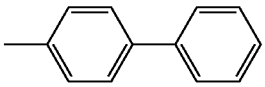 | — | — |
| III-36 | 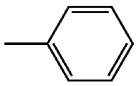 | 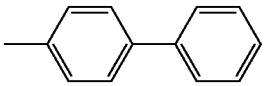 | — | — |
| III-37 | 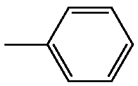 | 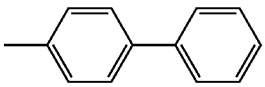 | — | — |
| III-38 | 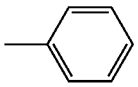 | 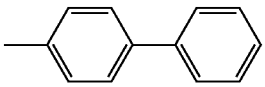 | — | — |
| III-39 | 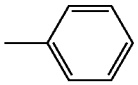 | 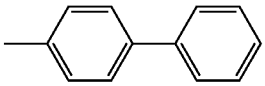 | — | — |
| III-40 | 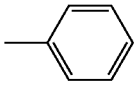 | 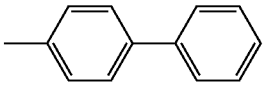 | — | — |
| No. | $Ar^5$ | k | S |
|---|---|---|---|
| III-31 | 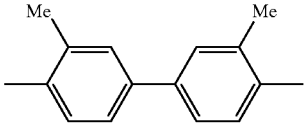 | 1 | —$(CH_2)_2$—COO—$(CH_2)_3$—Si(OiPr)Me$_2$ |
| III-32 | 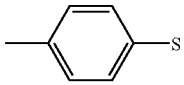 | 0 | —$(CH_2)_4$—Si(OiPr)$_3$ |

-continued
| | | | |
|---|---|---|---|
| III-33 | 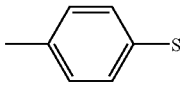 | 0 | —$(CH_2)_4$—$Si(OEt)_3$ |
| III-34 | 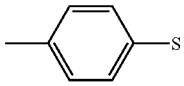 | 0 | —$(CH_2)_4$—$Si(OMe)_3$ |
| III-35 | 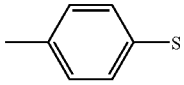 | 0 | —$(CH_2)_4$—$SiMe(OMe)_2$ |
| III-36 | 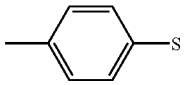 | 0 | —$(CH_2)_4$—$SiMe(OiPr)_2$ |
| III-37 | 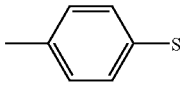 | 0 | —CH═CH—$(CH_2)_2$—$Si(OiPr)_3$ |
| III-38 | 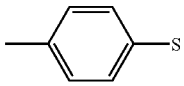 | 0 | —CH═CH—$(CH_2)_2$—$Si(OMe)_3$ |
| III-39 | 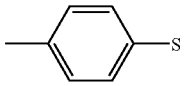 | 0 | —CH═N—$(CH_2)_3$—$Si(OiMe)_3$ |
| III-40 | 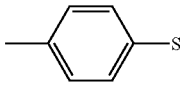 | 0 | —CH═N—$(CH_2)_3$—$Si(OiPr)_3$ |
| No. | $Ar^1$ | $Ar^2$ | $Ar^3$ | $Ar^4$ |
|---|---|---|---|---|
| III-41 | 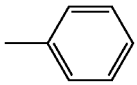 | 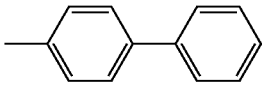 | — | — |
| III-42 | 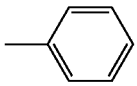 | 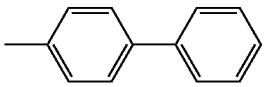 | — | — |
| III-43 | 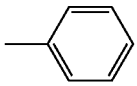 | 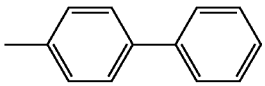 | — | — |
| III-44 | 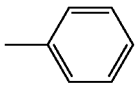 | 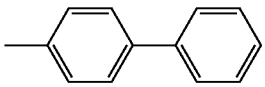 | — | — |
| III-45 | 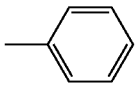 | 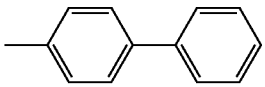 | — | — |
| III-46 | 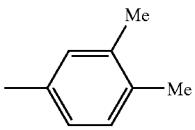  | 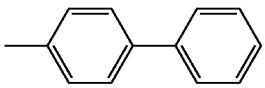 | — | — |

-continued
| | | | | |
|---|---|---|---|---|
| III-47 | 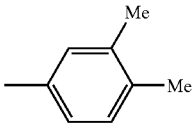 | 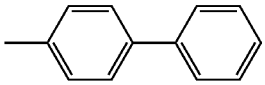 | — | — |
| III-48 | 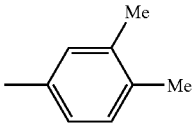 | 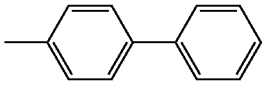 | — | — |
| III-49 | 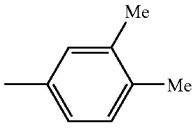 | 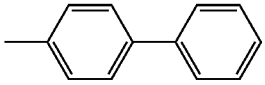 | — | — |
| III-50 | 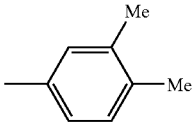 | 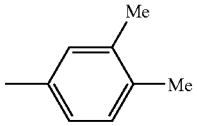 | — | — |
| No. | $Ar^5$ | k | S |
|---|---|---|---|
| III-41 | 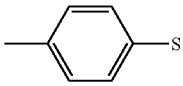 | 0 | —O—$(CH_2)_3$—Si(OiPr)$_3$ |
| III-42 | 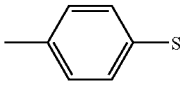 | 0 | —COO—$(CH_2)_3$—Si(OiPr)$_3$ |
| III-43 | 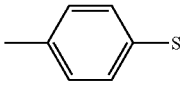 | 0 | —$(CH_2)_2$—COO—$(CH_2)_3$—Si(OiPr)$_3$ |
| III-44 | 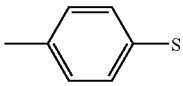 | 0 | —$(CH_2)_2$—COO—$(CH_2)_3$—Si(OiPr)$_2$Me |
| III-45 | 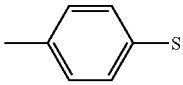 | 0 | —$(CH_2)_2$—COO—$(CH_2)_3$—Si(OiPr)Me$_2$ |
| III-46 | 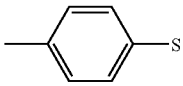 | 0 | —$(CH_2)_4$—Si(OMe)$_3$ |
| III-47 | 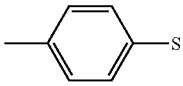 | 0 | —$(CH_2)_2$—COO—$(CH_2)_3$—Si(OiPr)$_3$ |
| III-48 | 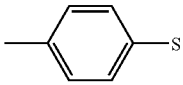 | 0 | —$(CH_2)_2$—COO—$(CH_2)_3$—SiMe(OiPr)$_2$ |
| III-49 | 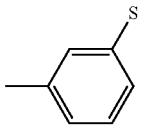 | 0 | —O—$(CH_2)_3$—Si(OiPr)$_3$ |

-continued
| | | | |
|---|---|---|---|
| III-50 | 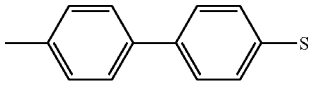 | 0 | —COO—$(CH_2)_3$—Si(OiPr)$_3$ |
| No. | $Ar^1$ | $Ar^2$ | $Ar^3$ | $Ar^4$ |
|---|---|---|---|---|
| III-51 | 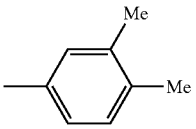 | 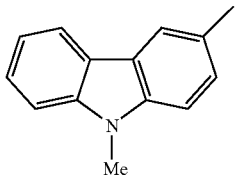 | — | — |
| III-52 | 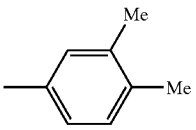 | 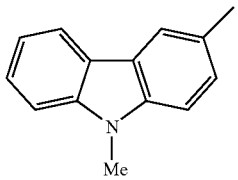 | — | — |
| III-53 | 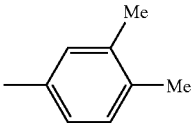 | 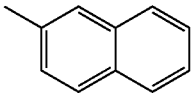 | — | — |
| III-54 | 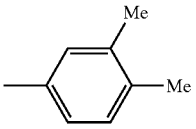 | 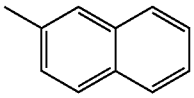 | — | — |
| III-55 | 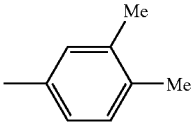 | 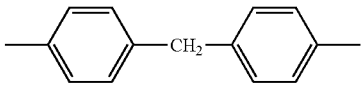 | — | — |
| III-56 | 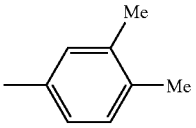 | 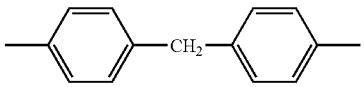 | — | — |
| III-57 | 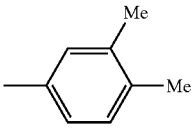 | 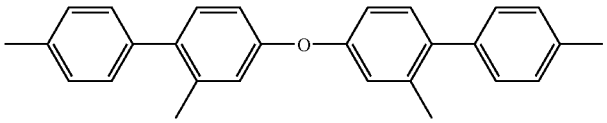 | — | — |
| III-58 | 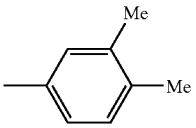 | 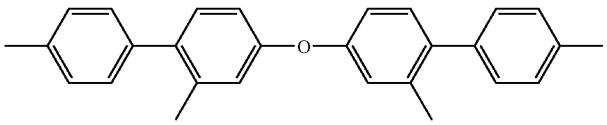 | — | — |
| III-59 | 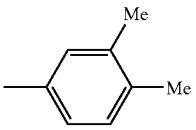 | 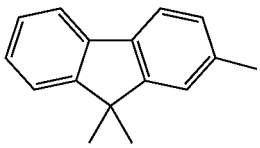 | — | — |

-continued
| No. | $Ar^5$ | k | S |
|---|---|---|---|
| III-51 | 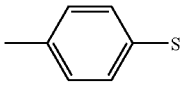 | 0 | —$(CH_2)_4$—Si(OiPr)$_3$ |
| III-52 | 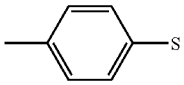 | 0 | —$(CH_2)_2$—COO—$(CH_2)_3$—Si(OiPr)$_3$ |
| III-53 | 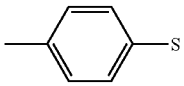 | 0 | —$(CH_2)_4$—Si(OiPr)$_3$ |
| III-54 | 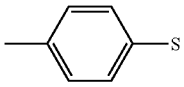 | 0 | —$(CH_2)_2$—COO—$(CH_2)_3$—Si(OiPr)$_3$ |
| III-55 | 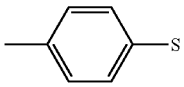 | 0 | —$(CH_2)_4$—Si(OiPr)$_3$ |
| III-56 | 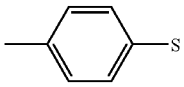 | 0 | —$(CH_2)_2$—COO—$(CH_2)_3$—Si(OiPr)$_3$ |
| III-57 | 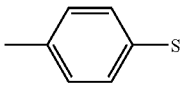 | 0 | —$(CH_2)_4$—Si(OiPr)$_3$ |
| III-58 | 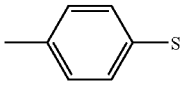 | 0 | —$(CH_2)_2$—COO—$(CH_2)_3$—Si(OiPr)$_3$ |
| III-59 | 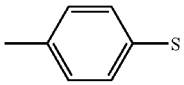 | 0 | —$(CH_2)_2$—COO—$(CH_2)_3$—Si(OiPr)$_3$ |
| No. | $Ar^1$ | $Ar^2$ | $Ar^3$ | $Ar^4$ |
|---|---|---|---|---|
| III-60 | 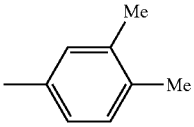 | 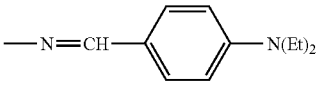 | — | — |
| III-61 | 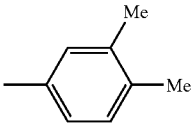 | 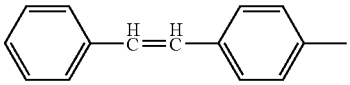 | — | — |
| No. | $Ar^5$ | k | S |
|---|---|---|---|
| III-60 | 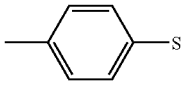 | 0 | —$(CH_2)_2$—COO—$(CH_2)_3$—Si(OiPr)$_3$ |
| III-61 | 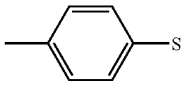 | 0 | —$(CH_2)_2$—COO—$(CH_2)_3$—Si(OiPr)$_3$ |

Specific examples of the compounds represented by the formula (II) include compounds represented by the following formulae (II)-1 to (II)-26, but the invention is not limited thereto.
(II)-1
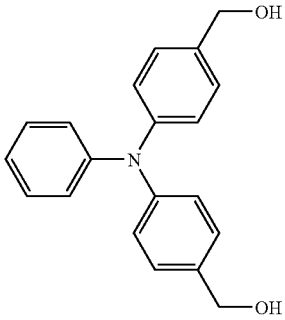
(II)-2
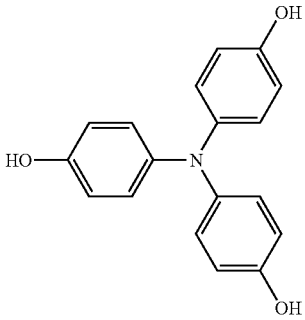
(II)-3
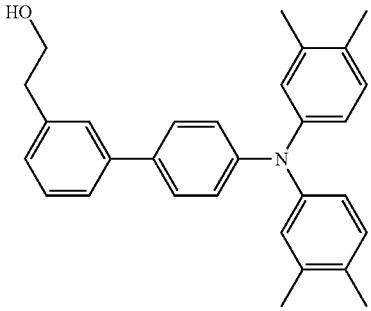
(II)-4
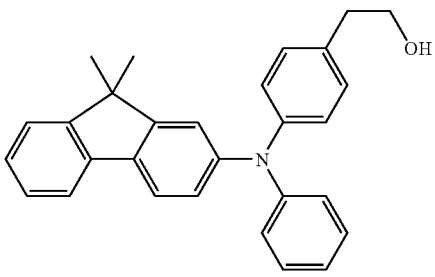
-continued
(II)-5
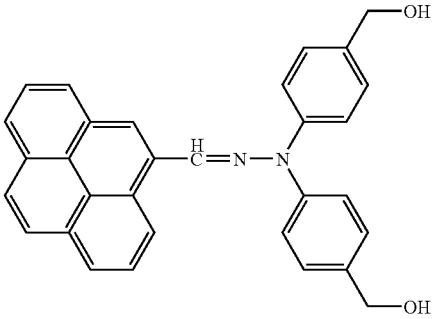
(II)-6
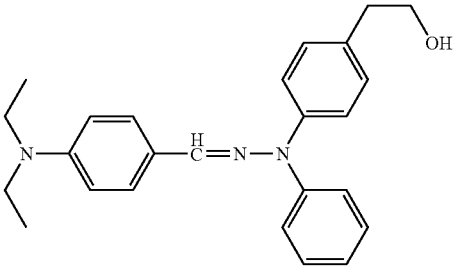
(II)-7
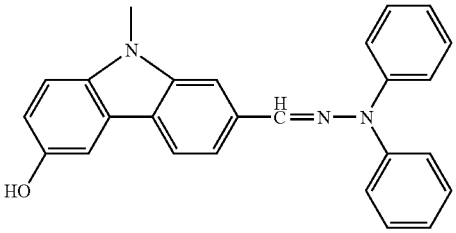
(II)-8
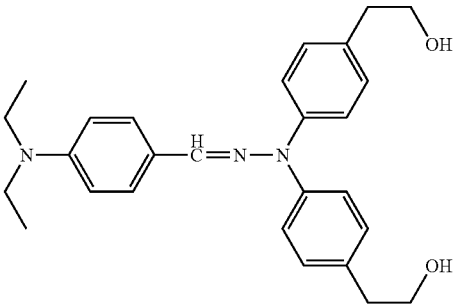
(II)-9
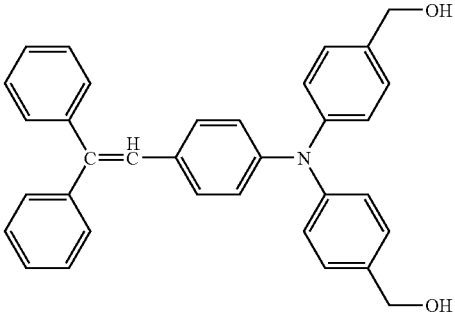

-continued
(II)-10
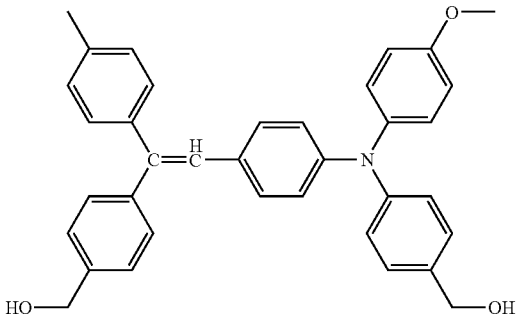
(II)-11
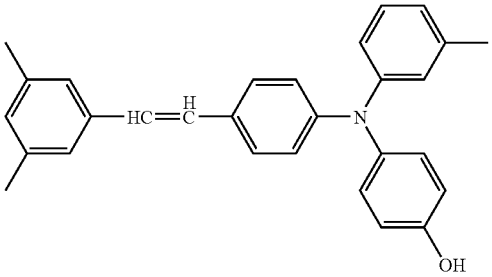
(II)-12
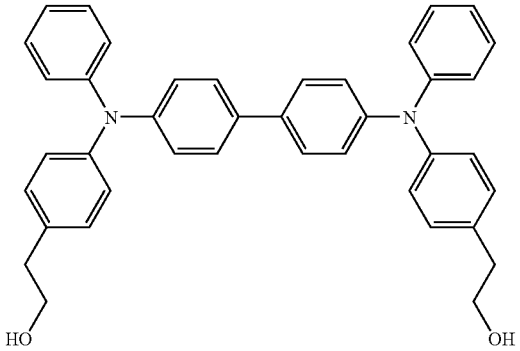
(II)-13
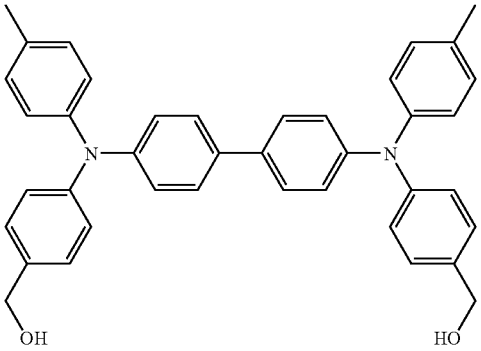
-continued
(II)-14
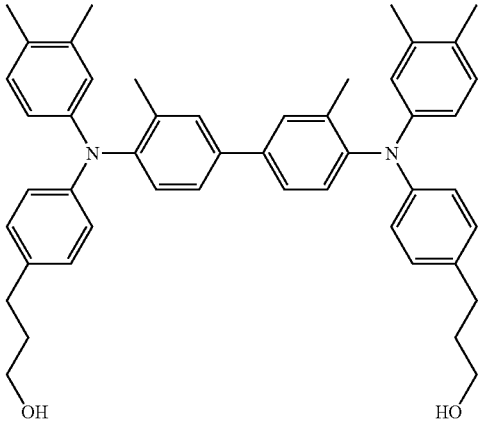
(II)-15
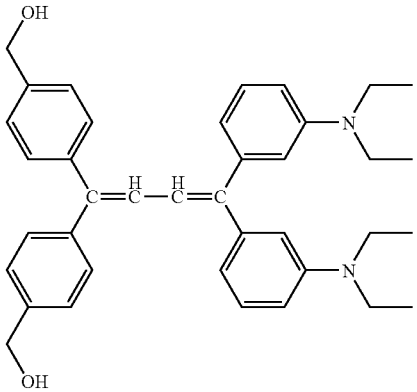
(II)-16
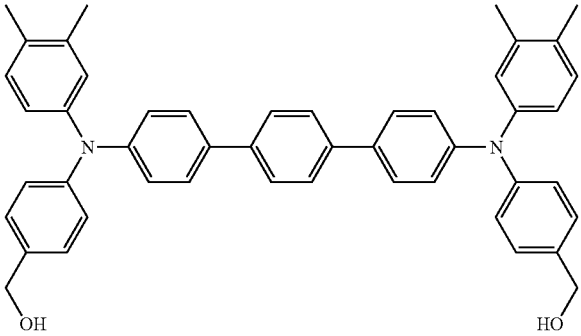
(II)-17
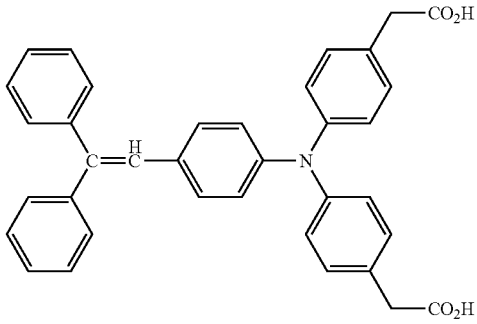

-continued
(II)-18
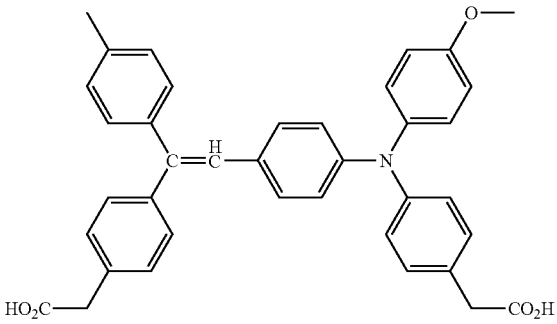
(II)-19
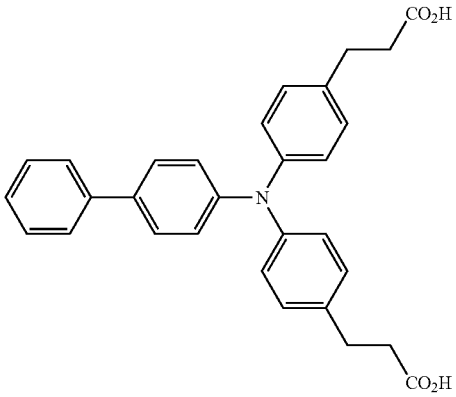
(II)-20
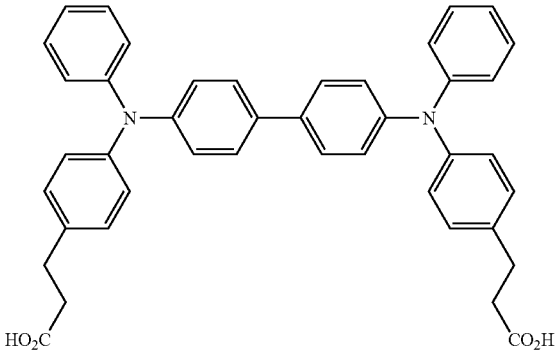
(II)-21
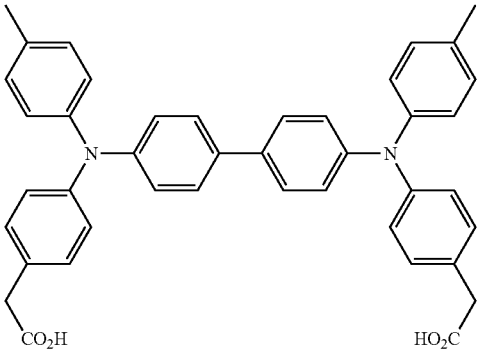
-continued
(II)-22
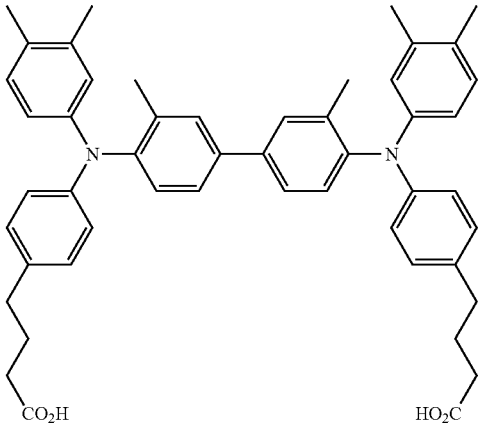
(II)-23
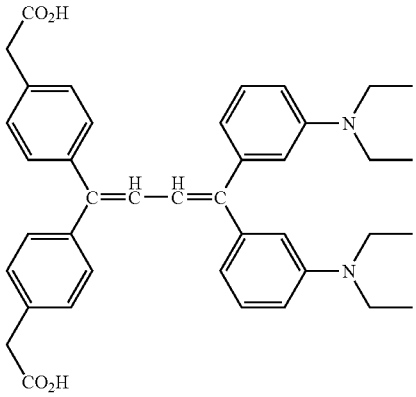
(II)-24
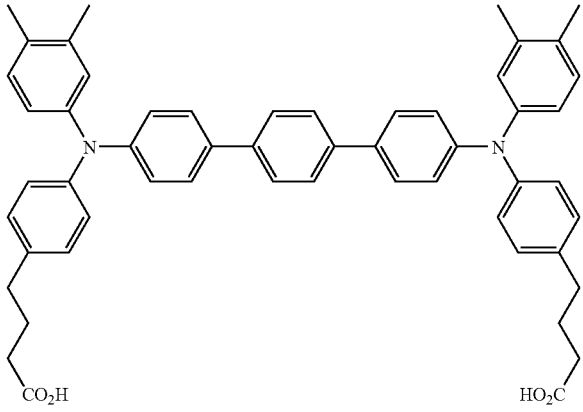

-continued (II)-25

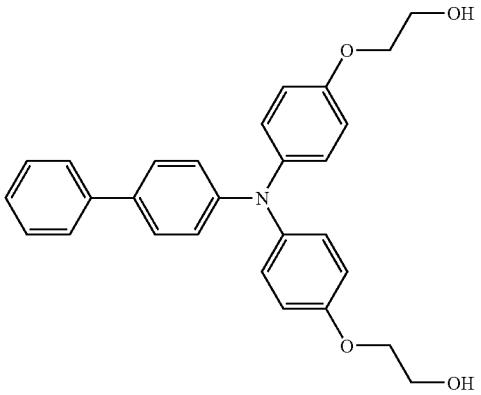

(II)-26

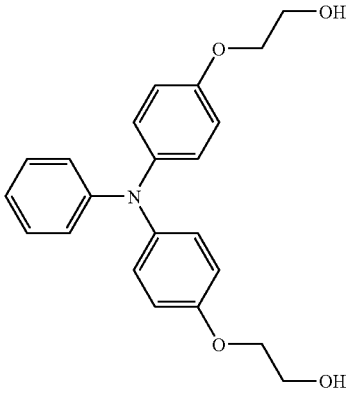

To control various physical properties such as strength and film resistance, it is possible to add a compound represented by the following formula (IV):

$$Si(R^2)_{(4-c)}Q_c \quad (IV)$$

wherein $R^2$ represents hydrogen, an alkyl group or a substituted or unsubstituted aryl group, Q represents a hydrolyzable group, and c is an integer of 1 to 4.

Specific examples of the compounds represented by the formula (VI) include the following silane coupling agents: Tetrafunctional alkoxy silane (c=4) such as tetramethoxy silane and tetraethoxy silane; trifunctional alkoxy silane (c=3) such as methyl trimethoxy silane, methyl triethoxy silane, ethyl trimethoxy silane, methyl trimethoxy ethoxy silane, vinyl trimethoxy silane, vinyl triethoxy silane, phenyl trimethoxy silane, γ-glycidoxy propyl methyl diethoxy silane, γ-glycidoxy propyl trimethoxy silane, γ-glycidoxy propyl trimethoxy silane, γ-aminopropyl triethoxy silane, γ-aminopropyl trimethoxy silane, γ-aminopropyl methyl dimethoxy silane, N-β(aminoethyl) γ-aminopropyl triethoxy silane, (tridecafluoro-1,1,2,2-tetrahydrooctyl)triethoxy silane, (3,3,3-trifluoropropyl)trimethoxy silane, 3-(heptafluoroisopropoxy)propyl triethoxy silane, 1H,1H,2H,2H-perfluoroalkyl triethoxy silane, 1H,1H,2H,2H-perfluorodecyl triethoxy silane and 1H,1H,2H,2H-perfluorooctyl triethoxy silane; bifunctional alkoxy silane (c=2) such as dimethyl dimethoxy silane, diphenyl dimethoxy silane and methyl phenyl dimethoxy silane; and monofunctional alkoxy silane (c=1) such as trimethyl methoxy silane. For improving film strength, tri- and tetrafunctional alkoxy silane is preferable, and for improving flexibility and film formability, di- and monofunctional alkoxy silane is preferable.

Silicone-based hard coating agent prepared mainly from these coupling agents can also be used. As commercial hard coating agent, it is possible to use KP-85, X-40-9740, X-40-2239 (manufactured by Shin-Etsu Chemical Co., Ltd.) and AY42-440, AY42-441 and AY49-208 (manufactured by Dow Corning Toray Co., Ltd.).

To increase strength, it is also preferable to use a compound having two or more silicon atoms represented by the following formula (V):

$$B—(Si(R^2)_{(3-a)}Q_a)_2 \quad (V)$$

wherein B represents a divalent organic group, $R^2$ represents hydrogen, an alkyl group or a substituted or unsubstituted aryl group, Q represents a hydrolyzable group, and a is an integer of 1 to 3.

Specifically, preferable examples include materials shown in Table 8 below, but the invention is not limited thereto.

| No. | Structural Formula |
|---|---|
| V-1 | $(MeO)_3Si—(CH_2)_2—Si(OMe)_3$ |
| V-2 | $(MeO)_2MeSi—(CH_2)_2—SiMe(OMe)_2$ |
| V-3 | $(MeO)_2MeSi—(CH_2)_6—SiMe(OMe)_2$ |
| V-4 | $(MeO)_3Si—(CH_2)_6—Si(OMe)_3$ |
| V-5 | $(EtO)_3Si—(CH_2)_6—Si(OEt)_3$ |
| V-6 | $(MeO)_2MeSi—(CH_2)_{10}—SiMe(OMe)_2$ |
| V-7 | $(MeO)_3Si—(CH_2)_3—NH—(CH_2)_3—Si(OMe)_3$ |
| V-8 | $(MeO)_3Si—(CH_2)_3—NH—(CH_2)_2—NH—(CH_2)_3—Si(OMe)_3$ |
| V-9 | 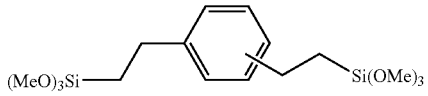 |
| V-10 | 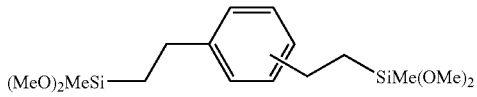 |

-continued

| No. | Structural Formula |
|---|---|
| V-11 | 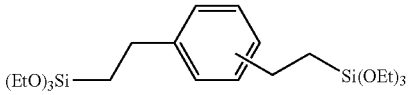 |
| V-12 | 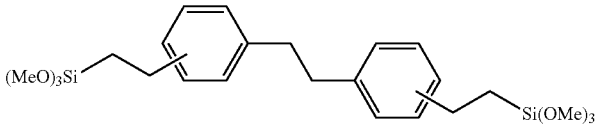 |
| V-13 | 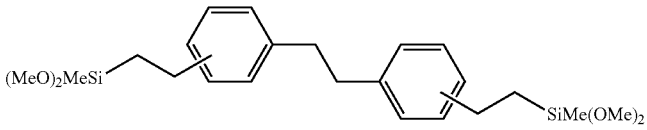 |
| V-14 | 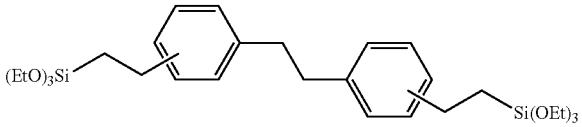 |
| V-15 | $(MeO)_3SiC_3H_6$—O—$CH_2CH\{$—O—$C_3H_6Si(OMe)_3\}$—$CH_2\{$—O—$C_3H_6Si(OMe)_3\}$ |
| V-16 | $(MeO)_3SiC_2H_4$—$SiMe_2$—O—$SiMe_2$—O—$SiMe_2$—$C_2H_4Si(OMe)_3$ |

For control of film characteristics, prolongation of liquid life, etc., a resin soluble in an alcohol- or ketone-based solvent can be added. Such resin includes polyvinyl butyral resin, polyvinyl formal resin, polyvinyl acetal resin such as partially acetalated polyvinyl acetal resin having a part of butyral modified with formal, acetoacetal or the like (for example, Esrek B, K etc. manufactured by Sekisui Chemical Co., Ltd.), polyamide resin, cellulose resin, phenol resin etc. Particularly, polyvinyl acetal resin is preferable from the viewpoint of electric characteristics.

For the purpose of discharging gas resistance, mechanical strength, scratch resistance, particle dispersibility, viscosity control, torque reduction, abrasion control and prolongation of pot life, etc., various resins can be added. A resin soluble in alcohol is preferably added particularly to the siloxane-based resin.

The resin soluble in an alcohol-based solvent includes polyvinyl butyral resin, polyvinyl formal resin, polyvinyl acetal resin such as partially acetalated polyvinyl acetal resin having a part of butyral modified with formal, acetoacetal or the like (for example, Esrek B, K etc. manufactured by Sekisui Chemical Co., Ltd.), polyamide resin, cellulose resin, phenol resin etc. Particularly, polyvinyl acetal resin is preferable from the viewpoint of electric characteristics.

The molecular weight of the resin is preferably 2000 to 100000, more preferably 5000 to 50000. When the molecular weight is less than 2000, the desired effect cannot be achieved, while when the molecular weigh is greater than 100000, the solubility is decreased, the amount of the resin added is limited, and coating defects are caused upon coating. The amount of the resin added is preferably 1 to 40 wt %, more preferably 1 to 30 wt %, most preferably 5 to 20 wt %. When the amount is less than 1 wt %, it is difficult to obtain the desired effect, while when the amount is greater than 40 wt %, image blurring may easily occur under high temperature and high humidity. These resins may be used alone or as a mixture thereof.

For prolongation of pot life, control of film characteristics, etc., a cyclic compound having a repeating structural unit represented by the following formula (VI), or a derivative of the compound, can also be contained.

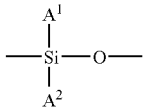

(VI)

In the formula (VI), $A^1$ and $A^2$ independently represent a monovalent organic group.

The cyclic compound having a repeating structural unit represented by the formula (VI) can include commercial cyclic siloxane. Specific examples thereof include cyclic siloxane, for example cyclic dimethyl cyclosiloxane such as hexamethyl cyclotrisiloxane, octamethyl cyclotetrasiloxane, decamethyl cyclopentasiloxane and dodecamethyl cyclohexasiloxane, cyclic methyl phenyl cyclosiloxane such as 1,3,5-trimethyl-1,3,5-triphenyl cyclotrisiloxane, 1,3,5,7-tetramethyl-1,3,5,7-tetraphenyl cyclotetrasiloxane, and 1,3,5,7,9-pentamethyl-1,3,5,7,9-pentaphenyl cyclopentasiloxane, cyclic phenyl cyclosiloxane such as hexaphenyl cyclotrisiloxane, fluorine-containing cyclosiloxane such as 3-(3,3,3-trifluoropropyl)methyl cyclotrisiloxane, a methyl hydroxy siloxane mixture, hydrosilyl group-containing cyclosiloxane such as pentamethyl cyclopentasiloxane and phenyl hydrocyclosiloxane, and vinyl group-containing cyclosiloxane such as pentavinyl pentamethyl cyclopentasiloxane. These cyclic siloxane compounds can be used alone or as a mixture thereof.

To improve the stain resistance and lubricating properties of the surface of the photoreceptor, various particles can also be added. Such particles can be used alone or two or more thereof can be used in combination. Examples of the particles include silicon-containing particles. The silicon-containing particles are particles containing silicon as a constituent element, and specifically, colloidal silica and silicone particles can be mentioned. The colloidal silica used as the silicon-containing particles is selected from acidic or alkaline aqueous dispersions having an average particle diameter of 1 to 100 nm, preferably 10 to 30 nm or those dispersed in an organic solvent such as alcohol, ketone or ester, and generally commercially available products can be used. The solids content of colloidal silica in the outermost surface includes, but is not limited to, 0.1 to 50 wt %, preferably 0.1 to 30 wt %, from the viewpoints of film formability, electric characteristics and strength.

The silicone particles used as the silicon-containing particles are selected from spherical silicone resin particles, silicone rubber particles or silicone surface-treated silica particles having an average particle diameter of 1 to 500 nm, preferably 10 to 100 nm, and generally commercially available products can be used. The silicone particles are chemically inert particles of small diameter excellent in dispersibility in resin, and the content of the silicone particles required for further achieving sufficient characteristics is low, so the surface state of the photoreceptor can be improved without inhibiting crosslinking reaction. That is, the silicone particles can incorporated uniformly into the rigid crosslinked structure and can simultaneously improve lubricating properties and water repellence on the surface of the photoreceptor and maintain excellent abrasion resistance and stain resistance for a long time. The content of the silicone particles in the outermost layer of the photoreceptor in the invention is in the range of 0.1 to 30 wt %, preferably in the range of 0.5 to 10 wt %, based on the total solids content of the outermost layer.

Other particles can include fluorine-containing particles such as ethylene tetrafluoride, ethylene trifluoride, propylene hexafluoride, vinyl fluoride, vinylidene fluoride etc., particles consisting of a resin produced by copolymerizing the fluorine resin with a monomer having a hydroxyl group, for example particles shown in "Preliminary Collection of Eighth Polymer Material Forum Lectures, p. 89" (in Japanese), and semi-electroconductive metal oxides such as $ZnO—Al_2O_3$, $SnO_2—Sb_2O_3$, $In_2O_3—SnO_2$, $ZnO—TiO_2$, $ZnO—TiO_2$, $MgO—Al_2O_3$, $FeO—TiO_2$, $TiO_2$, $SnO_2$, $In_2O_3$, ZnO and MgO.

For the same purpose, oil such as silicone oil can also be added. The silicone oil includes, for example, silicone oils such as dimethyl polysiloxane, diphenyl polysiloxane and phenyl methyl siloxane, and reactive silicone oils such as amino-modified polysiloxane, epoxy-modified polysiloxane, carboxyl-modified polysiloxane, carbinol-modified polysiloxane, methacryl-modified polysiloxane, mercapto-modified polysiloxane and phenol-modified polysiloxane.

The degree of exposure of the particles to the surface of the protective layer is preferably 40% or less. When the degree of exposure is higher than the above range, the influence of the particles themselves is increased, and image flow due to low resistance occurs easily. In the above range, the degree of exposure is more preferably 30 wt % or less, and the particles exposed to the surface are effectively refreshed with a cleaning member, and depression of toner component filming on the surface of the photoreceptor, removal of discharge products, and reduction in abrasion of a cleaning member due to torque reduction are maintained for a long period of time.

An additive such as plasticizer, a surface modifier, an antioxidant and a photo-deterioration inhibitor can also be used. The plasticizer includes, for example, biphenyl, biphenyl chloride, terphenyl, dibutyl phthalate, diethylene glycol phthalate, dioctyl phthalate, triphenyl phosphoric acid, methylnaphthalene, benzophenone, chlorinated paraffin, polypropylene, polystyrene and various fluorohydrocarbons.

An antioxidant having a hindered phenol, hindered amine, thioether or phosphite partial structure can be added to the protective layer, and is effective in improving potential stability and image qualities when the environment is changed. The antioxidant includes the following compounds, for example, hindered phenol antioxidants such as "Sumilizer BHT-R", "Sumilizer MDP-S", "Sumilizer BBM-S", "Sumilizer WX-R", "Sumilizer NW", "Sumilizer BP-76", "Sumilizer BP-101", "Sumilizer GA-80", "Sumilizer GM" and "Sumilizer GS", which are manufactured by Sumitomo Chemical Co., Ltd., "IRGANOX1010", "IRGANOX1035", "IRGANOX1076", "IRGANOX1098", "IRGANOX1135", "IRGANOX1141", "IRGANOX1222", "IRGANOX1330", "IRGANOX1425WL", "IRGANOX1520L", "IRGANOX245", "IRGANOX259", "IRGANOX3114", "IRGANOX3790", "IRGANOX5057" and "IRGANOX565", which are manufactured by Ciba Speciality Chemicals, "Adekastab AO-20", "Adekastab AO-30", "Adekastab AO-40", "Adekastab AO-50", "Adekastab AO-60", "Adekastab AO-70", "Adekastab AO-80" and "Adekastab AO-330", which are manufactured by Asahi Denka Co., Ltd., hindered amine antioxidants such as "Sanol LS2626", "Sanol LS765", "Sanol LS770", "Sanol LS744", "Tinubin 144", "Tinubin 622LD", "Mark LA57", "Mark LA67", "Mark LA62", "Mark LA68", "Mark LA63" and "Sumilizer TPS", thioether antioxidants such as "Sumilizer TP-D", phosphite antioxidants such as "Mark 2112", "Mark PEP•8", "Mark PEP•24G", "Mark PEP•36", "Mark 329K" and "Mark HP•10", and particularly hindered phenol or hindered amine antioxidants are preferable. These may be modified with substituent groups such as an alkoxysilyl group capable of crosslinking with a material forming a crosslinked film.

A catalyst is added or used in a coating solution used in forming the protective layer or at the time of preparing the coating solution. The catalyst used includes inorganic acids such as hydrochloric acid, acetic acid, phosphoric acid and sulfuric acid, organic acids such as formic acid, propionic acid, oxalic acid, p-toluenesulfonic acid, benzoic acid, phthalic acid and maleic acid, and alkali catalysts such as potassium hydroxide, sodium hydroxide, calcium hydroxide, ammonia and triethylamine, and the following insoluble solid catalysts may be used.

Examples of the insoluble solid catalysts include cation exchange resins such as Amberlite 15, Amberlite 200C and Amberlist 15E (manufactured by Rohm and Haas Company); Dow X MWC-1-H, Dow X 88 and Dow X HCR-W2 (manufactured by Dow Chemical Company); Levatit SPC-108 and Levatit SPC-118 (manufactured by Bayer AG); Diaion RCP-150H (manufactured by Mitsubishi Chemical Industries); Sumika Ion KC-470, Duolite C26-C, Duolite C-433 and Duolite-464 (manufactured by Sumitomo Chemical Co., Ltd.); and Naphion-H (manufactured by DuPont); anion exchange resins such as Amberlite IRA-400 and Amberlite IRA-45 (manufactured by Rohm and Haas Company); inorganic solids having groups containing protonic acid groups such as $Zr(O_3PCH_2CH_2SO_3H)_2$ and $Th(O_3PCH_2CH_2COOH)_2$ bound to the surface thereof; polyorganosiloxane containing protonic acid groups, such as polyorganosiloxane having sulfonic acid groups; heteropoly acids such as cobalt tungstic acid and phosphomolybdic acid; isopoly acids such as niobic acid, tantalic acid and molybdic acid; mono metal oxides such as silica gel, alumina, chromia, zirconia, CaO and MgO; composite metal oxides such as silica-alumina, silica-magnesia, silica-zirconia, and zeolite; clay minerals such as acidic clay, active clay, montmorilonite and kaolinite; metal sulfates such as $LiSO_4$ and $MgSO_4$; metal phosphates such as zirconia phosphate and lanthanum phosphate; metal nitrates such as $LiNO_3$ and $Mn(NO_3)_2$; inorganic solids having amino group-containing groups bound to the surface thereof, such as solids obtained by reacting aminopropyl triethoxy silane with silica gel; and polyorganosiloxane containing amino groups, such as amino-modified silicone resin.

It is preferable that a solid catalyst insoluble in a photofunctional compound, reaction products, water and solvent is used in preparing the coating solution, because the stability of the coating solution tends to be improved. The solid catalyst insoluble in the system is not particularly limited insofar as the catalyst component is a compound represented by the formula (I), (II), (III) or (V), or is insoluble in other additives, water, solvent etc. The amount of the solid catalyst used is not particularly limited and is preferably 0.1 to 100 parts by weight relative to 100 parts by weight of the total amount of compounds having a hydrolyzable group.

As described above, the solid catalyst is insoluble in the starting compounds, reaction products and solvent, and can thus be easily removed in an usual manner after the reaction. The reaction temperature and reaction time are selected suitably depending on the type and amount of the starting compounds and solid catalyst used, but usually the reaction temperature is 0 to 100° C., preferably 10 to 70° C., more preferably 15 to 50° C. and the reaction temperature is preferably 10 minutes to 100 hours. When the reaction time is longer than the upper limit mentioned above, gelation tends to occur easily.

When the catalyst insoluble in the system is used in preparing the coating solution, a catalyst dissolved in the system is preferably simultaneously used for the purpose of improving strength, liquid storage stability, etc. As the catalyst, it is possible to use, in addition to the above-mentioned catalysts, organoaluminum compounds such as aluminum triethylate, aluminum triisopropylate, aluminum tri(sec-butyrate), mono(sec-butoxy)aluminum diisopropylate, diisopropoxy aluminum(ethyl acetoacetate), aluminum tris(ethyl acetoacetate), aluminum bis(ethyl acetoacetate)monoacetyl acetonate, aluminum tris(acetyl acetonate), aluminum diisopropoxy(acetyl acetonate), aluminum isopropoxy-bis(acetyl acetonate), aluminum tris(trifluoroacetyl acetonate), aluminum tris (hexafluoroacetyl acetonate), etc.

In addition to the organoaluminum compounds, it is also possible to use organotin compounds such as dibutyltin dilaurate, dibutyltin dioctiate and dibutyltin diacetate; organotitanium compounds such as titanium tetrakis(acetyl acetonate), titanium bis(butoxy)bis(acetyl acetonate) and titanium bis (isopropoxy)bis(acetyl acetonate); and zirconium compounds such as zirconium tetrakis(acetyl acetonate), zirconium bis(butoxy)bis(acetyl acetoate) and zirconium bis (isopropoxy)bis(acetyl acetonate), but from the viewpoints of safety, low cost, and pot-life length, the organoaluminum compounds are preferably used, and particularly the aluminum chelate compounds are more preferable. The amount of these catalysts used is not particularly limited and is preferably 0.1 to 20 parts by weight, more preferably 0.3 to 10 parts by weight, relative to 100 parts by weight of the total amount of compounds having a hydrolyzable group.

When the organometallic compound is used as a catalyst, a multidentate ligand is preferably added from the viewpoints of pot life and curing efficiency. The multidentate ligand includes the following ligands and ligands derived therefrom, but the invention is not limited thereto.

Specific examples of the multidentate ligand include β-diketones such as acetyl acetone, trifluoroacetyl acetone, hexafluoroacetyl acetone and dipivaloyl methyl acetone; acetoacetates such as methyl acetoacetate and ethyl acetoacetate; bipyridine and derivatives thereof; glycine and derivatives thereof; ethylene diamine and derivatives thereof; 8-oxyquinoline and derivatives thereof; salicylaldehyde and derivatives thereof; catechol and derivatives thereof; bidentate ligands such as 2-oxyazo compounds; diethyl triamine and derivatives thereof; tridendate ligands such as nitrilotriacetic acid and derivatives thereof; and hexadentate ligands such as ethylenediaminetetraacetic acid (EDTA) and derivatives thereof. In addition to the organic ligands described above, inorganic ligands such as pyrophosphoric acid and triphosphoric acid can be mentioned. The multidentate ligand is particularly preferably a bidentate ligand, and specific examples thereof include bidentate ligands represented by the formula (VII) in addition to those described above. Among these ligands, the bidentate ligands represented by formula (VII) below are more preferable, and those of the formula (VII) wherein $R^5$ and $R^6$ are the same are particularly preferable. When $R^5$ is the same as $R^6$, the coordination strength of the ligand in the vicinity of room temperature can be increased to achieve further stabilization of the coating solution.

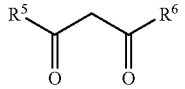

(VII)

In the formula (VII), $R^5$ and $R^6$ independently represent a C1 to C10 alkyl group, an alkyl fluoride group, or a C1 to C10 alkoxy group.

The amount of the multidentate ligand incorporated can be optionally selected, but it is preferable that the amount is 0.01 mole or more, preferably 0.1 mole or more, more preferably 1 mole or more, relative to 1 mole of the organometallic compound used.

Production of the coating solution can also be conducted in the absence of a solvent, but if necessary, various solvents may be used in addition to alcohols such as methanol, ethanol, propanol and butanol; ketones such as acetone and methyl ethyl ketone; tetrahydrofuran; and ethers such as diethyl ether and dioxane. Such solvents preferably have a boiling point of 100° C. or less and can be optionally mixed before use. The amount of the solvent can be optionally selected, but when the amount is too low, the organosilicon compound is easily precipitated, so it is preferable that the amount of the solvent is preferably 0.5 to 30 parts by weight, preferably 1 to 20 parts by weight, relative to 1 part by weight of the organosilicon compound.

The reaction temperature and reaction time for curing the coating solution are not particularly limited, but from the viewpoints of the mechanical strength and chemical stability of the resulting silicone resin, the reaction temperature is preferably 60° C. or more, more preferably 80 to 200° C., and the reaction time is preferably 10 minutes to 5 hours. To allow a protective layer obtained by curing the coating solution to be kept in a highly humid state is effective in improving the properties of the protective layer. Depending on applications, the protective layer can be hydrophobated by surface treatment with hexamethyl disilazane or trimethyl chlorosilane.

The resin layer having charge transportability and also containing a resin having a crosslinked structure has excellent mechanical strength and satisfactory photoelectric properties, and can thus be used directly as a charge transporting layer, in a photoreceptor of laminate type. In this case, an usual method such as blade coating, Meyer bar coating, spray coating, dipping coating, bead coating, air knife coating and curtain coating can be used. However, when necessary film thickness cannot be obtained by applying the coating solution once, the coating solution can be applied repeatedly to attain necessary film thickness. When the coating solution is applied repeatedly, heat treatment may be carried out after each application or after repeated application.

A photosensitive layer of single layer type is formed by incorporation of the charge generation material and a binder resin. The binder resin can be the same as that used in the charge generating layer and the charge transporting layer. The content of the charge generation material in the photosensitive layer of single layer type is about 10 to 85 wt %, preferably 20 to 50 wt %. For the purpose of improving photoelectric properties etc., the charge transport material and polymeric charge transport material may be added to the photosensitive layer of single layer type. The amount thereof is preferably 5 to 50 wt %. The compound represented by the formula (I) may also be added. As the solvent used in coating and the coating method, those described above can be used. The thickness of the coating is preferably about 5 to 50 μm, more preferably 10 to 40 μm.

Hereinafter, particularly preferable modes of the invention are listed. However, the invention is not necessarily limited to these modes.

(1) A toner for electrostatic image development, comprising a crystalline ester compound synthesized by polymerizing a carboxylic acid component with an alcohol component, a non-crystalline resin, a colorant and a releasing agent, wherein the weight-average molecular weight of the crystalline ester compound is about 5000 or less, and the number of carbon atoms in at least one component selected from the carboxylic acid component and the alcohol component is 10 or more.

(2) The toner for electrostatic image development of the above (1), wherein at least one component selected from the carboxylic acid component and the alcohol component contains a linear-chain structure having 10 or more carbon atoms in a main-chain moiety.

(3) The toner for electrostatic image development of the above (2), wherein the linear-chain structure is an alkylene group having 10 or more carbon atoms.

(4) The toner for electrostatic image development of the above (1), wherein the melting point of the toner is in the range of about 50 to 90° C., and satisfies the following equation (1):

$$0.9 \leqq Y/X \leqq 1.0 \quad (1)$$

wherein X represents the heat quantity (J/g) of the maximum endothermic peak of the toner for electrostatic image development after production, measured under heating from room temperature to 150° C. at an increasing temperature rate of 10° C./minute by a differential scanning calorimeter, and Y represents the heat quantity (J/g) of the maximum endothermic peak of the toner for electrostatic image development after making the measurement of the heat quantity X, measured under heating from 0° C. to 150° C. at an increasing temperature rate of 10° C./minute by a differential scanning calorimeter.

(5) The toner for electrostatic image development of the above (1), wherein the toner contains the releasing agent as a dispersion, and the average dispersion diameter of the releasing agent dispersed and contained therein is about 0.3 to 0.8 μm.

(6) The toner for electrostatic image development of the above (5), wherein the standard deviation of the dispersion diameter of the releasing agent is about 0.05 or less.

(7) The toner for electrostatic image development of the above (5), wherein the degree of exposure of the releasing agent at the surface of the toner is about 5 to 12 atom %.

(8) The toner for electrostatic image development of the above (1), wherein the content of the crystalline resin is about 1 to 10% relative to the weight of the toner.

(9) The toner for electrostatic image development of the above (8), wherein the toner contains a crystalline resin having a region in which the storage elastic modulus G' and loss elastic modulus G" are changed by 2 orders of magnitude or more for at least one difference in temperature range of 10° C. in the temperature range of 60 to 90° C.

(10) The toner for electrostatic image development of the above (8), wherein the number-average molecular weight (Mn) of the crystalline resin is about 2000 or more.

(11) The toner for electrostatic image development of the above (8), wherein the weight-average molecular weight (Mw) of the crystalline resin is about 5000 or more.

(12) The toner for electrostatic image development of the above (1), wherein the small particle diameter-side particle size distribution index (GSDp-under) of the toner is about 1.27 or less.

(13) The toner for electrostatic image development of the above (1), wherein the average circularity of the toner is about 0.94 to 0.99.

(14) The toner for electrostatic image development of the above (1), which is produced through a particle formation process of forming colored resin particles, comprising the crystalline ester compound, the non-crystalline resin, the colorant and the releasing agent, in water, an organic solvent or a mixed solvent thereof and a process of washing and drying the colored resin particles.

(15) The toner for electrostatic image development of the above (1), which is produced at least through forming aggregated particles in a dispersion comprising a mixture of a crystalline ester compound dispersion having the crystalline ester compound dispersed therein, the non-crystalline resin particle dispersion having the non-crystalline resin dispersed therein, a colorant dispersion having the colorant dispersed therein and a releasing agent dispersion having the releasing agent dispersed therein, and fusing the aggregated particles by heating the dispersion having the aggregated particles formed therein, to a temperature not lower than the glass transition temperature of the non-crystalline resin.

(16) An electrostatic image developer comprising a toner containing a crystalline ester compound synthesized by polymerizing a carboxylic acid component with an alcohol component, a non-crystalline resin, a colorant and a releasing agent, wherein the weight-average molecular weight of the crystalline ester compound is about 5000 or less, and the number of carbon atoms in at least one component selected from the carboxylic acid component and the alcohol component is 10 or more.

(17) The electrostatic image developer of the above (16), which comprises the toner and a carrier, wherein the carrier has a core material and a resin layer covering the core material.

(18) An image forming method comprising: forming an electrostatic latent image on the surface of a latent image carrier, developing the electrostatic latent image with a toner-containing developer to form a toner image, transferring the toner image onto a recording medium, and fixing the toner image on the recording medium, wherein the toner comprises a crystalline ester compound synthesized by polymerizing a carboxylic acid component with an alcohol component, a non-crystalline resin, a colorant and a releasing agent, the weight-average molecular weight of the crystalline ester compound is about 5000 or less, and the number of carbon atoms in at least one component selected from the carboxylic acid component and the alcohol component is 10 or more.

(19) The image forming method of the above (18), wherein the layer constituting the outermost surface of the latent image carrier comprises a siloxane resin having a crosslinked structure.

(20) The image forming method of the above (18), which comprises cleaning and recovering residual toner remaining on the surface of the latent image carrier after the transfer, and a toner recycling where the residual toner recovered in the cleaning is re-utilized as the developer.

EXAMPLES

Hereinafter, the present invention is described in more detail by reference to the Examples. In the following description, "parts" means "parts by weight".

<Preparation of a Developer for Electrostatic Image Development>

-Preparation of Non-crystalline Polyester Resin (1)/Non-crystalline Resin Particle Dispersion (1a)-

A two-necked flask dried by heating is charged with 35 mol parts of polyoxyethylene (2,0)-2,2-bis(4-hydroxyphenyl) propane, 65 mol parts of polyoxypropylene (2,2)-2,2-bis(4-hydroxyphenyl)propane, 80 mol parts of terephthalic acid, 15 mol parts of n-dodecenyl succinic acid, 10 mol parts of trimellitic acid, and dibutyltin oxide in an amount of 0.05 mol part relative to these acid components (number of moles in total of the terephthalic acid, n-dodecenyl succinic acid and trimellitic acid), and after a nitrogen gas is introduced into the container, the mixture is heated in the inert atmosphere and subjected to condensation polymerization at 150 to 230° C. for about 12 hours and then gradually depressurized at 210 to 250° C. to synthesize non-crystalline polyester resin (1).

By measurement (expressed by polystyrene) of molecular weight by GPC (gel permeation chromatography), the weight-average molecular weight (Mw) of the resulting non-crystalline polyester resin (1) is 15000, and the number-average molecular weight (Mn) is 6800.

Molecular-weight measurement is conducted in the following manner. An experiment in GPC makes use of "HLC-8120GPC, SC-8020 (Tosoh Corporation) unit", two columns "TSKgel, Super HM-H (6.0 mm ID×15 cm, manufactured by Tosoh Corporation)" and THF (tetrahydrofuran) as an eluent. The experiment conditions are as follows: the sample concentration is 0.5%, the flow rate is 0.6 ml/min., the volume of a sample injected is 10 μl, the measurement temperature is 40° C., and an IR detector is used in the experiment. A calibration curve is prepared from 10 samples of "polystyrene standard sample TSK standard" manufactured by Tosoh Corporation, that is, A-500, F-1, F-10, F-80, F-380, A-2500, F-4, F-40, F-128 and F-700.

When the non-crystalline polyester resin (1) is measured with a differential scanning calorimeter (DSC), no definite peak is shown, and a stepwise endothermic change is observed. A glass transition point in the center of the stepwise endothermic change is 62° C.

An emulsifying tank in a high-temperature/high pressure emulsifier (Cabitron CD1010, slit 0.4 mm) is charged with 3000 parts of the resulting non-crystalline polyester resin (1), 10000 parts of water and 90 parts of surfactant, sodium dodecyl benzene sulfonate, and the mixture is melted by heating at 130° C., dispersed at 110° C. in a flow rate of 3 L/m at 10000 rpm for 30 minutes and passed through a cooling tank to recover a non-crystalline resin particle dispersion (high temperature/high pressure emulsifier (Cabitron CD1010, slit 0.4 mm)), and thus, a non-crystalline resin particle dispersion (1a) is obtained.

When the particles contained in the resulting non-crystalline resin particle dispersion (1a) are measured with a laser diffraction particle size measuring instrument (SALD2000A, manufactured by Shimadzu Corporation), the volume average particle diameter $D_{50v}$ is 0.3 μm and the standard deviation is 1.2.

-Preparation of Non-crystalline Polyester Resin (2)/Non-crystalline Resin Particle Dispersion (2a)-

A non-crystalline polyester resin (2) is prepared under the same conditions as for the non-crystalline polyester resin (1) except that the amount of n-dodecenyl succinic acid is changed into 30 mol parts, and a non-crystalline resin particle dispersion (2a) is prepared under the same conditions as for the non-crystalline resin particle dispersion (1a).

The weight-average molecular weight (Mw) of the resulting non-crystalline polyester resin (2) is 12000, the number-average molecular weight (Mn) is 6000, and the glass transition point is 56° C. The volume-average particle diameter $D_{50v}$ contained in the resulting resin particle dispersion is 0.35 μm, and the standard deviation is 1.4.

-Preparation of Crystalline Ester Compound (3)/Crystalline Ester Compound Particle Dispersion (3a)-

A three-necked flask dried by heating is charged with 293 parts by weight of 1,4-butane diol (manufactured by Wako Pure Chemical Industries, Ltd.), 750 parts by weight of dodecane dicarboxylic acid (manufactured by Wako Pure Chemical Industries, Ltd.) and 0.3 part by weight of a catalyst, dibutyltin oxide, and after the air in the container is replaced by a nitrogen gas through depressurization, the mixture is stirred in the inert atmosphere under mechanical stirring at 180° C. for 2 hours. Thereafter, the mixture is gradually heated to 200° C. and stirred for 2 hours, and when the mixture has become viscous, it is air-cooled to terminate the reaction, whereby crystalline ester compound (3) is synthesized.

By measurement (expressed by polystyrene) of the molecular weight by gel permeation chromatography (GPC), the weight-average molecular weight of the resulting crystalline ester compound (3) is 3500.

When the melting point (Tm) of the crystalline ester compound (3) is measured with a differential scanning calorimeter (DSC) by the above-mentioned measurement method, a clear peak appears and the temperature of a peak top is 69° C.

A crystalline ester compound particle dispersion (3a) is prepared under the same conditions as for the resin particle dispersion (1a) except that the crystalline ester compound (3) is used. The volume average particle diameter $D_{50v}$ of the particles contained in the resulting dispersion is 0.25 μm and the standard deviation thereof is 1.3.

-Preparation of Crystalline Ester Compound (4)/Crystalline Ester Compound Particle Dispersion (4a)-

A crystalline ester compound (4) having a weight-average molecular weight of 5000 is obtained by reaction at 180° C. for 5 hours and subsequent reaction under reduced pressure at 200° C. for 2 hours under the same conditions as for the crystalline ester compound (3) except that tetradecane dicarboxylic acid (manufactured by Wako Pure Chemical Industries, Ltd.) is used in place of dodecane dicarboxylic acid.

When the melting point (Tm) of the crystalline ester compound (4) is measured with a differential scanning calorimeter (DSC) by the above-mentioned measurement method, a clear peak appears and the temperature of a peak top is 70° C.

A crystalline ester compound particle dispersion (4a) is prepared under the same conditions as for the resin particle dispersion (1a) except that the crystalline ester compound (4) is used. The volume average particle diameter $D_{50v}$ of the resulting dispersion is 0.2 μm and the standard deviation thereof is 1.2.

-Preparation of Crystalline Ester Compound (5)/Crystalline Ester Particle Dispersion (5a)-

A three-necked flask dried by heating is charged with 483.2 parts by weight of 1,10-decane diol, 550 parts by weight of octadecane dicarboxylic acid (manufactured by Wako Pure Chemical Industries, Ltd.) and 0.3 part by weight of a catalyst, dibutyltin oxide, and after the air in the container is replaced by a nitrogen gas through depressurization, the mixture is stirred in the inert atmosphere under mechanical stirring at 180° C. for 2 hours. Thereafter, the mixture is gradually heated to 200° C. and stirred for 2 hours, and when the mixture has become viscous, it is air-cooled to terminate the reaction, whereby crystalline ester compound (5) is synthesized.

By measurement (expressed by polystyrene) of the molecular weight by gel permeation chromatography (GPC), the weight-average molecular weight of the resulting crystalline ester compound (5) is 4200.

When the melting point (Tm) of the crystalline ester compound (5) is measured with a differential scanning calorimeter (DSC) by the above-mentioned measurement method, a clear peak appears and the temperature of a peak top is 80° C.

A crystalline ester compound particle dispersion (5a) is prepared under the same conditions as for the resin particle dispersion (1a) except that the crystalline ester compound (5) is used. The volume average particle diameter $D_{50v}$ of the particles contained in the resulting dispersion is 0.28 μm and the standard deviation thereof is 1.3.

-Preparation of Non-crystalline Resin Particle Dispersion (6a)-

| | |
|---|---|
| Styrene (Wako Pure Chemical Industries, Ltd): | 73 parts |
| Butyl acrylate (Wako Pure Chemical Industries, Ltd): | 27 parts |
| Dodecyl mercaptan (Wako Pure Chemical Industries, Ltd): | 2.0 parts |
| β-Carboxyethyl acrylate (Rhodia Japan): | 2 parts |
| Decanediol diacrylate (Shin-Nakamura Chemical Co., Ltd.): | 0.5 part |

A solution wherein the above components are mixed and dissolved is prepared.

A solution of 1 part of a nonionic surfactant (NONION P-213, manufactured by NOF CORPORATION) and 1 part of an anionic surfactant (NEWLEX R, manufactured by NOF CORPORATION) in 120 parts of water is prepared, and the above solution is added thereto and dispersed in a flask and emulsified, and then a solution of 1.2 parts of ammonium persulfate (manufactured by Wako Pure Chemical Industries, Ltd.) in 50 parts of water is introduced thereto under gentle stirring for 10 minutes.

Then, the atmosphere in the system is replaced by nitrogen, and the mixture is heated to 70° C. under stirring in the flask on an oil bath, and emulsion polymerization is continued as such for 6 hours.

Thereafter, this reaction solution is cooled to room temperature to give a non-crystalline resin particle dispersion (6a) having a volume-average particle diameter $D_{50v}$ of 0.25 μm and a standard deviation of 1.3. Apart of the non-crystalline resin particle dispersion (6a) is left on an oven at 80° C. to remove water, and when the resulting residues are measured for their physical properties, the weight-average molecular weight Mw of the residues is 40000, and the glass transition temperature Tg is 52° C.

-Preparation of Crystalline Ester Compound (7)/Crystalline Ester Particle Dispersion (7a)-

A crystalline ester compound (7) is synthesized under the same conditions as for the crystalline ester compound (3) except that 430.0 parts by weight of sebacic acid, 130.5 parts by weight of 1,6-hexane diol and 0.2 part by weight of dibutyltin oxide are used. The weight-average molecular weight of the crystalline ester compound (7) obtained is 4800. By measurement with a differential scanning calorimeter (DSC), a clear peak appears and the temperature of a peak top is 60° C.

A crystalline ester particle dispersion (7a) is prepared under the same conditions as for the non-crystalline resin particle dispersion (1a). The volume average particle diameter $D_{50v}$ of the particles contained in the resulting dispersion is 0.29 μm and the standard deviation thereof is 1.4.

-Preparation of Crystalline Resin (8)/Crystalline Resin Particle Dispersion (8a)-

A crystalline resin (8) is synthesized under the same conditions as for the crystalline ester compound (3) except that the reaction temperature and time under reduced pressure are changed into 230° C. and 3 hours respectively. The weight-average molecular weight thereof is 5300. By measurement with a differential scanning calorimeter (DSC), a clear peak appears and the temperature of a peak top is 68° C.

A crystalline resin particle dispersion (8a) is prepared under the same conditions as for the non-crystalline resin particle dispersion (1a). The volume average particle diameter $D_{50v}$ of the particles contained in the resulting dispersion is 0.27 μm and the standard deviation thereof is 1.3.

-Preparation of Crystalline Resin (9)/Crystalline Resin Particle Dispersion (9a)-

A crystalline resin (9) is synthesized under the same conditions as for the crystalline ester compound (3) except that the reaction temperature and time under reduced pressure are changed into 230° C. and 10 hours respectively. The weight-average molecular weight thereof is 21000. By measurement with a differential scanning calorimeter (DSC), a clear peak appears and the temperature of a peak top is 70° C.

A crystalline resin particle dispersion (9a) is prepared under the same conditions as for the non-crystalline resin particle dispersion (1a). The volume average particle diameter $D_{50v}$ of the particles contained in the resulting dispersion is 0.25 μm and the standard deviation thereof is 1.3.

-Preparation of Colorant Dispersion (1)-

| | |
|---|---|
| Phthalocyanine pigment (PVFASTBLUE, Dainipponseika Color & Chemicals Mfg. Co., Ltd.): | 25 parts |
| Anionic surfactant (NEOGEN RK, DAI-ICHI KOGYO SEIYAKU CO., LTD.): | 2 parts |
| Water: | 125 parts |

The above ingredients are mixed, dissolved and dispersed by a homogenizer (ULTRATAX, manufactured by IKA Co., Ltd.) and then dispersed by a pressure discharging homogenizer to give a releasing agent dispersion (1).

| | |
|---|---|
| Pentaerythritol behenic acid tetraester wax: | 100 parts |
| Anionic surfactant (NEWLEX R, NOF CORPORATION): | 2 parts |
| Water: | 300 parts |

The above ingredients are mixed, dissolved and dispersed by a homogenizer (ULTRATAX, manufactured by IKA Co., Ltd.) and then dispersed by a pressure discharging homogenizer to give a releasing agent dispersion (1).

(Production of Developer (1))

-Preparation of Toner Matrix Particle (1)-

| | |
|---|---|
| Non-crystalline resin particle dispersion (1a): | 145 parts |
| Crystalline ester compound particle dispersion (5a): | 30 parts |
| Colorant dispersion (1): | 42 parts |
| Releasing agent particle dispersion (1): | 36 parts |
| Aluminum sulfate (Wako Pure Chemical Industries, Ltd.): | 0.5 part |
| Water: | 300 parts |

The above ingredients are placed in a round stainless steel flask, adjusted to pH 2.7, dispersed with a homogenizer (ULTRATAX T50, manufactured by IKA Co., Ltd.) and heated to 45° C. under stirring in a heating oil bath. When the mixture is kept at 48° C. for 120 minutes and then observed under an optical microscope, formation of aggregated particles having an average particle diameter of about 5.6 μm is confirmed.

After this dispersion is further heated under stirring for 30 minutes at 48° C., it is confirmed by observation under an optical microscope that aggregated particles having an average particle diameter of about 6.5 μm is formed. The pH of the aggregated particle dispersion is 3.2.

Subsequently, 1 N aqueous sodium hydroxide is gently added thereto to adjust the dispersion to pH 8.5, and then the dispersion is heated at 90° C. under stirring for 3 hours. Thereafter, the reaction product is filtered off, washed sufficiently with water and dried with a vacuum dryer to give a toner matrix particle (1).

The volume average particle diameter $D_{50v}$ of the resulting toner matrix particles is 6.5 μm. 1 part of colloidal silica (R972, manufactured by NIPPON AEROSIL CO., LTD.) is mixed with, and externally added to, 100 parts of the toner particles in a Henschel mixer to give an electrostatic image development toner (1).

Separately, 100 parts of ferrite particles (average particle diameter 50 μm, manufactured by Powder-Tech Associate, Inc.) and 2.5 parts of polymethylmethacrylate resin (weight-average molecular weight 95000, manufactured by MITSUBISHI RAYON CO., LTD.) together with 500 parts of toluene are introduced into a pressurizing kneader, mixed under stirring at room temperature for 15 minutes, then mixed under reduced pressure and simultaneously heated to 70° C., to distill toluene off, then cooled, classified through a screen having an opening of 105 μm, whereby a ferrite carrier (resin-coated carrier) is prepared. This ferrite carrier is mixed with the toner for the electrostatic image development (1) to prepare a two-component developer (1) with a toner concentration of 7 wt %.

(Production of Developer (2))

A toner matrix particle (2) is obtained under the same conditions as for the toner matrix particle (1) except that the crystalline ester compound particle dispersion (4a) is used in place of the crystalline ester compound particle dispersion (5a).

The volume average particle diameter $D_{50v}$ of the resulting toner matrix particles is 6.3 μm. Subsequently, a developer (2) is prepared by mixing with the external additive and mixing with the carrier in the same manner as for the developer (1).

(Production of Developer (3))

A toner matrix particle (3) is obtained under the same conditions as for the toner matrix particle (1) except that the crystalline ester compound particle dispersion (3a) is used in place of the crystalline ester compound particle dispersion (5a).

The volume average particle diameter $D_{50v}$ of the resulting toner matrix particles is 6.4 μm. Subsequently, a developer (3) is prepared by mixing with the external additive and mixing with the carrier in the same manner as for the developer (1).

(Production of Developer (4))

A toner matrix particle (4) is obtained under the same conditions as for the toner matrix particle (1) except that the non-crystalline resin particle dispersion (2a) is used in place of the non-crystalline resin particle dispersion (1a).

The volume average particle diameter $D_{50v}$ of the resulting toner matrix particles is 5.9 μm. Subsequently, a developer (4) is prepared by mixing with the external additive and mixing with the carrier in the same manner as for the developer (1).

(Production of Developer (5))

-Preparation of Toner Matrix Particle (5)-

A toner matrix particle (5) is obtained under the same conditions as for the toner matrix particle (1) except that the crystalline ester compound particle dispersion (7a) is used. Subsequently, a developer (5) is prepared by mixing with the external additive and mixing with the carrier in the same manner as for the developer (1).

(Production of Developer (6))

-Preparation of Toner Matrix Particle (6)-

A toner matrix particle (6) is obtained under the same conditions as for the toner matrix particle (1) except that the crystalline resin particle dispersion (9a) is used. Subsequently, a developer (6) is prepared by mixing with the external additive and mixing with the carrier in the same manner as for the developer (1).

(Production of Developer (7))

-Preparation of Toner Matrix Particle (7)-

A toner matrix particle (7) is obtained under the same conditions as for the toner matrix particle (1) except that the crystalline resin particle dispersion (8a) is used. Subsequently, a developer (7) is prepared by mixing with the external additive and mixing with the carrier in the same manner as for the developer (1).

(Production of Developer (8))

-Preparation of Toner Matrix Particle (8)-

| | |
|---|---|
| Non-crystalline resin particle dispersion (1a): | 145 parts |
| Colorant dispersion (1): | 42 parts |
| Releasing agent particle dispersion (1): | 36 parts |
| Aluminum sulfate (Wako Pure Chemical Industries, Ltd.): | 0.5 part |
| Water: | 300 parts |

A developer (8) is prepared under the same conditions as for the developer (1) except that the starting dispersion used in the aggregating process is changed to the composition shown above. The volume average particle diameter $D_{50v}$ of the resulting toner matrix particles is 5.5 μm.

(Production of Developer (9))

| | |
|---|---|
| Polyester resin (linear polyester having a glass transition temperature, Tg of 59° C., a weight-average molecular weight Mn of 3500 and a number-average molecular weight Mw of 20000, obtained from a terephthalic acid-bisphenol A ethylene oxide adduct-cyclohexane dimethanol): | 100 parts |
| Phthalocyanine pigment (PVFASTBLUE, manufactured by Dainichiseika Color & Chemicals Mfg. Co., Ltd.): | 25 parts |
| Carnauba wax (melting point 80° C., manufactured by TOAKASEI CO., LTD.): | 5 parts |

The above mixture is kneaded in an extruder, milled with a jet mill and classified with an air classifier to give a toner matrix particle (9) having a volume-average particle diameter $D_{50v}$ of 10.3 μm. Subsequently, a developer (9) is obtained by mixing with the external additive and mixing with the carrier in the same manner as for the developer (1).

-Preparation of a Photoreceptor- (Photoreceptor 1)

A cylindrical Al substrate is polished with a center-less polishing apparatus such that the surface roughness Rz comes to be 0.6 μm. In a cleaning process, this cylinder is degreased, then etched for 1 minute in 2 wt % aqueous sodium hydroxide, neutralized and washed with purified water. In anodizing treatment, an anodized film (current density 1.0 A/dm$^2$) is formed on the surface of the cylinder by 10 wt % sulfuric acid solution. After washing with water, the anodized film is subjected to pore sealing by dipping in 1 wt % nickel acetate solution at 80° C. for 20 minutes. Then, the substrate is washed with purified water and dried. In this manner, 7 μm anodized film is formed on the surface of the aluminum cylinder.

1 part of titanyl phthalocyanine having a strong diffraction peak at a Bragg angle (2θ±0.2°) of 27.2° in an X-ray diffraction spectrum is mixed with 1 part of polyvinyl butyral (SEREK BM-S, manufactured by SEKISUI CHEMICAL CO., LTD.) and 100 parts of n-butyl acetate and dispersed together with glass beads in a paint shaker for 1 hour, and the resulting coating solution is applied by dipping coating on the undercoat layer on the aluminum substrate described above and dried by heating at 100° C. for 10 minutes to form a charge generating layer of about 0.15 μm in thickness.

Then, a coating solution prepared by dissolving 2 parts of a benzidine compound having the following structure (compound 1 below) and 2.5 parts of a polymer compound (compound 2 below, a viscosity average molecular weight of 39,000) in 20 parts of chlorobenzene is applied by dipping coating on the charge generating layer and heated at 110° C. for 40 minutes to form a charge transporting layer of 20 μm in thickness, whereby a photoreceptor 1 is obtained.

Compound 1

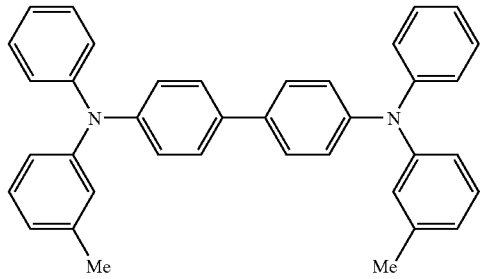

Compound 2

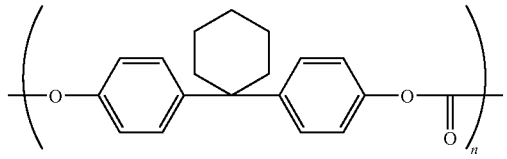

(Photoreceptor 2)

5 parts of methyl alcohol and 0.5 part of ion-exchange resin (AMBERLIST 15E) are added to the constituent materials shown below and stirred at room temperature on the photoreceptor 1, whereby exchange reaction of protective groups is carried out for 24 hours.

-Constituent Materials-

| | |
|---|---|
| Compound 3 below: | 2 parts |
| Methyl trimethoxy silane: | 2 parts |
| Tetraethoxy silane: | 0.5 part |
| Colloidal silica: | 0.4 part |
| $Me(MeO)_2Si—(CH_2)_4—SiMe(OMe)_2$: | 0.5 part |
| (Heptadecafluoro-1,1,2,2-tetrahydrodecyl)methyl dimethoxy silane: | 0.1 part |
| Hexamethyl cyclotrisiloxane: | 0.3 part |

-continued

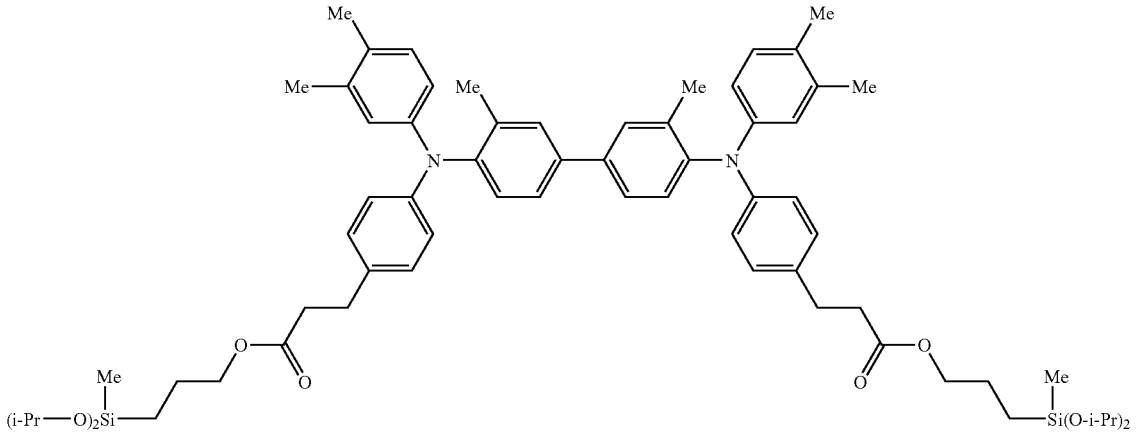

Compound 3

Thereafter, 10 parts of n-butanol and 0.3 part of distilled water are added thereto to carry out hydrolysis for 15 minutes.

After hydrolysis, the ion-exchange resin is separated by filtration to give a filtrate to which 0.1 part of aluminum trisacetyl acetonate (Al (aqaq) 3), 0.1 part of acetyl acetone, 0.4 part of 3,5-di-t-butyl-4-hydroxy toluene (BHT) and 0.5 part of ESREK BX-L (manufactured by SEKISUI CHEMICAL CO., LTD.) are then added, and the resulting coating solution is applied by a ring-type dipping coating method onto the above charge transporting layer, air-dried at room temperature for 30 minutes, and cured by heating treatment at 170° C. for 1 hour to give a surface layer of about 3 μm in thickness, whereby a photoreceptor 2 is obtained.

-Evaluation-

Using a modified apparatus (equipped with a cleaning blade as a means of cleaning the photoreceptor and having a recycle system returning a toner in a recovery box to the inside of a developing device) of Printer DOCUCENTRE Color 400CP manufactured by Fuji Xerox Co., Ltd., the photoreceptor and the developer are combined as shown in Table 9 and used in a test of forming images on 5000 sheets in a high-temperature and high-humidity (28° C., 85% RH) environment and then in a test of forming images on 5000 sheets in a low-temperature and low-humidity (10° C., 15% RH) environment, to evaluate low-temperature fixability, image gloss, toner strength, transferability, image durability, and photoreceptor surface defect. The results are shown in Table 10.

In only Example 4, a recycle system is actuated to carry out a test of forming images on 100000 sheets in a low-temperature and low-humidity (10° C./humidity 10%) environment, and the presence or absence of filming on the photoreceptor after the test is visually checked through a 50-power magnifying glass in order to confirm the recycle system.

TABLE 9

| | | | Crystalline ester compound or crystalline resin | | | | |
|---|---|---|---|---|---|---|---|
| | Developer No. | Photoreceptor No. | Type | Weight-average molecular weight Mw | Number of carbon atoms in carboxylic acid component (main-chain structure) | Number of carbon atoms in alcohol component (main-chain structure) | Volume-average particle diameter (μm) |
| Example 1 | Developer 1 | Photoreceptor 1 | Crystalline ester compound 5 | 4200 | 16 (linear alkyl) | 10 (linear alkyl) | 6.2 |
| Example 2 | Developer 2 | Photoreceptor 1 | Crystalline ester compound 4 | 5000 | 12 (linear alkyl) | 4 (linear alkyl) | 5.8 |
| Example 3 | Developer 3 | Photoreceptor 1 | Crystalline ester compound 3 | 3500 | 10 (linear alkyl) | 4 (linear alkyl) | 6.0 |
| Example 4 | Developer 4 | Photoreceptor 2 | Crystalline ester compound 5 | 4200 | 16 (linear alkyl) | 10 (linear alkyl) | 5.7 |
| Comparative Example 1 | Developer 5 | Photoreceptor 1 | Crystalline ester compound 7 | 4800 | 8 (linear alkyl) | 6 (linear alkyl) | 6.4 |
| Comparative Example 2 | Developer 6 | Photoreceptor 1 | Crystalline resin 9 | 21000 | 10 (linear alkyl) | 4 (linear alkyl) | 7.0 |
| Comparative Example 3 | Developer 7 | Photoreceptor 1 | Crystalline resin 8 | 5300 | 10 (linear alkyl) | 4 (linear alkyl) | 5.9 |

TABLE 9-continued

| | | | | | | | |
|---|---|---|---|---|---|---|---|
| Comparative Example 4 | Developer 8 | Photoreceptor 1 | — | — | — | — | 5.5 |
| Comparative Example 5 | Developer 9 | Photoreceptor 1 | — | — | — | — | 10.3 |

| | Particle size distribution index (GSDv/GSDp) | Average circularity | Dispersed state of releasing agent in toner: Average dispersion diameter (μm) | Standard deviation | Degree of exposure of releasing agent to the surface of toner | Ratio of heat quantity at endothermic peak (Y/X) |
|---|---|---|---|---|---|---|
| Example 1 | 1.21/1.23 | 0.962 | 0.25 | 0.03 | 6 | 0.92 |
| Example 2 | 1.21/1.24 | 0.965 | 0.51 | 0.04 | 10 | 0.92 |
| Example 3 | 1.20/1.22 | 0.96 | 0.37 | 0.03 | 7 | 0.94 |
| Example 4 | 1.22/1.24 | 0.965 | 0.74 | 0.05 | 14 | 0.98 |
| Comparative Example 1 | 1.22/1.25 | 0.962 | 0.8 | 0.18 | 20 | 0.8 |
| Comparative Example 2 | 1.24/1.25 | 0.965 | 0.82 | 0.19 | 19 | 0.78 |
| Comparative Example 3 | 1.23/1.22 | 0.970 | 0.85 | 0.12 | 13 | 0.98 |
| Comparative Example 4 | 1.32/1.35 | 0.945 | 0.8 | 0.20 | 18 | — |
| Comparative Example 5 | 1.35/1.40 | 0.935 | 1 | 0.3 | 21 | — |

TABLE 10

| | | | Evaluation results: Low-temperature fixability | Image gloss | Toner strength |
|---|---|---|---|---|---|
| | Developer No. | Photoreceptor No. | | | |
| Example 1 | Developer 1 | Photoreceptor 1 | A | AA | A |
| Example 2 | Developer 2 | Photoreceptor 1 | A | A | A |
| Example 3 | Developer 3 | Photoreceptor 1 | A | A | A |
| Example 4 | Developer 4 | Photoreceptor 2 | A | A | A |
| Comparative Example 1 | Developer 5 | Photoreceptor 1 | A | A | C |
| Comparative Example 2 | Developer 6 | Photoreceptor 1 | A | A | C |
| Comparative Example 3 | Developer 7 | Photoreceptor 1 | A | A | B |
| Comparative Example 4 | Developer 8 | Photoreceptor 1 | C | C | A |
| Comparative Example 5 | Developer 9 | Photoreceptor 1 | C | C | A |

| | Evaluation results: Embedment of external additive | Transfer-ability | Image durability | Charging maintenance (high-temperature and high-humidity) | Evaluation of filming upon actuation of recycle system |
|---|---|---|---|---|---|
| Example 1 | A | A | A | A | — |
| Example 2 | A | A | A | A | — |
| Example 3 | B | A | A | B | — |
| Example 4 | A | A | A | A | A |
| Comparative Example 1 | C | B to C (500 sheets and thereafter: C) | C | C | — |
| Comparative Example 2 | C | C | C | C | — |
| Comparative Example 3 | B | B | B | B | — |
| Comparative Example 4 | C | B (initially A; 1000 sheets and thereafter, C) | A | A | — |
| Comparative Example 5 | C | C | A | C (lower charging than initial) | — |

Evaluation methods and evaluation criteria in the evaluation items shown in Table 10 are as follows:

-Low-temperature Fixability-

In evaluation of low-temperature fixability, regulation of the temperature in a fixation apparatus is carried out with an external power source before the image forming test, and fixation is conducted at a fixation temperature at 5-degree intervals in the range of 100 to 130° C., and an image is formed such that the reflective density of the resulting image becomes constant (density of 1.5 to 1.8 on paper C2 (manufactured by Fuji Xerox) determined with an X-Rite 404 densitometer), and defects on the image upon bending of the image are determined by sensory evaluation.

A: Excellent (fixed at 110° C. or less)

C: Practically not durable level with many image defects (fixed at 115° C. or more)

-Image Gloss-

In evaluation of image gloss, regulation of the temperature in a fixation apparatus is carried out with an external power source before the image forming test, and fixation is conducted at a set fixation temperature of 140° C., and an image is formed such that the reflective density of the image becomes constant (density of 1.5 to 1.8 on paper MC256 as determined with an X-Rite 404 densitometer), and gloss at 60° is evaluated with a Mirror Trigloss gloss meter (manufactured by Gardner) and evaluated under the following criteria.

AA: Very excellent (equal to or higher than paper, gloss ratio of 95% or more relative to paper)

A: Excellent (gloss ratio of 60 to 94% relative to paper)

C: Practically not durable level with many image defects (gloss ratio of 59% or less relative to paper)

-Toner Strength-

In evaluation of toner strength, the developer is collected after the image forming test under high-temperature and high-humidity and low-temperature and low-humidity environments, and the shape of the toner particles and the occurrence of breakage are observed under a scanning electron microscope (SEM) and sensorily evaluated by comparison with those of the unused toner particles. The evaluation criteria are as follows:

A: There is no change or breakage (number of particles: 3% or less) as compared with the unused toner particles.

B: Toner cracking and deformation are recognized (number of particles: 3 to 20%) as compared with the unused toner particles.

C: Toner cracking and deformation are recognized (number of particles: 20% or more) as compared with the unused toner particles.

-Embedment of External Additive-

In evaluation of embedment of the external additive, the developer is collected after the image forming test at high-temperature high-humidity and low-temperature low-humidity environments, and the state of particles of the external additive added to the surfaces of the toner particles is sensorily evaluated under a scanning electron microscope (SEM) as compared with the unused toner particles. The evaluation criteria are as follows:

A: Embedment of particles of the external additive in the surfaces of the toner particles is hardly recognized as compared with the unused toner particles.

B: Particles of the external additive are embedded in a certain degree in the surfaces of the toner particles as compared with the unused toner particles.

C: Particles of the external additive are significantly embedded in the surfaces of the toner particles as compared with the unused toner particles.

-Transferability-

Transferability is evaluated by collecting non-transfer samples from 500 sheets (first 500 sheets after the test is initiated) and then per 1000 sheets (subsequent 1000 sheets), and measuring the weight of residual toners on the photoreceptor.

A: Excellent.

B: Lowered significantly after 1000 sheets.

C: Lowered in an early stage.

-Image Durability-

In evaluation of image durability, an image is collected before the test such that the reflective density of the image becomes constant (density of 1.5 to 1.8 by an X-Rite 404 densitometer), and image defects are determined by sensory evaluation under a vertical loading of 200 g at a needle transfer rate of 1500 mm/min. in an image scratching test (HEIDON Type: 14 DR (surface property tester)). Evaluation criteria are as follows:

A: Excellent.

B: Practically not durable level with many image defects

-Charging Characteristics-

Given the formula: ΔTP=(charging after 5000 sheets×toner density after 5000 sheets)/(initial charging×initial toner density), charging characteristics are determined under the following criteria.

The toner density refers to the ratio by weight of the toner in the developer measured for charging characteristics. The toner charging is evaluated by collecting the developer on a sleeve of the developing device and measuring it by a blow-off method (TB-200, manufactured by TOSHIBA CHEMICAL CORPORATION).

A: ΔTP of 0.65 to less than 1.2.

B: ΔTP of 0.5 to less than 0.65.

C: ΔTP of less than 0.5.

-Evaluation of Filming Upon Actuation of Recycle System-

With respect to Example 4, the occurrence of filming on the photoreceptor after the test is visually checked thorough a 50-power magnifying glass and evaluated under the following criteria.

AA: Not confirmed.

A: Confirmed with the magnifying glass although the image is not influenced.

B: Not practically problematic although the image is influenced.

C: Practically problematic.

As described above, the invention provides a toner for electrostatic image development which is capable of fixation at low temperatures and is excellent in the dispersibility and compatibility in binder resin and strength of a releasing agent contained in a toner, as well as an electrostatic image developer and an image forming method using the same.

What is claimed is:

1. A toner for electrostatic image development, comprising a crystalline ester compound synthesized by polymerizing a carboxylic acid component with an alcohol component, a non-crystalline resin, a colorant and a releasing agent, wherein the weight-average molecular weight of the crystalline ester compound is from 1000 to 4000, the number of carbon atoms in at least one component selected from the carboxylic acid component and the alcohol component is 10 or more, and the toner contains the releasing agent as a dispersion having an average dispersion diameter of about 0.3 to 0.8 μm.

2. The toner for electrostatic image development of claim 1, wherein the at least one component selected from the carboxylic acid component and the alcohol component contains a linear-chain structure having 10 or more carbon atoms in a main-chain moiety.

3. The toner for electrostatic image development of claim 2, wherein the linear-chain structure is an alkylene group having 10 or more carbon atoms.

4. The toner for electrostatic image development of claim 1, wherein the melting point of the toner is in the range of about 50 to 90° C., and satisfies the following equation (1):

$$0.9 \leqq Y/X \leqq 1.0 \quad (1)$$

wherein X represents the heat quantity (J/g) of the maximum endothermic peak of the toner for electrostatic image development after production, measured under heating from room temperature to 150° C. at an increasing temperature rate of 10° C./minute by a differential scanning calorimeter, and Y represents the heat quantity (J/g) of the maximum endothermic peak of the toner for electrostatic image development after making the measurement of the heat quantity X, measured under heating from 020 C. to 150° C. at an increasing temperature rate of 10° C./minute by a differential scanning calorimeter.

5. The toner for electrostatic image development of claim 1, wherein the standard deviation of dispersion diameter of the releasing agent is about 0.05 or less.

6. The toner for electrostatic image development of claim 1, wherein the degree of exposure of the releasing agent at the surface of the toner is about 5 to 12 atom %.

7. The toner for electrostatic image development of claim 1, wherein the toner further comprises a crystalline resin in a content of about 1 to 10% relative to the weight of the toner.

8. The toner for electrostatic image development of claim 7, wherein the toner contains a crystalline resin having a region in which the storage elastic modulus G' and loss elastic modulus G" are changed by 2 orders of magnitude or more for at least one difference in temperature range of 10° C. in the temperature range of 60 to 90° C.

9. The toner for electrostatic image development of claim 7, wherein the number-average molecular weight (Mn) of the crystalline resin is about 2000 or more.

10. The toner for electrostatic image development of claim 7, wherein the weight-average molecular weight (Mw) of the crystalline resin is about 5000 or more.

11. The toner for electrostatic image development of claim 1, wherein the small particle diameter-side particle size distribution index (GSDp-under) of the toner is about 1.27 or less.

12. The toner for electrostatic image development of claim 1, wherein the average circularity of the toner is about 0.94 to 0.99.

13. The toner for electrostatic image development of claim 1, which is produced through a particle formation process of forming colored resin particles, comprising the crystalline ester compound, the non-crystalline resin, the colorant and the releasing agent, in water, an organic solvent or a mixed solvent thereof and a process of washing and drying the colored resin particles.

14. The toner for electrostatic image development of claim 1, which is produced at least through forming aggregate particles in a dispersion comprising a mixture of a crystalline ester compound dispersion having the crystalline ester compound dispersed therein, the non-crystalline resin particle dispersion having the non-crystalline resin dispersed therein, a colorant dispersion having the colorant dispersed therein and a releasing agent dispersion having the releasing agent dispersed therein, and fusing the aggregated particles by heating the dispersion having the aggregated particles formed therein, to a temperature not lower than the glass transition temperature of the non-crystalline resin.

15. An electrostatic image developer comprising a toner containing a crystalline ester compound synthesized by polymerizing a carboxylic acid component with an alcohol component, a non-crystalline resin, a colorant and a releasing agent, wherein the weight-average molecular weight of the crystalline ester compound is from 1000 to 4000, the number of carbon atoms in at least one component selected from the carboxylic acid component and the alcohol component is 10 or more, and the toner contains the releasing agent as a dispersion having an average dispersion diameter of about 0.3 to 0.8 μm.

16. The electrostatic image developer of 15, which comprises the toner and a carrier, wherein the carrier has a core material and a resin layer covering the core material.

17. An image forming method comprising forming an electrostatic latent image on the surface of a latent image carrier, developing the electrostatic latent image with a toner-containing developer to form a toner image, transferring the toner image onto a recording medium, and fixing the toner image on the recording medium, wherein the toner comprises a crystalline ester compound synthesized by polymerizing a carboxylic acid component with an alcohol component, a non-crystalline resin, a colorant and a releasing agent, the weight-average molecular weight of the crystalline ester compound is from 1000 to 4000, the number of carbon atoms in at least one component selected from the carboxylic acid component and the alcohol component is 10 or more, and the toner contains the releasing agent as a dispersion having an average dispersion diameter of about 0.3 to 0.8 μm.

18. The image forming method of claim 17, wherein the layer constituting the outermost surface of the latent image carrier comprises a siloxane resin having a crosslinked structure.

19. The image forming method of claim 17, which comprises cleaning and recovering residual toner remaining on the surface of the latent image carrier after the transfer, and toner recycling where the residual toner recovered in the cleaning is re-utilized as the developer.

* * * * *